US007638030B2

(12) United States Patent
Nabeya et al.

(10) Patent No.: US 7,638,030 B2
(45) **Date of Patent: *Dec. 29, 2009**

(54) ELECTROLYTIC PROCESSING APPARATUS AND ELECTROLYTIC PROCESSING METHOD

(75) Inventors: Osamu Nabeya, Ohta-ku (JP); Masayuki Kumekawa, Ohta-ku (JP); Hozumi Yasuda, Ohta-ku (JP); Itsuki Kobata, Ohta-ku (JP); Takeshi Iizumi, Ohta-ku (JP); Nobuyuki Takada, Ohta-ku (JP); Koichi Fukaya, Ohta-ku (JP); Mitsuhiko Shirakashi, Ohta-ku (JP); Takayuki Saito, Fujisawa (JP); Yasushi Toma, Fujisawa (JP); Tsukuru Suzuki, Fujisawa (JP); Kaoru Yamada, Fujisawa (JP); Yuji Makita, Fujisawa (JP)

(73) Assignee: Ebara Corporation, Tokyo (JP)

( * ) Notice: Subject to any disclaimer, the term of this patent is extended or adjusted under 35 U.S.C. 154(b) by 1027 days.

This patent is subject to a terminal disclaimer.

(21) Appl. No.: 10/669,468

(22) Filed: Sep. 25, 2003

(65) Prior Publication Data

US 2004/0129569 A1 Jul. 8, 2004

Related U.S. Application Data

(63) Continuation-in-part of application No. 10/337,357, filed on Jan. 7, 2003, now Pat. No. 7,101,465, which is a continuation-in-part of application No. 10/296,333, filed as application No. PCT/JP02/01545 on Feb. 21, 2002, now abandoned.

(30) Foreign Application Priority Data

| | | |
|---|---|---|
| Mar. 25, 2002 | (JP) | 2002-084120 |
| Jul. 2, 2002 | (JP) | 2002-193775 |
| Jul. 3, 2002 | (JP) | 2002-194708 |
| Oct. 4, 2002 | (JP) | 2002-292935 |
| Dec. 20, 2002 | (JP) | 2002-370965 |
| Dec. 27, 2002 | (JP) | 2002-382129 |

(51) Int. Cl.
*C25F 7/00* (2006.01)
*B23H 5/06* (2006.01)

(52) U.S. Cl. ..... 205/652; 205/654; 204/198; 204/224 M; 204/227; 204/275.1

(58) Field of Classification Search ..... 204/198, 204/224 M, 227, 275.1; 205/652, 654
See application file for complete search history.

(56) References Cited

U.S. PATENT DOCUMENTS 3,883,383 A 5/1975 Leitz, Jr.

(Continued)

FOREIGN PATENT DOCUMENTS

EP 1 029 954 A1 9/1999

(Continued)

OTHER PUBLICATIONS

Co-pending U.S. Appl. No. 10/337,357, filed Jan. 7, 2003, entitled "*Electrolytic Processing Device and Substrate Processing Apparatus*".

(Continued)

*Primary Examiner*—Arun S Phasge
(74) *Attorney, Agent, or Firm*—Wenderoth, Lind & Ponack, L.L.P.

(57) ABSTRACT

An electrolytic processing apparatus which, while eliminating a CMP processing entirely or reducing a load on a CMP processing to the least possible extent, can process and flatten a conductive material formed in the surface of a substrate, or can remove (clean) extraneous matter adhering to the surface of a workpiece such as a substrate. The present invention includes an electrode section including a plurality of electrode members disposed in parallel, each electrode member including an electrode and an ion exchanger covering the surface of the electrode, a holder for holding a workpiece, which is capable of bringing the workpiece close to or into contact with the ion exchanger of the electrode member, and a power source to be connected to the electrode of each electrode member of the electrode section. The ion exchanger of the electrode member includes an ion exchanger having an excellent surface smoothness and an ion exchanger having a large ion exchange capacity.

24 Claims, 51 Drawing Sheets

U.S. PATENT DOCUMENTS

| | | | | |
|---|---|---|---|---|
| 5,258,109 | A | 11/1993 | Vaughan | |
| 6,368,493 | B1 * | 4/2002 | Mori et al. | 205/672 |
| 6,379,223 | B1 | 4/2002 | Sun et al. | |
| 6,440,295 | B1 | 8/2002 | Wang | |
| 6,602,396 | B2 * | 8/2003 | Mori et al. | 205/652 |
| 6,693,036 | B1 * | 2/2004 | Nogami et al. | 438/692 |
| 6,743,349 | B2 * | 6/2004 | Mori et al. | 205/652 |
| 6,875,335 | B2 * | 4/2005 | Mori et al. | 205/652 |
| 7,101,465 | B2 * | 9/2006 | Kobata et al. | 204/198 |
| 7,208,076 | B2 * | 4/2007 | Kobata et al. | 205/652 |

FOREIGN PATENT DOCUMENTS

| | | |
|---|---|---|
| EP | 1167585 A2 | 1/2002 |
| WO | 00/34995 | 6/2000 |
| WO | 03/054255 | 7/2003 |
| WO | 03/064734 | 8/2003 |

OTHER PUBLICATIONS

Co-pending U.S. Appl. No. 10/432,397, filed May 21, 2003, entitled "*Method and Device for Regenerating Ion Exchanger, and Electrolytic Processing Apparatus*".

European Search Report issued Dec. 3, 2007 in a European Application which is a foreign counter part of the present application.

* cited by examiner

ELECTROLYTIC PROCESSING APPARATUS AND ELECTROLYTIC PROCESSING METHOD

This application is a continuation-in-part of U.S. application Ser. No. 10/337,357 filed Jan. 7, 2003, now U.S. Pat. No. 7,101,465 which is a continuation-in-part of U.S. application Ser. No. 10/296,333 filed Nov. 22, 2002, now abandoned which is a 371 of PCT/JP02/01545 filed Feb. 21, 2002 and international application No. PCT/JP03/03599 filed Mar. 25, 2003.

BACKGROUND OF THE INVENTION

1. Field of the Invention

This invention relates to an electrolytic processing apparatus and electrolytic processing method, and more particularly to an electrolytic processing apparatus and electrolytic processing method useful for processing a conductive material formed in the surface of a substrate, especially a semiconductor wafer, or for removing impurities adhering to the surface of a substrate. The present invention also relates to a substrate holder for holding a substrate as a workpiece in such an electrolytic processing apparatus. Furthermore, the present invention relates to a substrate processing apparatus provided with the electrolytic processing apparatus.

2. Description of the Related Art

In recent years, instead of using aluminum or aluminum alloys as a material for forming circuits on a substrate such as a semiconductor wafer, there is an eminent movement towards using copper (Cu) which has a low electric resistivity and high electromigration endurance. Copper interconnects are generally formed by filling copper into fine recesses formed in the surface of a substrate. Various techniques are known for forming such copper interconnects, including chemical vapor deposition, sputtering, and plating. According to any such technique, a copper film is formed in the substantially entire surface of a substrate, followed by removal of unnecessary copper by chemical mechanical polishing (CMP).

FIGS. 1A through 1C illustrate, in sequence of process steps, an example of forming such a substrate W having copper interconnects. As shown in FIG. 1A, an insulating film 2, such as an oxide film of $SiO_2$ or a film of low-k material, is deposited on a conductive layer 1*a* in which semiconductor devices are formed, which is formed on a semiconductor base 1. Contact holes 3 and trenches 4 for interconnects are formed in the insulating film 2 by the lithography/etching technique. Thereafter, a barrier layer 5 of TaN or the like is formed on the surface, and a seed layer 7 as an electric supply layer for electroplating is formed on the barrier layer 5 by sputtering or CVD, or the like.

Then, as shown in FIG. 1B, copper plating is performed onto the surface of the substrate W to fill the contact holes 3 and the trenches 4 with copper and, at the same time, deposit a copper film 6 on the insulating film 2. Thereafter, the copper film 6 and the barrier layer 5 on the insulating film 2 are removed by chemical mechanical polishing (CMP) so as to make the surface of the copper film 6 filled in the contact holes 3 and the trenches 4 for interconnects and the surface of the insulating film 2 lie substantially on the same plane. An interconnection composed of the copper film 6 as shown in FIG. 1C is thus formed.

Components in various types of equipment have recently become finer and have required higher accuracy. As sub-micro manufacturing technology has commonly been used, the properties of materials are largely influenced by the processing method. Under these circumstances, in such a conventional machining method that a desired portion in a workpiece is physically destroyed and removed from the surface thereof by a tool, a large number of defects may be produced to deteriorate the properties of the workpiece. Therefore, it becomes important to perform processing without deteriorating the properties of the materials.

Some processing methods, such as chemical polishing, electrolytic processing, and electrolytic polishing, have been developed in order to solve this problem. In contrast with the conventional physical processing, these methods perform removal processing or the like through chemical dissolution reaction. Therefore, these methods do not suffer from defects, such as formation of an altered layer and dislocation, due to plastic deformation, so that processing can be performed without deteriorating the properties of the materials.

In recent years, metals of the platinum group or their oxides have become candidates for an electrode material for use in forming a capacitor, which utilizes a high dielectric material, on a semiconductor substrate. Among them, ruthenium, because of its good film-forming properties and good processibility for patterning, is being progressively studied as a feasible material.

The ruthenium formed on or adhering to the peripheral region or back surface of a substrate, i.e. the non-circuit region of the substrate, is not only unnecessary, but can also cause cross-contamination during later transfer, storage and various processing steps of the substrate, whereby, for instance, the performance of a dielectric material can be lowered. Accordingly, during the process for forming a ruthenium film or after carrying out some treatments of the formed ruthenium film, it is necessary to completely remove the unnecessary ruthenium film. Further, in the case of using ruthenium as an electrode material for forming a capacitor, a step for removing part of a ruthenium film formed on the circuit region of a substrate is needed.

Chemical mechanical polishing (CMP), for example, generally necessitates a complicated operation and control, and needs a considerably long processing time. In addition, a sufficient cleaning of a substrate must be conducted after the polishing treatment. This also imposes a considerable load on the slurry or cleaning liquid waste disposal. Accordingly, there is a strong demand for omitting CMP entirely or reducing a load upon CMP. Also in this connection, it is to be pointed out that though a low-k material, which has a low dielectric constant, is expected to be predominantly used in the future as a material for the insulating film, the low-k material has a low mechanical strength and therefore is hard to endure the stress applied during CMP processing. Thus, also from this standpoint, there is a demand for a process that enables the flattering of a substrate without giving any stress thereto.

Further, a method has been reported which performs CMP processing simultaneously with plating, viz. chemical mechanical electrolytic polishing. According to this method, the mechanical processing is carried out to the growing surface of a plating film, causing the problem of denaturing of the resulting film.

In the case of the above-mentioned conventional electrolytic processing or electrolytic polishing, the process proceeds through an electrochemical interaction between a workpiece and an electrolytic solution (aqueous solution of NaCl, $NaNO_3$, HF, HCl, $HNO_3$, NaOH, etc.). Since an electrolytic solution containing such an electrolyte must be used, contamination of a workpiece with the electrolyte cannot be avoided.

Further, when a fragile material, such as a low-k material, is processed in a semiconductor device manufacturing process, there is a fear of destruction of the material due to buckling, etc. It is therefore not possible with such a processing as CMP to apply a high surface pressure between a substrate and a polishing surface, whereby a sufficient polishing cannot be performed. Especially, in these days, it is desired to use copper or a low-dielectric constant material as an interconnect material of a substrate. The above problem becomes remarkable when such a fragile material is used. In the case of electrolytic processing, it is not necessary to apply a surface pressure between a substrate and a processing electrode. It is however possible that a surface pressure is produced when a substrate is brought in contact with a processing electrode, which could cause destruction of a semiconductor device. Accordingly, it is necessary even with electrolytic processing to prevent a high load from being applied onto a substrate.

In an electrochemical processing, ions as reactant species move onto the surface of a workpiece due to the electric field created between a processing electrode, feeding electrode and the workpiece. Accordingly, generation of an obstacle to the movement of ions will affect constancy and uniformity in processing. Such an obstacle may include a processing product which is generated during processing by the electrochemical reaction between the workpiece and the ions at the surface of the workpiece, a substance released from an ion exchanger during a relative movement between the ion exchanger and the workpiece, and bubbles (gas) generated by a side reaction at the surface of the workpiece and the electrode, etc. Such an obstacle, present between the electrode and the workpiece, impedes the migration of ions, and therefore prevents obtaining a constant and uniform processing amount. Bubbles, in particular, can also cause the formation of pits in the surface of the workpiece.

SUMMARY OF THE INVENTION

The present invention has been made in view of the above situation in the background art. It is therefore a first object of the present invention to provide an electrolytic processing apparatus and an electrolytic processing method which, while eliminating a CMP processing entirely or reducing a load on a CMP processing to the least possible extent, can process and flatten a conductive material formed in the surface of a substrate, or can remove (clean) extraneous matter adhering to the surface of a workpiece such as a substrate, and also to provide a substrate processing apparatus in which the electrolytic processing apparatus is incorporated.

It is a second object of the present invention to provide an electrolytic processing method and an electrolytic processing apparatus which can carry out processing of a substrate without destroying a device formed in the substrate even when processing a fragile material, and to provide a substrate holder usable in such an electrolytic processing apparatus.

It is a third object of the present invention to provide an electrolytic processing apparatus and an electrolytic processing method which can effectively remove gas bubbles inevitably generated upon electrochemical processing.

In order to achieve the above object, the present invention provides an electrolytic processing apparatus, comprising: an electrode section including a plurality of electrode members disposed in parallel, each electrode member comprising an electrode and an ion exchanger covering the surface of the electrode; a holder for holding a workpiece, which is capable of bring ing the workpiece close to or into contact with the ion exchanger of the electrode member; and a power source to be connected to the electrode of each electrode member of the electrode section, wherein the ion exchanger of the electrode member comprises an ion exchanger having an excellent surface smoothness and an ion exchanger having a large ion exchange capacity.

FIGS. 2 and 3 illustrate the principle of processing according to the present invention. FIG. 2 shows the ionic state in the reaction system when an ion exchanger 12*a* mounted on a processing electrode 14 and an ion exchanger 12*b* mounted on a feeding electrode 16 are brought into contact with or close to the surface of a workpiece 10, while a voltage is applied from a power source 17 to between the processing electrode 14 and the feeding electrode 16, and a fluid 18, such as ultrapure water, is supplied from a fluid supply section 19 to between the processing electrode 14, the feeding electrode 16 and the workpiece 10. FIG. 3 shows the ionic state in the reaction system when the ion exchanger 12*a* mounted on the processing electrode 14 is brought into contact with or close to the surface of the workpiece 10 and the feeding electrode 16 is directly contacted with the workpiece 10, while a voltage is applied from the power source 17 to between the processing electrode 14 and the feeding electrode 16, and the fluid 18, such as ultrapure water, is supplied from the fluid supply section 19 to between the processing electrode 14 and the workpiece 10.

When using a liquid, like ultrapure water, which itself has a large resistivity, it is preferred to bring the ion exchanger 12*a* into "contact" with the surface of the workpiece 10. This can lower the electric resistance, lower the voltage applied, and reduce the power consumption. Thus, the "contact" in the processing according to the present invention does not imply "press" for giving a physical energy (stress) to a workpiece as in CMP.

In FIGS. 2 and 3, water molecules 20 in the liquid 18, such as ultrapure water, are dissociated by the ion exchangers 12*a* and 12*b* into hydroxide ions 22 and hydrogen ions 24. The hydroxide ions 22 thus produced are carried, by the electric field between the workpiece 10 and the processing electrode 14 and by the flow of the liquid 18, to the surface of the workpiece 10 facing the processing electrode 14, whereby the density of the hydroxide ions 22 in the vicinity of the workpiece 10 is increased, and the hydroxide ions 22 are reacted with the atoms 10*a* of the workpiece 10. The reaction product 26 produced by reaction is dissolved in the liquid 18 such as ultrapure water, and removed from the workpiece 10 by the flow of the liquid 18 along the surface of the workpiece 10. Removal processing of the surface layer of the workpiece 10 is thus effected.

As will be appreciated from the above, the removal processing according to the present method is effected purely by the electrochemical interaction between the reactant ions and the workpiece. The present electrolytic processing thus clearly differs in the processing principle from a processing as by CMP according to which processing is effected by the combination of a physical interaction between a polishing member and a workpiece, and a chemical interaction between a chemical species in a polishing liquid and the workpiece. According to the present method, the portion of the workpiece 10 facing the processing electrode 14 is processed. Therefore, by moving the processing electrode 14, the workpiece 10 can be processed into a desired surface configuration.

Further, since the electrolytic processing apparatus according to the present invention performs removal processing of a workpiece solely by the dissolution reaction based on the electrochemical interaction, as distinct from a CMP apparatus which performs processing by the combination of the physical interaction between a polishing member and a workpiece, and the chemical interaction between a chemical species in a polishing liquid and the workpiece, the present electrolytic processing apparatus can perform removal processing of a material without impairing the properties of the material. Even when the material is of a low mechanical strength, such as the above-described low-k material, removal processing of the material can be effected without causing any physical interaction. Further, as compared to conventional electrolytic processing apparatuses, the apparatus of the present invention, because of the use as an electrolysis liquid a liquid having an electric conductivity of not more than 500 μS/cm, preferably pure water, more preferably ultrapure water, can remarkably reduce contamination of the surface of a workpiece with impurities and can facilitate disposal of waste liquid after the processing.

Further, by combining an ion exchanger having an excellent surface smoothness with an ion exchanger having a large ion exchange capacity, as described above, the defect of small ion exchange capacity of the ion exchanger having excellent surface smoothness can be compensated for by the ion exchanger having large ion exchange capacity.

Preferably, a through-hole for supplying a fluid to the ion exchanger is formed in the electrode of each electrode member of the electrode section.

The electrodes of the adjacent electrode members may be connected alternately to the cathode and to the anode of the power source.

The present invention provides another electrolytic processing apparatus, comprising: an electrode section including a plurality of electrode members disposed in parallel, each electrode member comprising an electrode and an ion exchanger covering the surface of the electrode; a holder for holding a workpiece, which is capable of bringing the workpiece close to or into contact with the ion exchanger of the electrode member; power source to be connected to the electrode of each electrode member of the electrode section, and a fluid supply nozzle for supplying a fluid between the workpiece and the ion exchanger of each electrode member. According to the apparatus, a fluid such as pure water or ultrapure water can be jetted and supplied between a workpiece and the ion exchanger of each electrode member.

The fluid supply nozzle preferably has a jet orifice for jetting the fluid toward the to-be-processed surface of the workpiece facing the electrode member. This makes it possible to jet the fluid, such as pure water or ultrapure water, toward the to-be-processed surface of the workpiece facing the electrode member, i.e. the portion of the workpiece in contact with the ion exchanger, whereby the fluid can be supplied over the entire to-be-processed surface.

It is preferred that the height of the fluid supply nozzle be lower than the height of the ion exchanger of the electrode member. This can prevent the fluid supply nozzle from contacting a workpiece when the workpiece is brought into contact with the ion exchanger of the electrode member.

The present invention provides still another electrolytic processing apparatus comprising an electrode member, the electrode member comprising an electrode and an ion exchanger covering the surface of the electrode, wherein a contact width restriction section is provided in the electrode member for restricting the substantial contact width between a workpiece and such a portion of the ion exchanger as usable in processing to a constant width when the workpiece is brought into contact with the ion exchanger of the electrode member to a certain extent of pressing or higher.

According to the apparatus, it becomes possible to keep the substantial contact width between the to-be-processed surface of a workpiece and the ion exchanger constant, enabling a uniform processing. The "extent of pressing" herein refers to the distance between the position of a workpiece when it comes into contact with the ion exchanger and the present position of the workpiece pressing down the ion exchanger. The "contact width" herein refers to the width of the contact area between the ion exchanger and a workpiece in a direction perpendicular to the long direction of the electrode member. Further, such expression as "substantial contact width is constant" herein means not involving a variation in contact width due to fine irregularities in the surface of a workpiece, and means contact width does not change due to a change in the distance between the workpiece and the processing electrode associated with a relative movement therebetween, to a vibration of the apparatus, etc.

The contact width restriction section is comprised, for example, of an insulating film attached to the front surface side or the back surface side of the ion exchanger. By the use of the insulating film, attached to the front surface side or back surface side of the ion exchanger, the contact width between the to-be-processed surface of a workpiece and the ion exchanger can be kept constant regardless of changes in the extent of pressing by the workpiece, whereby a uniform processing can be effected.

The contact width restriction section may be comprised of a member having no ion exchanger ability. The use of such a non-ion exchangeable member makes it possible to keep the width of the portion under processing constant regardless of changes in the extent of pressing by the workpiece, enabling a uniform processing. In this case, the member having no ion exchange ability is preferably formed integrally with the ion exchanger. In the case where the contact width restriction section is comprised of the above-described insulating film, the thickness of the insulating film may have some influence on the contact width. On the other hand, such influence can be eliminated by using as the contact width restriction section an ion exchanger formed integrally of a portion having an ion exchange ability and a portion having no ion exchange ability.

Alternatively, the contact width restriction section may be comprised of a raised portion provided in the ion exchanger. The provision of the raised portion makes it possible to keep the contact width between the to-be-processed surface of a workpiece and the ion exchanger constant regardless of changes in the extent of pressing by the workpiece, thus enabling a uniform processing.

In a preferred embodiment of the present invention, a plurality of the electrode members are disposed in parallel, and the electrodes of the adjacent electrode members are connected alternately to the cathode and to the anode of a power source.

The present invention provides still another electrolytic processing apparatus, comprising: an electrode section including a plurality of feeding electrodes and a plurality of processing electrodes; a holder for holding a workpiece, which is capable of bringing the workpiece close to or into contact with the feeding electrodes and the processing electrodes of the electrode section; a power source to be connected to each of the feeding electrodes and the processing electrodes of the electrode section; and a drive mechanism for causing a relative movement between the electrode section and the workpiece, wherein a through-hole is formed in each of the feeding electrodes and the processing electrodes for supplying a fluid to the surface of each of the feeding electrodes and the processing electrodes.

In the above apparatus, each feeding electrode and each processing electrode may be of the same shape, and the feeding electrodes and the processing electrodes may be disposed at even intervals. This can equalize the proportions of the feeding electrodes and the processing electrodes, making it possible to feed electricity to a workpiece more securely. By making a distance adjustment so that the resistance between the workpiece and the processing and feeding electrodes becomes smaller than the resistance between adjacent processing and feeding electrodes, ions are allowed to move between the workpiece and the processing and feeding electrodes.

Preferably, a fluid supply nozzle for supplying a fluid between the workpiece and the feeding electrodes, processing electrodes is disposed between each feeding electrode and each processing electrode. This enables the interspace between the workpiece and the processing electrodes, feeding electrodes to be filled with the fluid. Pure water or ultrapure water, or an electrolysis solution may be used as the fluid.

The present invention provides still another electrolytic processing apparatus, comprising: an electrode section including feeding electrodes and processing electrodes disposed alternately and in parallel; a holder for holding a workpiece, which is capable of bringing the workpiece close to or into contact with the feeding electrodes and the processing electrodes of the electrode section; a power source to be connected to each of the feeding electrodes and the processing electrodes of the electrode section; a drive mechanism for causing a relative movement between the electrode section and the workpiece; and a liquid supply section for supplying a liquid between the feeding electrodes, the processing electrodes and the workpiece.

Preferably, an ion exchanger is provided between the feeding electrodes, the processing electrodes and the workpiece.

The present invention provides a substrate processing apparatus, comprising: a substrate carry-in-and-out section for carrying in and out a substrate; an electrolytic processing apparatus; and a transfer device for transferring the substrate between the substrate carry-in-and-out section and the electrolytic processing apparatus, wherein the electrolytic processing apparatus comprises: (i) an electrode section including a plurality of electrode members disposed in parallel, each electrode member comprising an electrode and an ion exchanger covering the surface of the electrode; (ii) a holder for holding the substrate, which is capable of bringing the substrate close to or into contact with the ion exchanger of the electrode member; and (iii) a power source to be connected to the electrode of each electrode member of the electrode section, wherein the ion exchanger of the electrode member comprises an ion exchanger having an excellent surface smoothness and an ion exchanger having a large ion exchange capacity.

The present invention provides another substrate processing apparatus, comprising: a substrate carry-in-and-out section for carrying in and out a substrate; an electrolytic processing apparatus; and a transfer device for transferring the substrate between the substrate carry-in-and-out section and the electrolytic processing apparatus, wherein the electrolytic processing apparatus comprises: (i) an electrode section including a plurality of feeding electrodes and a plurality of processing electrodes; (ii) a substrate holder for holding the substrate, which is capable of bringing the substrate close to or into contact with the electrode section; (iii) a power source to be connected to each of the electrodes of the electrode section; and (iv) a drive mechanism for causing a relative movement between the electrode section and the substrate, wherein a through-hole is formed in each of the feeding electrodes and the processing electrodes for supplying a fluid to the surface of each of the feeding electrodes and the processing electrodes.

The present invention provides still another substrate processing apparatus, comprising: a substrate carry-in-and-out section for carrying in and out a substrate; an electrolytic processing apparatus; and a transfer device for transferring the substrate between the substrate carry-in-and-out section and the electrolytic processing apparatus, wherein the electrolytic processing apparatus comprises: (i) an electrode section including a plurality of feeding electrodes and a plurality of processing electrodes; (ii) a substrate holder for holding the substrate, which is capable of bringing the substrate close to or into contact with the electrode section; (iii) a power source to be connected to each of the electrodes of the electrode section; (iv) a drive mechanism for causing a relative movement between the electrode section and the substrate; and (v) a processing liquid supply mechanism for supplying a processing liquid between the substrate and the electrode section.

The present invention provides an electrolytic processing method for electrolytically processing the surface of a workpiece, comprising: bringing the workpiece into contact with a processing electrode, the processing electrode having an ion exchanger disposed on its surface and having a narrower width than the workpiece; and processing the surface of the workpiece while allowing the processing electrode and the workpiece to make a relative movement, wherein the substantial contact width between the workpiece and such a portion of the ion exchanger as used in processing is kept constant during the processing.

In a preferred embodiment of the present invention, at least the portion of the ion exchanger exposed on the surface of the processing electrode is brought into a substantial contact with the workpiece over the full width of the exposed portion.

The present invention provides another electrolytic processing method, comprising: bringing a workpiece close to or into contact with a processing electrode; applying a voltage between the processing electrode and a feeding electrode that feeds electricity to the workpiece; supplying a fluid between the workpiece and at least one of the processing electrode and the feeding electrode; and processing the surface of the workpiece while allowing the processing electrode and the workpiece to make a first relative movement, which is a relative reciprocating movement in a certain direction, and, at the same time, allowing the workpiece and the processing electrode to make a second relative movement, which is a relative movement in the certain direction for a distance corresponding to an integral multiple of a pitch as determined in the processing amount distribution of the workpiece in the direction, obtained in the first relative movement.

According to this electrolytic processing method, in addition to the first relative movement between the processing electrode and a workpiece, i.e. a relative reciprocating movement in a certain direction, the workpiece and the processing electrode are allowed to make the second relative movement in the certain direction for a distance corresponding to an integral multiple of a pitch as determined in the processing amount distribution of the workpiece in the certain direction, obtained in the first relative movement. This can eliminate unevenness in the amount of processing by the processing electrode, thus making it possible to uniformly process the entire surface of the workpiece.

In a preferred embodiment of the present invention, the processing electrode is comprised of a plurality of electrode members disposed in parallel, each electrode member comprising an electrode and an ion exchanger covering the surface of the electrode. This can make smaller the moving distance in the relative movement between the processing electrode and the workpiece, leading to a smaller footprint of the apparatus. Further, a moving mechanism of a simple structure can be employed, lowering the cost of the apparatus.

The speed of the first relative movement may be changed. Further, the second relative movement may be a reciprocating movement. The moving distance in the reciprocating movement of the second relative movement may differ between the forward movement and the backward movement.

In a preferred embodiment, the second relative movement is repeated, and the moving direction of the workpiece in the second relative movement is changed with the movement in the certain direction in the second relative movement as a unit. According to this embodiment, even when there is some variation in the processing rate of the processing electrode, the variation can be evened out on the workpiece, whereby the unevenness of processing can be eliminated as a whole.

The present invention provides still another electrolytic processing method, comprising: bringing a workpiece close to or into contact with a processing electrode; applying a voltage between the processing electrode and a feeding electrode that feeds electricity to the workpiece; supplying a fluid between the workpiece and at least one of the processing electrode and the feeding electrode; and processing the surface of the workpiece while allowing the processing electrode and the workpiece to make a first relative movement and, at the same time, allowing the workpiece and the processing electrode to make a second relative movement in a certain direction, wherein the second relative movement is repeated, and the moving direction of the workpiece in the second relative movement is changed with the movement in the certain direction in the second relative movement as a unit.

In a preferred embodiment of the present invention, the workpiece is rotated through a predetermined rotational angle so as to change the moving direction of the workpiece in the second relative movement. In this case, it is possible to repeat the rotation of predetermined rotational angle so that the workpiece may make at least one revolution until completion of the electrolytic processing of the workpiece.

In a preferred embodiment of the present invention, the position of the workpiece relative to the processing electrode in the second relative movement is changed with the movement in the certain direction in the second relative movement as a unit. According to this embodiment, even when there is some variation in the processing rate depending upon the position of the processing electrode, the variation can be evened out on the workpiece, whereby the unevenness of processing can be eliminated as a whole.

In a preferred embodiment of the present invention, the workpiece is not allowed to rotate during the second relative movement.

It is preferred to change the voltage and/or electric current applied between the processing electrode and the feeding electrode during electrolytic processing. By changing the voltage and/or electric current applied between the processing electrode and the feeding electrode during electrolytic processing, the processing rate can be controlled properly, so that a film on a workpiece can be processed into a desired thickness.

It is possible to change the speed of the second relative movement during electrolytic processing. By changing the speed of the second relative movement during electrolytic processing, the processing rate can be controlled properly, so that a film on a workpiece can be processed into a desired thickness.

The present invention provides still another electrolytic processing apparatus, comprising: a processing electrode that can come close to or into contact with a workpiece; a feeding electrode for feeding electricity to the workpiece; a holder for holding the workpiece and bringing the workpiece close to or into contact with the processing electrode; a plurality of ion exchangers disposed between the workpiece and at least one of the processing electrode and the feeding electrode; and a feed mechanism for feeding and changing at least one of the plurality of ion exchangers.

According to this electrolytic processing apparatus, the feed mechanism can carry out a change of an ion exchanger for a new one automatically at a high speed. Accordingly, the downtime of the apparatus for a change of ion exchanger can be shortened and the throughput can be increased.

It is possible to provide a plurality of feed mechanisms each for each of the plurality of ion exchangers. This makes it possible to change only an ion exchange in need of change by the corresponding feed mechanism, lowering the running cost of the apparatus.

In a preferred embodiment of the present invention, the change cycle of an ion exchanger that does not come close to or into contact with the workpiece is shorter than that of an ion exchanger that comes close to or into contact with the workpiece. In this case, it is preferable to change the ion exchanger that does not come close to or into contact with the workpiece by the feed mechanism.

In a preferred embodiment of the present invention, of the plurality of ion exchangers, the change cycle of an ion exchanger having a large ion exchange capacity is shorter than that of the other ion exchanger(s).

When, for example, an ion exchanger having a surface smoothness is used as an ion exchanger that comes close to or into contact with a workpiece and an ion exchanger having a large ion exchange capacity is used as an ion exchanger that does not come close to or into contact with the workpiece, because of the small ion exchanger capacity of the ion exchanger having a surface smoothness, taking-in of the processing product is mainly effected by the ion exchanger having a large ion exchange capacity. In view of this, the change cycle of the ion exchanger having a large ion exchange capacity, which has taken in the processing product, may be shortened compared to that of the ion exchanger having a surface smoothness. Thus, by changing only the ion exchanger having a large ion exchange capacity while using the expensive ion exchanger having a surface smoothness to its wear limit without change, the running cost of the apparatus can be lowered.

It is possible to carry out the change of ion exchanger by the feed mechanism during electrolytic processing. Since the change of ion exchanger can be carried out without stopping the apparatus, the downtime of the apparatus can be further shortened.

The present invention provides still another electrolytic processing apparatus, comprising: a processing electrode that can come close to or into contact with a workpiece; a feeding electrode for feeding electricity to the workpiece; a holder for holding the workpiece and bringing the workpiece close to or into contact with the processing electrode; an ion exchanger disposed between the workpiece and at least one of the processing electrode and the feeding electrode; a water-permeable member superimposed on the surface of the ion exchanger; and a feed mechanism for feeding and changing the ion exchanger. It is thus possible to use a water-permeable member by superimposing it on the surface of the ion exchanger. In this case, it is preferred to make the change cycle of the ion exchange shorter than that of the water-permeable member.

In a preferred embodiment of the present invention, the apparatus includes a plurality of rotatable members and a plurality of intervening members intervening between the rotatable members, and the ion exchanger is disposed such that it threads between the rotatable members and the intervening members. In this case, it is preferred that the rotatable member be at least one of the processing electrode and the feeding electrode.

Preferably, the apparatus further comprises a regeneration device for regenerating the ion exchanger that is circulated by the feed mechanism. The provision of such a regeneration device enables an automatic regeneration of the ion exchanger that has been used in electrolytic processing, thereby lowering the running cost and, at the same, shortening the downtime.

The present invention provides still another electrolytic processing apparatus, comprising: a processing electrode that can come close to or into contact with a workpiece; a feeding electrode for feeding electricity to the workpiece; and a holder for holding the workpiece and bringing the workpiece close to or into contact with the processing electrode, wherein the processing electrode or the feeding electrode is comprised of a plurality of electrodes, and the respective electrodes can move close to or apart from the workpiece independently.

In a preferred embodiment of the present invention, an ion exchanger is disposed between the workpiece and at least one of the processing electrode and the feeding electrode.

The present invention provides a substrate holder for holding a substrate and bringing the substrate into contact with a processing electrode to carry out electrolytic processing of the substrate, comprising: a flange portion connected to a shaft; and a chucking member which can move with respect to the flange portion in the axial direction of the shaft and which holds the substrate.

The present invention provides still another electrolytic processing apparatus comprising: a processing electrode; a feeding electrode for feeding electricity to a substrate; a substrate holder for holding the substrate and bringing the substrate into contact with the processing electrode; a power source for applying a voltage between the processing electrode and the feeding electrode; and a drive section for allowing the substrate held by the substrate holder and the processing electrode to make a relative movement, wherein the substrate holder is a substrate holder for holding the substrate and bringing the substrate into contact with the processing electrode to carry out electrolytic processing of the substrate and comprises: a flange portion connected to a shaft; and a chucking member which can move with respect to the flange portion in the axial direction of the shaft and which holds the substrate. It is preferred that an ion exchange be disposed between the substrate and at least one of the processing electrode and the feeding electrode. Further, the apparatus preferably comprises a fluid supply section for supplying a fluid between the substrate and at least one of the processing electrode and the feeding electrode in which the ion exchanger is disposed.

The present invention provides still another electrolytic processing method, comprising: providing a processing electrode and a feeding electrode; applying a voltage between the processing electrode and the feeding electrode; holding a substrate by means of a substrate holder, the holder including a flange portion connected a shaft and a chucking member for holding the substrate; and allowing the substrate to be in contact with the processing electrode while allowing the substrate and the processing electrode to make a relative movement, thereby processing the surface of the substrate. It is preferred that an ion exchanger be disposed between the substrate and at least one of the processing electrode and the feeding electrode.

In a preferred embodiment of the present invention, the method further comprises supplying a fluid to a first pressure chamber formed between the flange portion and the chucking member to pressurize the first pressure chamber, thereby bringing the substrate held by the chucking member into contact with the processing electrode.

According to this embodiment, it is possible to arbitrarily control a pressure at which the substrate contacts the processing electrode by adjusting the pressure of the fluid supplied to the first pressure chamber. Accordingly, the surface pressure between the substrate and the processing electrode can be so controlled that it is lower than a pressure at which a semiconductor devices can be destroyed, making it possible to process the substrate without destroying a fragile material.

It is preferred to adjust the pressure of the fluid supplied to the first pressure chamber so that the pressure applied to the substrate from the processing electrode or the ion exchanger becomes not more than 19.6 kPa (200 gf/cm$^2$), more preferably not more than 6.86 kPa (70 gf/cm$^2$), most preferably not more than 686 Pa (7 gf/cm$^2$, 0.1 psi), and carry out processing of the substrate under such a low load.

Preferably, the first pressure chamber is defined by the flange portion, the chucking member and an elastic member linking the flange portion and the chucking member.

If a spherical bearing is provided between the flange portion and the shaft so that the whole substrate holder can tilt with respect to the shaft, a torque will be generated with the spherical bearing as a center. The torque becomes larger in proportion to the distance from the center of the spherical bearing. There is therefore a case where a stable processing cannot be carried out, depending upon the conditions, when the distance between the to-be-processed surface of the substrate and the center of the spherical bearing is large. According to the present invention, such a spherical bearing is not employed, but instead a gimbal mechanism and the first pressure chamber are formed by the elastic member linking the flange portion and the chucking member, and the center of gravity of the substrate holder is low. Further, the chucking member can move vertically independent of the flange portion, and can float against the pressure of the fluid in the first pressure chamber. Accordingly, the above-described torque is not generated or, if any, is small.

In a preferred embodiment of the present invention, a weight of a predetermined weight is attached to the chucking member to adjust the pressure of the substrate to the processing electrode. According to this embodiment, the surface pressure applied to the substrate can be adjusted by attaching the weight of an appropriate weight to the chucking member. Thus, the surface pressure applied to the substrate can be made low with such a simple structure, enabling a low-load processing.

The substrate holder may further comprise an air cylinder for pressing the chucking member downward. By appropriately controlling the air cylinder, the force pressing the chucking member downward, i.e. the surface pressure applied to the substrate, can be adjusted, making it possible to make the surface pressure applied to the substrate low and effect a low-load processing. Further, even in the case where the processing parameters, etc. are altered, the case may be dealt with by simply controlling the pressing force of the air cylinder.

In a preferred embodiment of the present invention, the chucking member includes a chucking plate having a through-hole communicating with the substrate, a stopper plate provided above the chucking plate, and a second pressure chamber formed between the chucking plate and the stopper plate, and the second pressure chamber is depressurized by drawing a fluid from the second pressure chamber, thereby attracting the substrate to the chucking member.

Preferably, a retainer ring having an inward-protruding portion is mounted to the flange portion, and a protrusion for engaging the protruding portion of the retainer ring are provided in the chucking member. By the engagement of the protrusion of the chucking member with the protruding portion of the retainer ring, the downward movement of the chucking member is restricted to a certain position.

Preferably, a water-permeable member is disposed between the substrate and at least one of the processing electrode and the feeding electrode.

The present invention provides still another electrolytic processing apparatus, comprising: an electrode section including a plurality of electrode members disposed in parallel, each electrode member comprising an electrode and a processing member mounted on the surface of the electrode; a holder for holding a workpiece, which is capable of bringing the workpiece close to or into contact with the processing member of the electrode member; and a power source to be connected to the electrode of each electrode member of the electrode section, wherein contact members that contact the surface of the workpiece are disposed between the plurality of electrode members.

It is preferred to mount on each contact member a buffer member formed of a material having such an elasticity as not damage the surface of the workpiece. Further, the processing member comprises preferably an ion exchanger.

According to the apparatus, when the workpiece is brought into contact with the processing members (ion exchanger) of the electrode members, the surface of the workpiece comes to be supported by the contact members. Thus, after pressing the workpiece against the processing members (ion exchanger) to a certain extent, the workpiece comes into contact with the upper surfaces of the contact members. Accordingly, if it is attempted to further press the workpiece against the processing members, the pressing force is received by the contact members, and therefore the contact area between the workpiece and the processing members (ion exchanger) does not change. Thus, according to the present invention, the workpiece can be prevented from tilting, and the contact area can be kept constant, whereby a uniform processing can be effected.

The present invention provides still another electrolytic processing apparatus, comprising: a processing electrode; a feeding electrode for feeding electricity to a substrate; a substrate holder for holding the substrate and bringing the substrate close to or into contact with the processing electrode and the feeding electrode; a power source for applying a voltage between the processing electrode and the feeding electrode; a drive section for allowing the substrate held by the substrate holder and the processing electrode, feeding electrode to make a relative movement; a fluid supply section for supplying a fluid between the substrate and at least one of the feeding electrode; and a partition for at least partly separating the flow of the fluid between the processing electrode and the substrate from the flow of the fluid between the feeding electrode and the substrate.

It is preferred that an ion exchanger be disposed between the workpiece and at least one of the processing electrode and the feeding electrode. Further, the partition is preferably formed of an elastic material. Examples of the elastic material include a nonwoven fabric, a foamed polyurethane, a PVA sponge, a polyurethane sponge, and an ion exchanger.

Preferably, the apparatus further comprises a second partition for separating the flow of the fluid, flowing in the region isolated by adjacent partitions, into a flow on the processing electrode or feeding electrode side and a flow on the workpiece side. The fluid is, for example, ultrapure water, pure water, a liquid having an electric conductivity (herein at 1 atm, 25° C.) of not more than 500 μS/cm, or an electrolysis solution. Further, the apparatus preferably includes a fluid suction section for sucking in the fluid flowing in the region isolated by adjacent partitions.

With such a construction, upon electrolytic processing which is an electrochemical processing, the flow of the liquid flowing between the workpiece and the feeding electrode at which bubbles (gas) generation reaction mainly occurs can at least partly be separated from the flow of the liquid flowing between the processing electrode and the workpiece and the respective flows can be controlled independently, whereby the bubbles generated can be removed effectively.

The present invention provides still another electrolytic processing apparatus, comprising: an electrode section including a plurality of electrodes; a holder for holding a workpiece, which is capable of bringing the workpiece close to or into contact with the electrodes; and a power source to be connected to each electrode of the electrode section, wherein contact members that contact the surface of the workpiece are disposed between the plurality of electrodes.

The present invention provides still another electrolytic processing method, comprising: providing a processing electrode and a feeding electrode; applying a voltage between the processing electrode and the feeding electrode; bringing a workpiece close to or into contact with the processing electrode; and processing the surface of the workpiece while allowing the workpiece and the processing electrode to make a relative movement, wherein the flow of a fluid between the processing electrode and the workpiece is at least partly separated from the flow of the fluid between the feeding electrode and the workpiece. It is preferred that an ion exchanger be disposed between the workpiece and at least one of the processing electrode and the feeding electrode.

DETAILED DESCRIPTION OF THE PREFERRED EMBODIMENT

Preferred embodiments of the present invention will now be described with reference to the drawings. Though the below-described embodiments refer to the application to electrolytic processing apparatuses that use a substrate as a workpiece to be processed and process the substrate, the present invention is of course applicable to besides the substrate.

Figure 1A:
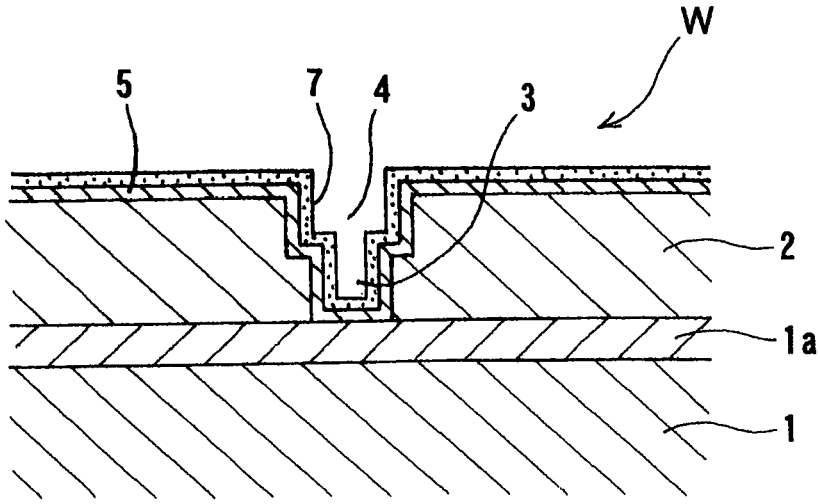
FIGS. 1A through 1C are diagrams illustrating, in sequence of process steps, an example of the production of a substrate with copper interconnects.
Figure 1B:
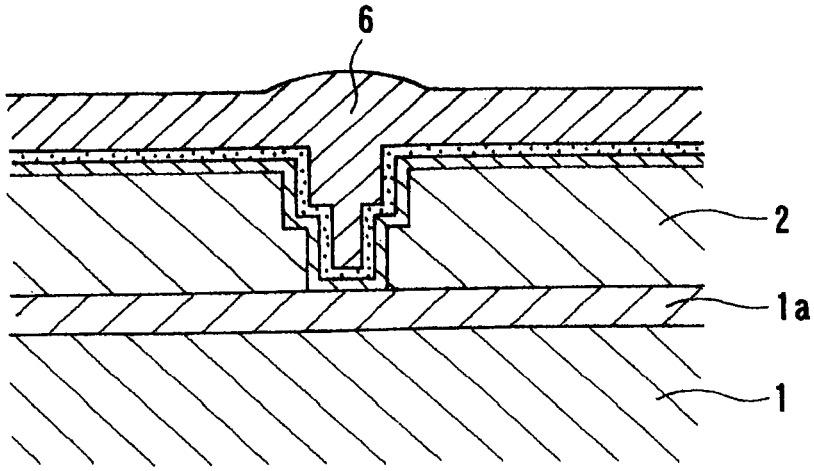
Figure 1C:
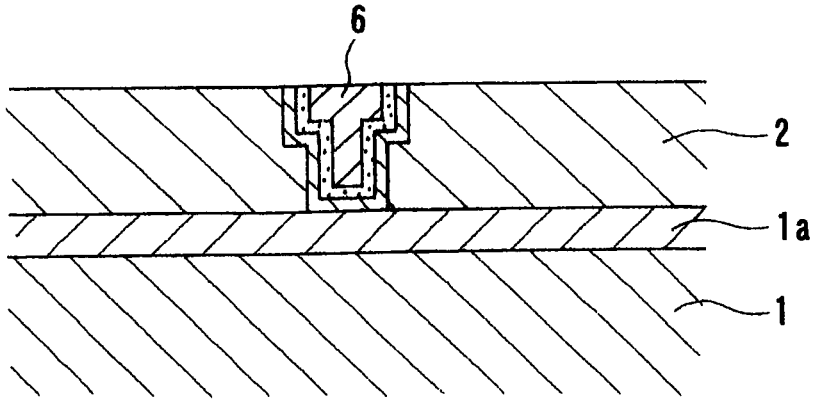
Figure 2:
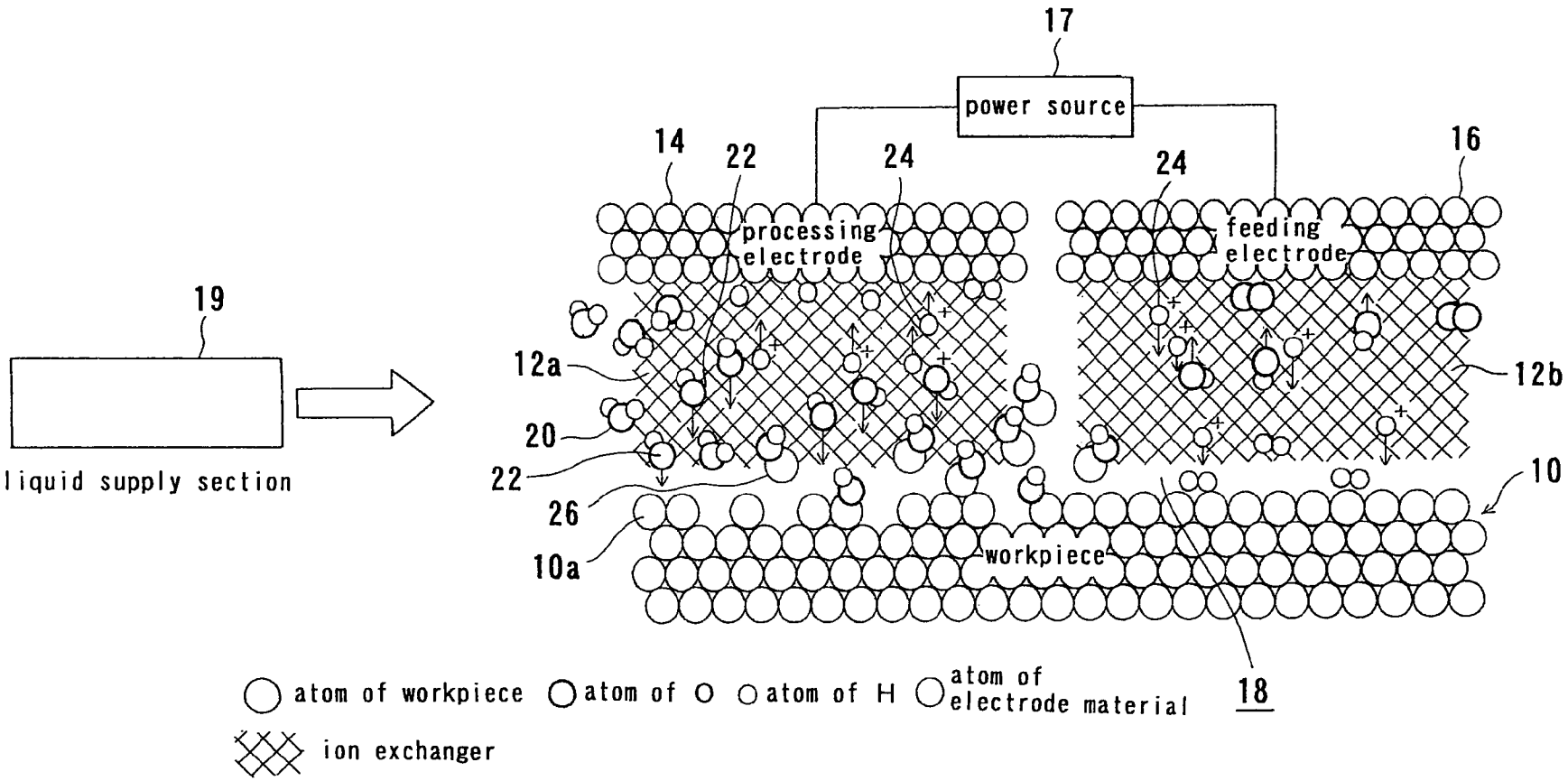
FIG. 2 is a diagram illustrating the principle of electrolytic processing according to the present invention as carried out by allowing a processing electrode and a feeding electrode, both having an ion exchanger mounted thereon, to be closed to a substrate (workpiece), and supplying pure water or a fluid having an electric conductivity of not more than 500 μS/cm between the processing electrode, the feeding electrode and the substrate (workpiece)
Figure 3:
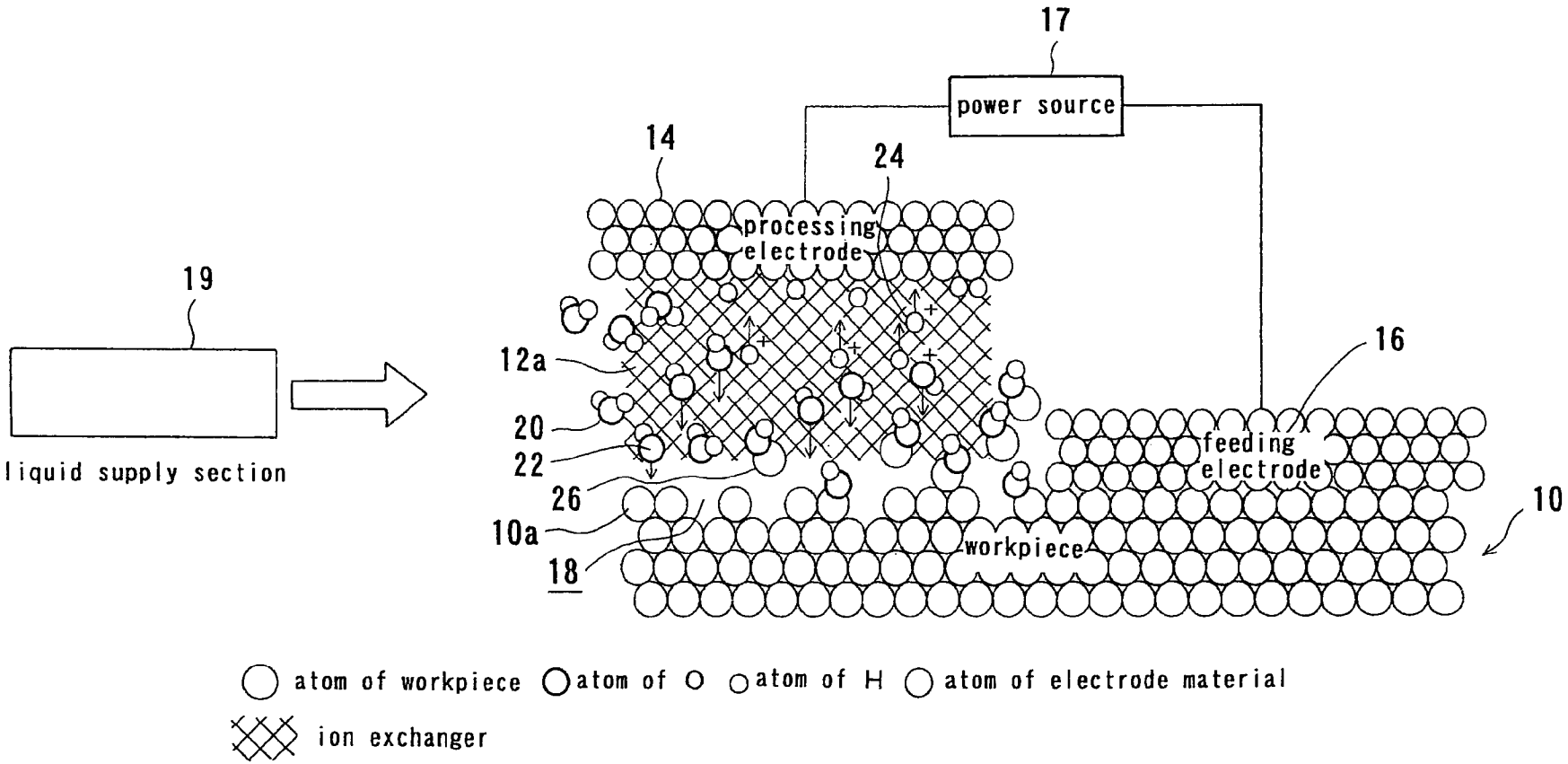
FIG. 3 is a diagram illustrating the principle of electrolytic processing according to the present invention as carried out by mounting the ion exchanger only on the processing electrode and supplying the fluid between the processing electrode and the substrate (workpiece)
Figure 4:
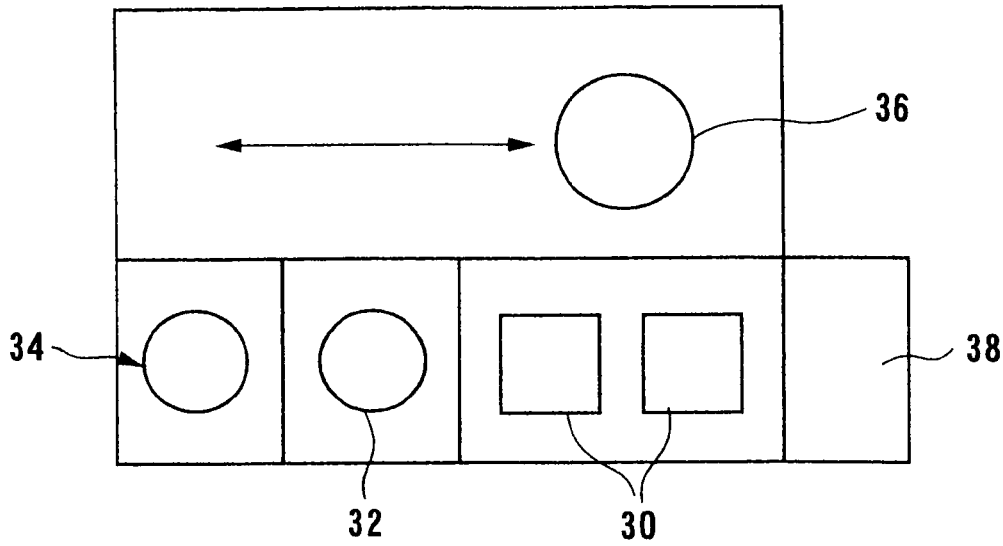
FIG. 4 is a plan view illustrating a construction of a substrate processing apparatus according to an embodiment of the present invention.

FIG. 4 is a plan view illustrating a construction of a substrate processing apparatus according to an embodiment of the present invention. As shown in FIG. 4, the substrate processing apparatus comprises a pair of the loading/unloading units 30 as a carry-in and carry-out section for carrying in and carrying out a substrate W, e.g. a substrate W as shown in FIG. 1B, the reversing machine 32 for reversing the substrate W, and an electrolytic processing device 34. These devices are disposed in series. A transport robot 36 as a transport device, which can move parallel to these devices for transporting and transferring the substrate W therebetween, is provided. The substrate processing apparatus is also provided with a monitor 38, adjacent to the loading/unloading units 30, for monitoring a voltage applied between the bellow-described processing electrodes and the feeding electrodes upon electrolytic processing in the electrolytic processing device 34, or an electric current flowing therebetween.

Figure 5:
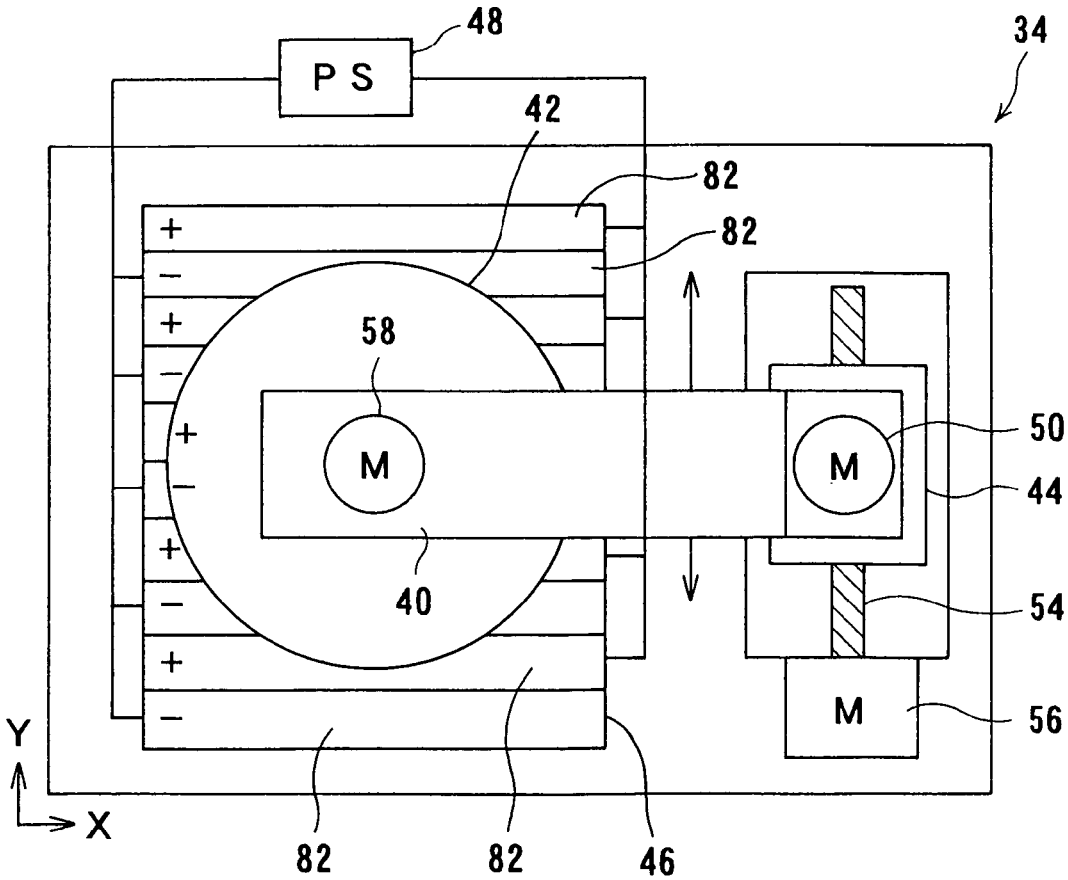
FIG. 5 is a plan view of an electrolytic processing apparatus according to an embodiment of the present invention, which is provided in the substrate processing apparatus shown in FIG. 4.
Figure 6:
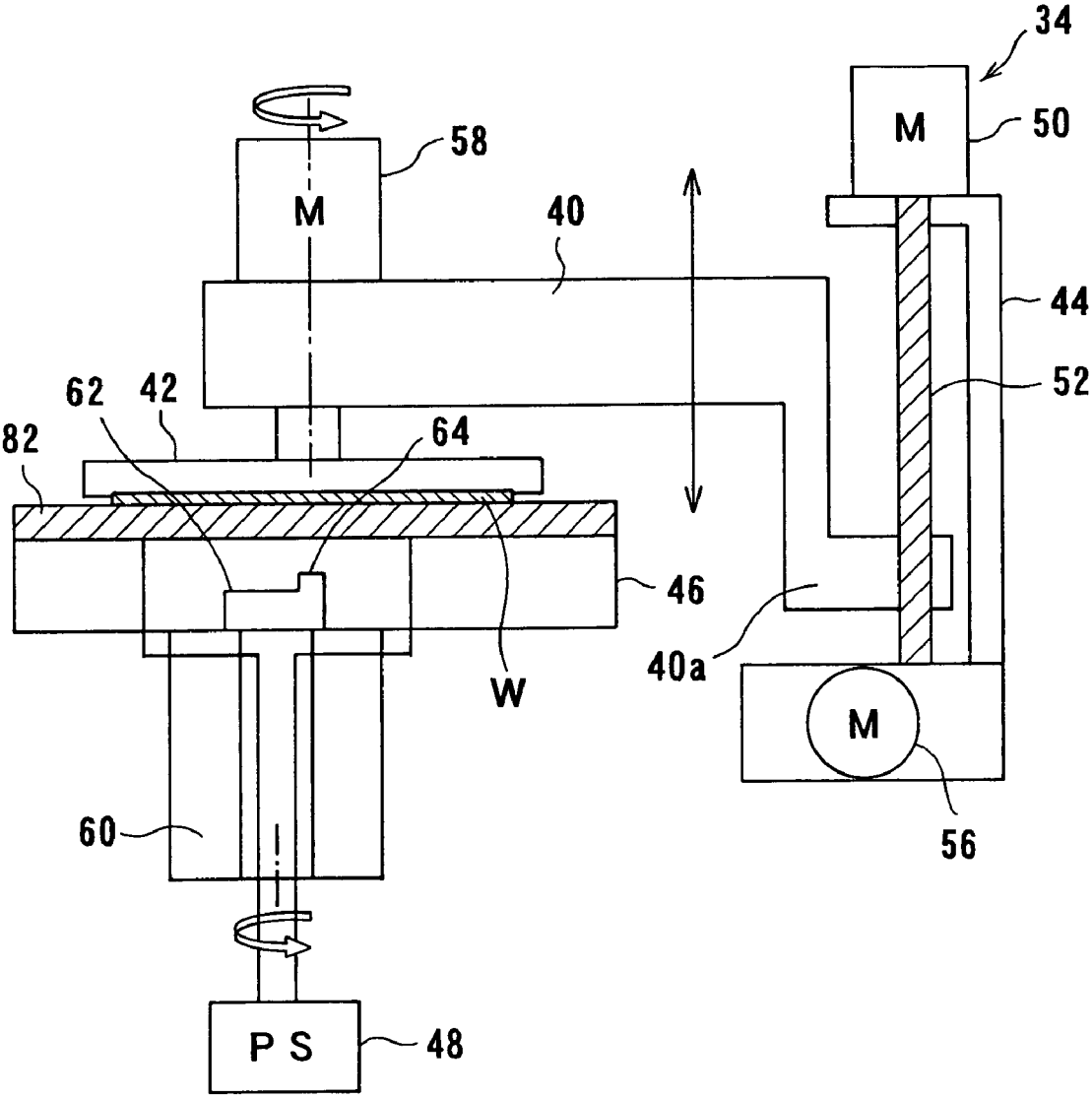
FIG. 6 is a vertical sectional view of FIG. 5.

FIG. 5 is a plan view showing the electrolytic processing apparatus 34 in the substrate processing apparatus, and FIG. 6 is a vertical sectional view of FIG. 5. As shown in FIGS. 5 and 6, the electrolytic processing apparatus 34 includes an arm 40 that can move vertically and make a reciprocation movement in a horizontal plane, a substrate holder 42, supported at the free end of the arm 40, for attracting and holding the substrate W with its front surface facing downward (face-down), moveable flame 44 to which the arm 40 is attached, a rectangular electrode section 46, and a power source 48 connected to the electrode section 46. In this embodiment, the size of the electrode section 46 is designed to have a slightly larger diameter than the diameter of the substrate W to be held by the substrate holder 42.

As shown in FIGS. 5 and 6, a vertical-movement motor 50 is mounted on the upper end of the moveable flame 44. A ball screw 52, which extends vertically, is connected to the vertical-movement motor 50. The base 40*a* of the arm 40, which moves up and down via a ball screw 52 by the actuation of the vertical-movement motor 50, is connected to the ball screw 52. The moveable flame 44, which itself moves back-and-forth in a horizontal plane with the arm 40 by the actuation of a reciprocating motor 56, is connected to a ball screw 54 that extends horizontally.

The substrate holder 42 is connected to a substrate-rotating motor 58 supported at the free end of the arm 40. The substrate holder 42 is rotated by the actuation of the substrate-rotating motor 58. The arm 40 can move vertically and make a reciprocation movement in the horizontal direction, as described above, the substrate holder 42 can move vertically and make a reciprocation movement in the horizontal direction integrated with the arm 40.

The hollow motor 60 is disposed below the electrode section 46. A drive end 64 is formed at the upper end portion of the main shaft 62 and arranged eccentrically position to the center of the main shaft 62. The electrode section 46 is rotatably coupled to the drive end 64 via a bearing (not shown) at the center portion thereof. Three or more rotation-prevention mechanisms are provided in the circumferential direction between the electrode section 46 and the hollow motor 60.

Figure 7A:
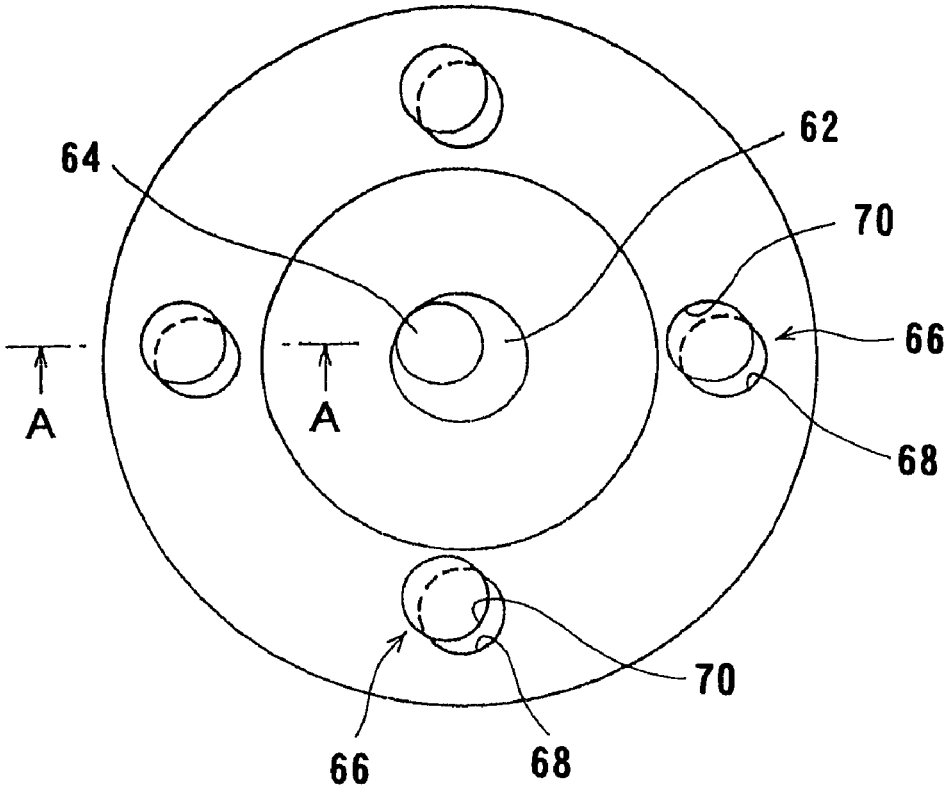
FIG. 7A is a plan view of the rotation-prevention mechanism of the electrolytic processing apparatus of FIG. 5.
Figure 7B:
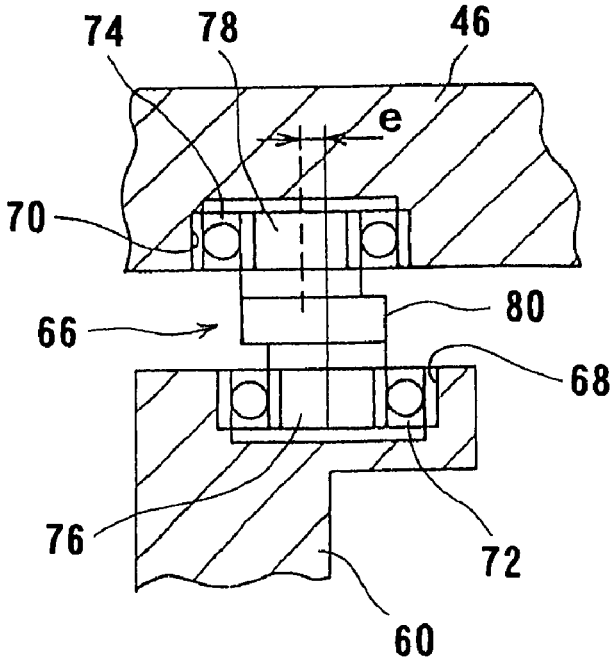
FIG. 7B is a sectional view taken along the line A-A of FIG. 7A.

FIG. 7A is a plan view showing the rotation-prevention mechanisms of this embodiment, and FIG. 7B is a cross-sectional view taken along the line A-A of FIG. 7A. As shown in FIGS. 7A and 7B, three or more (four in FIG. 7A) rotation-prevention mechanisms 66 are provided in the circumferential direction between the electrode section 46 and the hollow motor 60. As shown in FIG. 7B, a plurality of depressions 68, 70 are formed at equal intervals in the circumferential direction at the corresponding positions in the upper surface of the hollow motor 60 and in the lower surface of the electrode section 46. Bearings 72, 74 are fixed in each depression 68, 70, respectively. A connecting member 80, which has two shafts 76, 78 that are eccentric to each other by eccentricity "e", is coupled to each pair of the bearings 72, 74 by inserting the respective ends of the shafts 76, 78 into the bearings 72, 74. The eccentricity of the drive end 64 against to the center of the main shaft 62 of the hollow motor 60 is also "e". Accordingly, the electrode section 46 is allowed to make a revolutionary movement with the distance between the center of the main shaft 62 and the drive end 64 as radius "e", without rotation about its own axis, i.e. the so-called scroll movement (translational rotation movement) by the actuation of the hollow motor 60.

Figure 8:
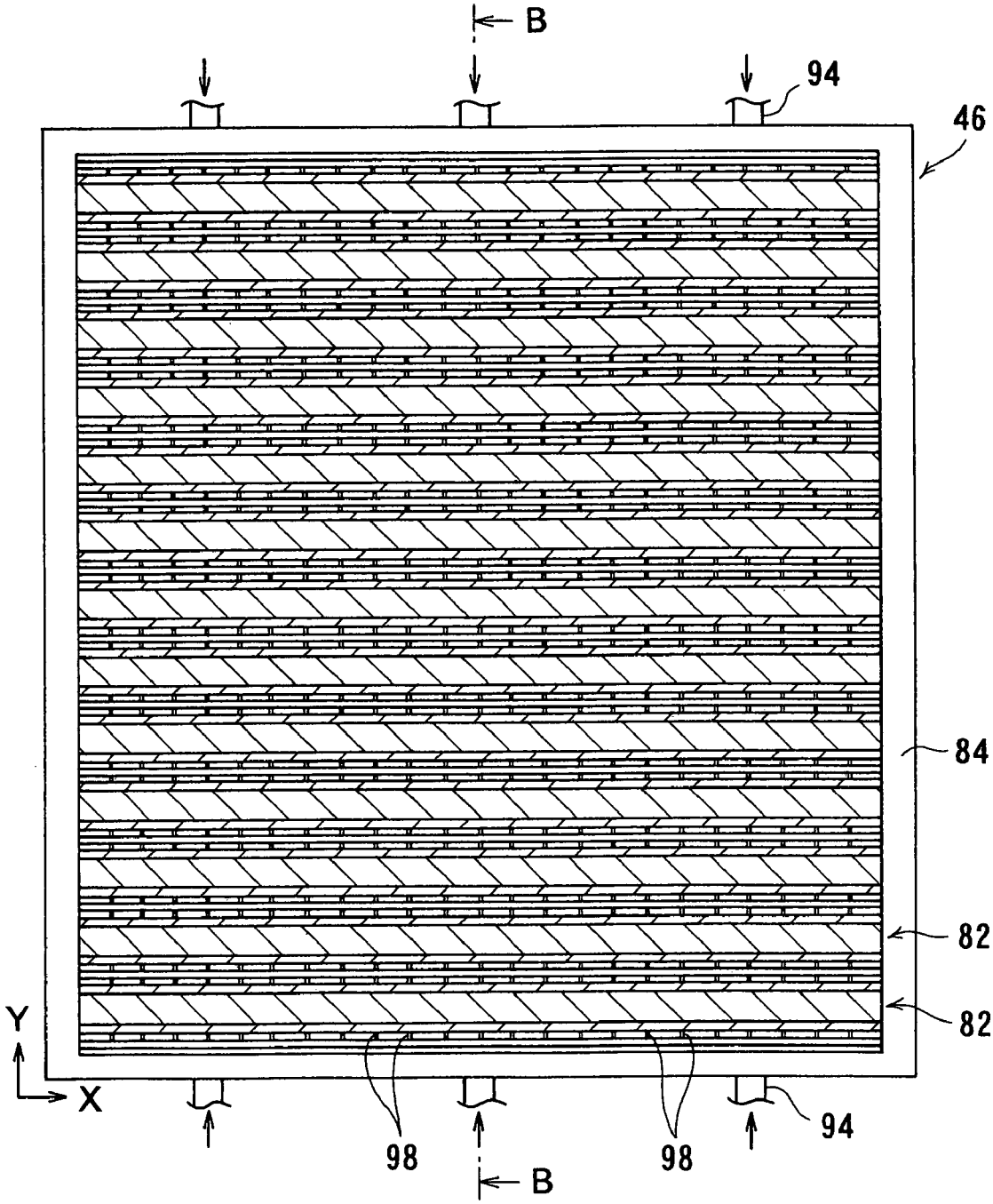
FIG. 8 is a plan view of the electrode section of the electrolytic processing apparatus of FIG. 5.
Figure 9:
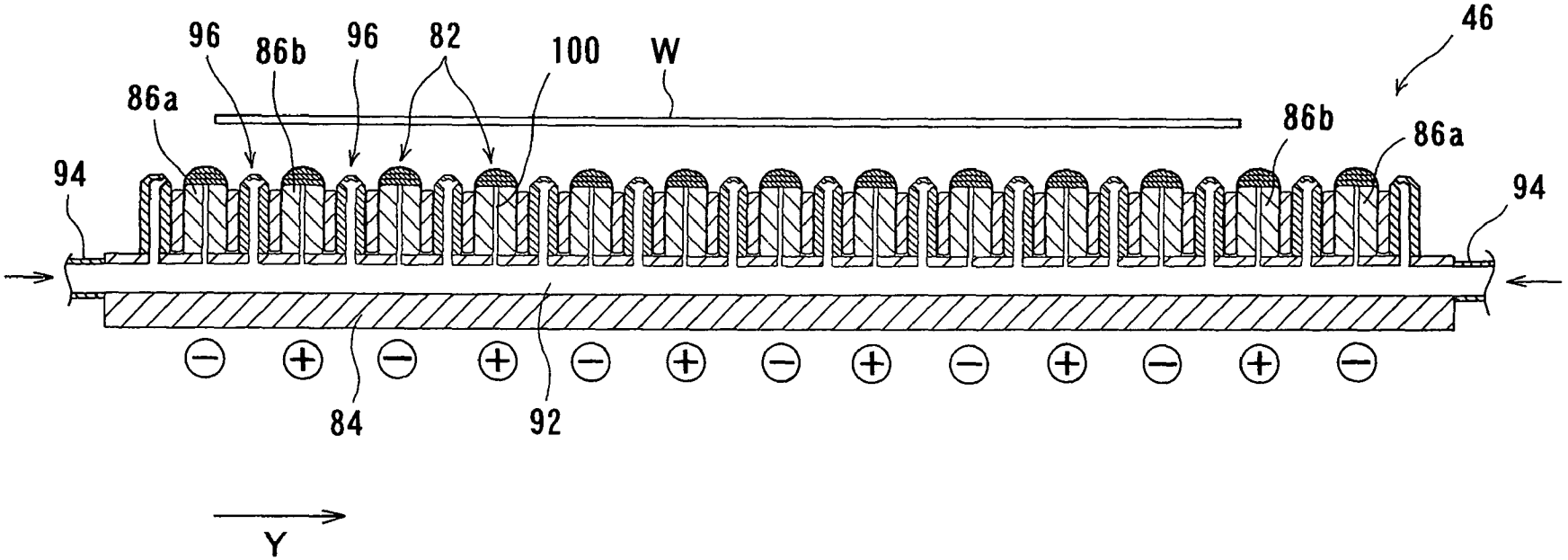
FIG. 9 is a sectional view taken along the line B-B of FIG. 8.
Figure 10:
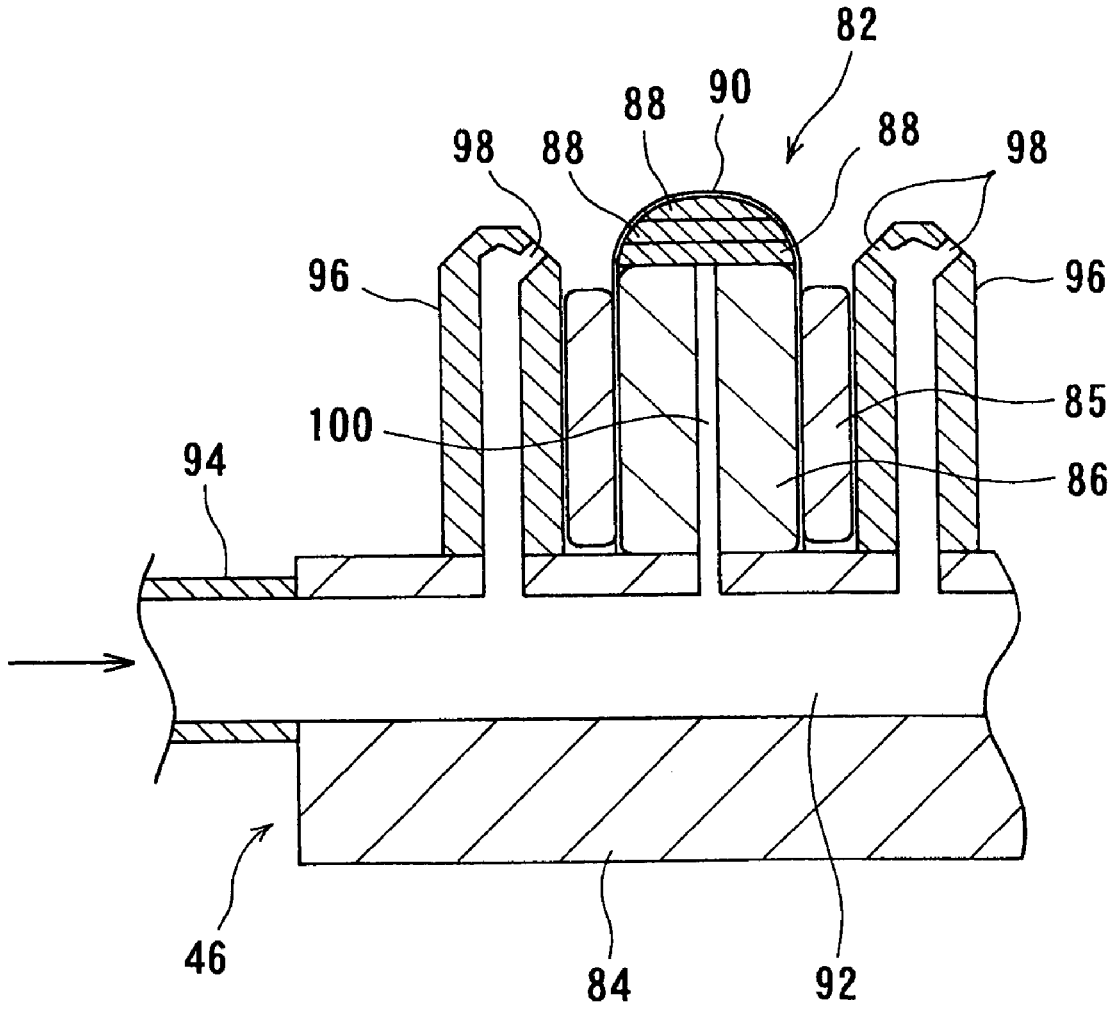
FIG. 10 is an enlarged view of a portion of FIG. 9.

Next, the electrode section 46 according to this embodiment will now be described. The electrode section 46 of this embodiment includes a plurality of electrode members 82. FIG. 8 is a plan view of the electrode section 46 of this embodiment, FIG. 9 is a sectional view taken along the line B-B of FIG. 8, and FIG. 10 is an enlarged view of a portion of FIG. 9. As shown in FIGS. 8 and 9, the electrode section 46 includes a plurality of electrode members 82 extending in the X direction (see FIGS. 5 and 8), and the electrode members 82 are disposed in parallel on a tabular base 84.

As shown in FIG. 10, each electrode member 82 comprises an electrode 86 to be connected to the power source 48 (see FIGS. 5 and 6), an ion exchanger 88 superimposed on the upper surface of the electrode 86, and an ion exchanger (ion exchange membrane) 90 covering the surfaces of the electrode 86 and the ion exchanger 88 integrally. The ion exchanger 90 is mounted to the electrode 86 by means of holding plates 85 disposed on both sides of the electrode 86.

The ion exchangers 88, 90 should meet the following four requisites:

(1) Removal of Processing Products (Including a Gas)

This is closely related to stability of the processing rate and evenness in the distribution of processing rate. To meet this demand, it is preferable to use an ion exchanger having "water permeability" and "water-absorbing properties". The term "water permeability" herein means a permeability in a broad sense. Thus, the member, which itself has no water permeability but can permit permeation therethrough of water by the provision of holes or grooves, is herein included as a "water-permeable" member. The term "water-absorbing properties" means properties of absorbing water and allowing water to penetrate into the material.

(2) Stability of Processing Rate

To meet this demand, it is desirable to use a multi-layer laminated ion exchanger, thereby securing an adequate ion-exchange capacity.

(3) Flatness of Processed Surface (Ability of Eliminating Steps)

To meet this demand, the processing surface of the ion exchanger desirably has a good surface smoothness. Further, in general, the harder the member is, the flatter the processed surface is (ability of eliminating steps).

(4) Long Life

In the light of long mechanical life of the member, it is desirable to use an ion-exchange material having a high wear resistance.

It is preferred to use an ion exchanger having a large ion exchange capacity as the ion exchanger 88. According to this embodiment, the ion exchanger 88 has a multi-layer structure of a laminate of three 1 mm-thick C membranes (nonwoven fabric ion exchangers), and thus has an increased total ion exchange capacity. The use of such an ion exchanger 88 can prevent the processing products (oxides and ions) produced by the electrolytic reaction from accumulating in the ion exchanger 88 in an amount exceeding the accumulation capacity of the ion exchanger 88. This can prevent the processing products accumulated in the ion exchanger 88 from changing their forms and adversely affecting the processing rate and its distribution. Further, an ion exchange capacity large enough for treating a desired processing amount of the workpiece can be secured. The ion exchanger 88 may be of a single membrane, when its ion exchange capacity is sufficiently high.

It is preferred that at least the ion exchanger 90 to be opposed to a workpiece has a high hardness and a good surface smoothness. According to this embodiment, Nafion (trademark, DuPont Co.) with a thickness of 0.2 mm is employed. The term "high hardness" herein means high rigidity and low modulus of elasticity against compression. A material having a high hardness, when used in processing of a workpiece having fine irregularities in the surface, such as a patterned wafer, hardly follows the irregularities and is likely to selectively remove the raised portions of the pattern. The expression "has a surface smoothness" herein means that the surface has few irregularities. An ion exchanger having a surface smoothness is less likely to contact the recesses in the surface of a workpiece, such as a patterned wafer, and is more likely to selectively remove the raised portions of the pattern. By thus combing the ion exchanger 90 having a surface smoothness with the ion exchanger 88 having a large ion exchange capacity, the defect of small ion exchange capacity of the ion exchanger 90 can be compensated for by the ion exchanger 88.

It is preferable to use an ion exchanger having good water permeability as the ion exchanger 90. By allowing pure water or ultrapure water to flow within the ion exchanger 90, a sufficient amount of water can be supplied to a functional group (sulfonic acid group in the case of an ion exchanger carrying a strongly acidic cation-exchange group) to thereby increase the amount of dissociated water molecules, and the process product (including a gas) formed by the reaction with hydroxide ions (or OH radicals) can be removed by the flow of water, whereby the processing efficiency can be enhanced. The flow of pure water or ultrapure water is thus necessary, and the flow of water should desirably be constant and uniform. The constancy and uniformity of the flow of water lead to constancy and uniformity in the supply of ions and the removal of the process product, which in turn lead to constancy and uniformity in the processing.

The ion exchangers 88, 90 may be composed of a nonwoven fabric which has an anion-exchange group or a cation-exchange group. A cation exchanger preferably carries a strongly acidic cation-exchange group (sulfonic acid group); however, a cation exchanger carrying a weakly acidic cation-exchange group (carboxyl group) may also be used. Though an anion exchanger preferably carries a strongly basic anion-exchange group (quaternary ammonium group), an anion exchanger carrying a weakly basic anion-exchange group (tertiary or lower amino group) may also be used.

The nonwoven fabric carrying a strongly basic anion-exchange group can be prepared by, for example, the following method: A polyolefin nonwoven fabric having a fiber diameter of 20-50 μm and a porosity of about 90% is subjected to the so-called radiation graft polymerization, comprising γ-ray irradiation onto the nonwoven fabric and the subsequent graft polymerization, thereby introducing graft chains; and the graft chains thus introduced are then aminated to introduce quaternary ammonium groups thereinto. The capacity of the ion-exchange groups introduced can be determined by the amount of the graft chains introduced. The graft polymerization may be conducted by the use of a monomer such as acrylic acid, styrene, glicidyl methacrylate, sodium styrenesulfonate or chloromethylstyrene, or the like. The amount of the graft chains can be controlled by adjusting the monomer concentration, the reaction temperature and the reaction time. Thus, the degree of grafting, i.e. the ratio of the weight of the nonwoven fabric after graft polymerization to the weight of the nonwoven fabric before graft polymerization, can be made 500% at its maximum. Consequently, the capacity of the ion-exchange groups introduced after graft polymerization can be made 5 meq/g at its maximum.

The nonwoven fabric carrying a strongly acidic cation-exchange group can be prepared by the following method: As in the case of the nonwoven fabric carrying a strongly basic anion-exchange group, a polyolefin nonwoven fabric having a fiber diameter of 20-50 μm and a porosity of about 90% is subjected to the so-called radiation graft polymerization comprising γ-ray irradiation onto the nonwoven fabric and the subsequent graft polymerization, thereby introducing graft chains; and the graft chains thus introduced are then treated with a heated sulfuric acid to introduce sulfonic acid groups thereinto. If the graft chains are treated with a heated phosphoric acid, phosphate groups can be introduced. The degree of grafting can reach 500% at its maximum, and the capacity of the ion-exchange groups thus introduced after graft polymerization can reach 5 meq/g at its maximum.

The base material of the ion exchangers 88, 90 may be a polyolefin such as polyethylene or polypropylene, or any other organic polymer. Further, besides the form of a nonwoven fabric, the ion exchanger may be in the form of a woven fabric, a sheet, a porous material, or short fibers, etc.

When polyethylene or polypropylene is used as the base material, graft polymerization can be effected by first irradiating radioactive rays (γ-rays or electron beam) onto the base material (pre-irradiation) to thereby generate a radical, and then reacting the radical with a monomer, whereby uniform graft chains with few impurities can be obtained. When an organic polymer other than polyolefin is used as the base material, on the other hand, radical polymerization can be effected by impregnating the base material with a monomer and irradiating radioactive rays (γ-rays, electron beam or UV-rays) onto the base material (simultaneous irradiation). Though this method fails to provide uniform graft chains, it is applicable to a wide variety of base materials.

By using a nonwoven fabric having an anion-exchange group or a cation-exchange group as the ion exchangers 88, 90, it becomes possible that pure water or ultrapure water, or a liquid such as an electrolytic solution can freely move within the nonwoven fabric and easily arrive at the active points in the nonwoven fabric having a catalytic activity for water dissociation, so that many water molecules are dissociated into hydrogen ions and hydroxide ions. Further, by the movement of pure water or ultrapure water, or a liquid such as an electrolytic solution, the hydroxide ions produced by the water dissociation can be efficiently carried to the surface of the processing electrodes, whereby a high electric current can be obtained even with a low voltage applied.

When the ion exchangers 88, 90 have only one of anion-exchange groups and cation-exchange groups, a limitation is imposed on electrolytically processible materials and, in addition, impurities are likely to form due to the polarity. In order to solve this problem, the anion exchanger and the cation exchanger may be superimposed, or the ion exchangers 88, 90 may carry both of an anion-exchange group and a cation-exchange group per se, whereby a range of materials to be processed can be broadened and the formation of impurities can be restrained.

According to this embodiment, the electrodes 86 of adjacent electrode members 82 are connected alternately to the cathode and to the anode of the power source 48. For example, the electrode 86 to become a processing electrode 86*a* is connected to the cathode of the power source 48, and the electrode 86 to become a feeding electrode 86*b* is connected to the anode. When processing copper, for example, the electrolytic processing action occurs on the cathode side, and therefore the electrode 86 connected to the cathode becomes a processing electrode 86*a*, and the electrode 86 connected to the anode becomes a feeding electrode 86*b*. Thus, according to this embodiment, the processing electrodes 86*a* and the feeding electrodes 86*b* are disposed in parallel and alternately.

Depending upon the material to be processed, the electrode 86 connected to the cathode of the power source 48 may serve as a feeding electrode, and the electrode 86 connected to the anode may serve as a processing electrode. Thus, when the material to be processed is copper, molybdenum, iron, or the like, the electrolytic processing action occurs on the cathode side, and therefore the electrode 86 connected to the cathode of the power source 48 becomes a processing electrode, and the electrode 86 connected to the anode becomes a feeding electrode. On the other hand, when the material to be processed is aluminum, silicon, or the like, the electrolytic processing action occurs on the anode side, and therefore the electrode 86 connected to the anode of the power source 48 becomes a processing electrode and the electrode 86 connected to the cathode becomes a feeding electrode.

Further, in the case where the to-be-processed material is a conductive oxide such as tin oxide or indium tin oxide (ITO), electrolytic processing is carried out after reducing the to-be-processed material. More specifically, with reference to FIG. 5, the electrodes connected to the anode of the power source 48 serve as reduction electrodes and the electrodes connected to the cathode serve as feeding electrodes to effect reduction of the conductive oxide. Subsequently, processing of the reduced conductive material is carried out by making the previous feeding electrodes serve as the processing electrodes. Alternatively, the polarity of the reduction electrodes at the time of reduction of the conductive oxide may be reversed so that the reduction electrodes can serve as the processing electrodes. Removal processing of the conductive oxide may also be effected by making the to-be-processed material serve as a cathode and allowing it to face an anode electrode.

According to the above-described embodiment, though a copper film 6 (see FIG. 1B) as a conductor film formed in the surface of the substrate is processed by electrolytic processing, an unnecessary ruthenium (Ru) film formed on or adhering to the surface of a substrate may be processed (etched and removed) by electrolytic processing in the same manner by making the ruthenium film serve as an anode and the electrodes connected to the cathode serve as processing electrodes.

By thus providing the processing electrodes 86*a* and the feeding electrodes 86*b* alternately in the Y direction of the electrode section 46 shown in FIG. 9 (direction perpendicular to the long direction of the electrode members 82), provision of a feeding section for feeding electricity to the conductive film (to-be-processed material) of the substrate W is no longer necessary, and processing of the entire surface of the substrate becomes possible. Further, by changing the positive and negative of the voltage applied between the processing electrodes 86*a* and the feeding electrodes 86*b* in a pulse form, it becomes possible to dissolve the electrolysis products, and improve the flatness of the processed surface through the multiplicity of repetition of processing.

With respect to the electrodes 86 of the electrode members 82, oxidation or dissolution there of due to an electrolytic reaction may be a problem. In view of this, as a material for the electrode, it is possible to use, besides the conventional metals and metal compounds, carbon, relatively inactive noble metals, conductive oxides or conductive ceramics. A noble metal-based electrode may, for example, be one obtained by plating or coating platinum or iridium onto a titanium electrode, and then sintering the coated electrode at a high temperature to stabilize and strengthen the electrode. Ceramic products are generally obtained by heat-treating inorganic raw materials, and ceramic products having various properties are produced from various raw materials including oxides, carbides and nitrides of metals and nonmetals. Among them there are ceramics having an electric conductivity. When an electrode is oxidized, the value of the electric resistance generally increases to cause an increase of applied voltage. However, by protecting the surface of an electrode with a non-oxidative material such as platinum or with a conductive oxide such as an iridium oxide, the decrease of electric conductivity due to oxidation of the base material of an electrode can be prevented.

As shown in FIG. 9, a flow passage 92 for supplying pure water, more preferably ultrapure water, to the to-be-processed surface is formed in the interior of the base 84 of the electrode section 46, and the flow passage 92 is connected to a pure water supply source (not shown) via a pure water supply pipe 94. On both sides of each electrode member 82, pure water jet nozzles 96 are provided for jetting the pure water or ultrapure water supplied from the flow passage 92 to between the substrate W and the ion exchangers 90 of the electrode members 82. In each pure water jet nozzle 96, a plurality of jet orifices 98 are provided along the X direction (see FIG. 8) for jetting pure water or ultrapure water toward the to-be-processed surface of the substrate W facing the electrode members 82, i.e., the portion of the substrate W in contact with the ion exchangers 90. Pure water or ultrapure water in the flow passage 92 is supplied from the jet orifices 98 of the pure water jet nozzles 96 to the entire to-be-processed surface of the substrate W. As shown in FIG. 10, the height of each pure water jet nozzle 96 is lower than the height of the ion exchanger 90 of each electrode member 82, so that the top of the pure water jet nozzle 96 does not contact the substrate W upon contact of the substrate W with the ion exchanger 90 of the electrode member 82.

Through-holes 100, which extend to the ion exchangers 88 from the flow passage 92, are formed in the interior of the electrodes 86 of the electrode members 82. With such a construction, pure water or ultrapure water in the flow passage 92 is supplied to the ion exchangers 88 through the through-holes 100. Pure water herein refers to water having an electric conductivity of not more than 10 μS/cm, and ultrapure water refers to water having an electric conductivity of not more than 0.1 μS/cm. The use of pure water or ultrapure water containing no electrolyte upon electrolytic processing can prevent extra impurities such as an electrolyte from adhering to and remaining on the surface of the substrate W. Further, copper ions or the like dissolved during electrolytic processing are immediately caught by the ion exchangers 88, 90 through the ion-exchange reaction. This can prevent the dissolved copper ions or the like from re-precipitating on the other portions of the substrate W, or from being oxidized to become fine particles which contaminate the surface of the substrate W.

It is possible to use, instead of pure water or ultrapure water, a liquid having an electric conductivity of not more than 500 μS/cm, any electrolytic solution, for example, an electrolytic solution obtained by adding an electrolyte to pure water or ultrapure water. The use of such an electrolytic solution can further lower the electric resistance and reduce the power consumption. A solution of a neutral salt such as NaCl or $Na_2SO_4$, a solution of an acid such as HCl or $H_2SO_4$, or a solution of an alkali such as ammonia, may be used as the electrolytic solution, and these solutions may be selectively used according to the properties of the workpiece.

Further, it is also possible to use, instead of pure water or ultrapure water, a liquid obtained by adding a surfactant or the like to pure water or ultrapure water, and having an electric conductivity of not more than 500 μS/cm, preferably not more than 50 μS/cm, more preferably not more than 0.1 μS/cm (resistivity of not less than 10 MΩ·cm). Due to the presence of a surfactant in pure water or ultrapure water, the liquid can form a layer, which functions to inhibit ion migration evenly, at the interface between the substrate W and the ion exchangers 88, 90, thereby moderating concentration of ion exchange (metal dissolution) to enhance the flatness of the processed surface. The surfactant concentration is desirably not more than 100 ppm. When the value of the electric conductivity is too high, the current efficiency is lowered and the processing rate is decreased. The use of the liquid having an electric conductivity of not more than 500 μS/cm, preferably not more than 50 μS/cm, more preferably not more than 0.1 μS/cm, can attain a desired processing rate.

Next, substrate processing (electrolytic processing) by using the electrolytic processing apparatus of this embodiment will be described. First, a substrate W, e.g. a substrate W as shown in FIG. 1B which has in its surface a copper film 6 as a conductive film (portion to be processed), is taken by the transfer robot 36 out of the cassette housing substrates and set in the loading/unloading unit 30. If necessary, the substrate W is transferred to the reversing machine 32 by the transfer robot 36 to reverse the substrate W so that the front surface of the substrate W having the conductor film (copper film 6) faces downward.

The transfer robot 36 receives the reversed substrate W and transfers it to the electrolytic processing apparatus 34, and the substrate W is attracted and held by the substrate holder 42. The arm 40 is moved to move the substrate holder 42 holding the substrate W to a processing position right above the electrode section 46. Next, the vertical-movement motor 50 is driven to lower the substrate holder 42 so as to bring the substrate W held by the substrate holder 42 close to or into contact with the surface of the ion exchangers 90 of the electrode section 46. Thereafter, the substrate-rotating motor 58 is driven to rotate the substrate W and, at the same time, the hollow motor 60 is driven to allow the electrode section 46 to make a scroll movement, while pure water or ultrapure water is jetted from the jet orifices 98 of the pure water jet nozzles 96 to between the substrate W and the electrode members 82 and, at the same time, pure water or ultrapure water is passed through the through-holes 100 of the electrode section 46 to the ion exchangers 88, thereby impregnating the ion exchangers 88 with pure water or ultrapure water. According to this embodiment, the pure water or ultrapure water supplied to the ion exchangers 88 is discharged from the ends in the long direction of each electrode member 82.

A given voltage is applied from the power source 48 to between the processing electrodes 86*a* and the feeding electrodes 86*b*, and electrolytic processing of the conductive film (copper film 6) in the surface of the substrate W is carried out at the processing electrodes (cathodes) 86*a* through the action of hydrogen ions and hydroxide ions produced by the ion exchangers 88, 90. According to this embodiment, the reciprocating motor 56 is driven to move the arm 40 and the substrate holder 42 in the Y direction (see FIGS. 5 and 9) during electrolytic processing. Thus, according to this embodiment, the processing is carried out while allowing the electrode section 46 to make a scroll movement and allowing the substrate W to move in a direction perpendicular to the long direction of the electrode members 82. It is, however, possible to allow the substrate W to make a scroll movement while moving the electrode 46 in a direction perpendicular to the long direction of the electrode members 82. Further, instead of the scroll movement, it is possible to employ a translatory reciprocating movement in the Y direction (see FIGS. 5 and 9).

Figure 11A:
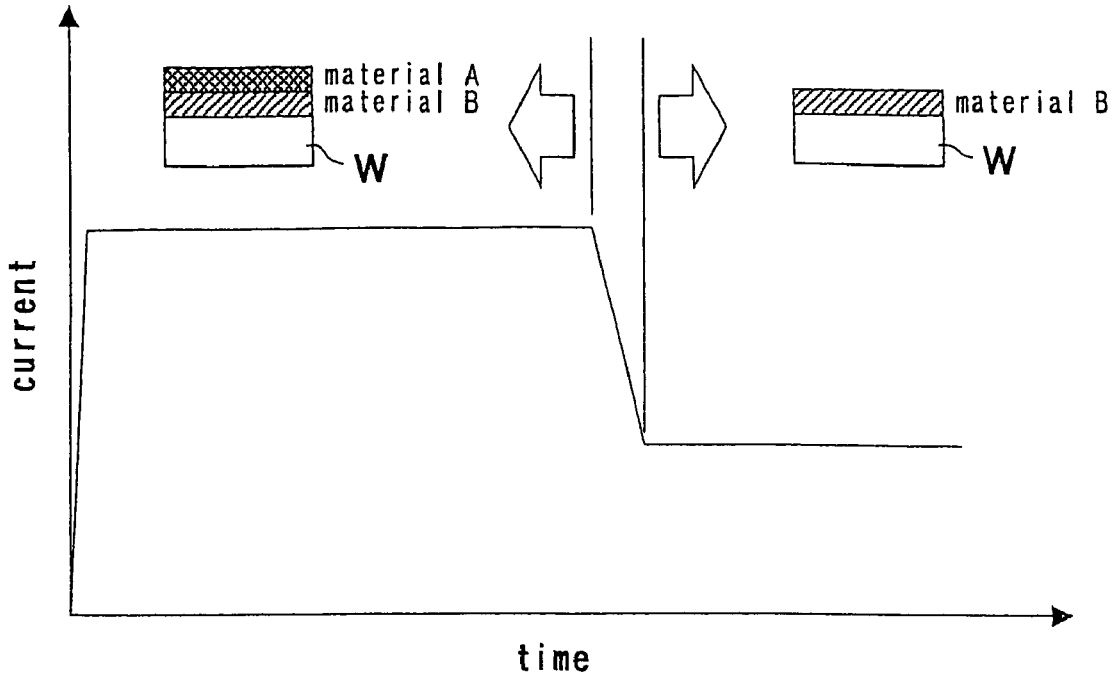
FIG. 11A is a graph showing the relationship between electric current and time, as observed in electrolytic processing of the surface of a substrate having a film of two different materials formed in the surface.
Figure 11B:
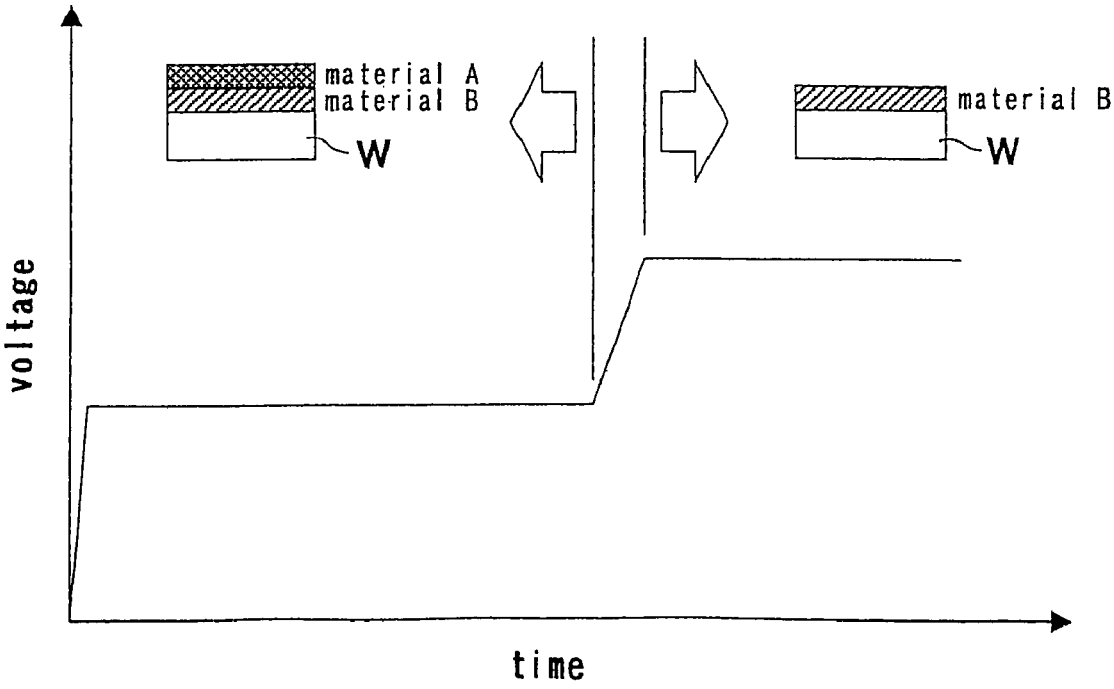
FIG. 11B is a graph showing the relationship between voltage and time, as observed in electrolytic processing of the surface of a substrate having a film of two different materials formed in the surface.

The monitor 38 monitors the voltage applied between the processing electrodes 86*a* and the feeding electrodes 86*b* or the electric current flowing therebetween to detect the end point (terminal of processing). It is noted in this connection that in electrolytic processing an electric current (applied voltage) varies, depending upon the material to be processed, even with the same voltage (electric current). For example, as shown in FIG. 11A, when an electric current is monitored in electrolytic processing of the surface of a substrate W to which a film of material B and a film of material A are laminated in this order, a constant electric current is observed during the processing of material A, but it changes upon the shift to the processing of the different material B. Likewise, when a voltage applied between the processing electrode and the feeding electrode is monitored, as shown in FIG. 11B, though a constant voltage is applied between the processing electrode and the feeding electrode during the processing of material A, the voltage applied changes upon the shift to the processing of the different material B. FIG. 11A illustrates, by way of example, a case in which an electric current is harder to flow in electrolytic processing of material B compared to electrolytic processing of material A, and FIG. 11B illustrates a case in which the applied voltage becomes higher in electrolytic processing of material B compared to electrolytic processing of material A. As will be appreciated from the above-described example, the monitoring of changes in electric current or in voltage can surely detect the end point.

Though this embodiment shows the case where the monitor 38 monitors the voltage applied between the processing electrodes 86*a* and the feeding electrodes 86*b*, or the electric current flowing therebetween to detect the end point of processing, it is also possible to allow the monitor 38 to monitor a change in the state of the substrate being processed to detect an arbitrarily set end point of processing. In this case, "the end point of processing" refers to a point at which a desired processing amount is attained for a specified region in a surface to be processed, or a point at which an amount corresponding to a desired processing amount is attained in terms of a parameter correlated with a processing amount for a specified region in a surface to be processed. By thus arbitrarily setting and detecting the end point of processing even in the middle of processing, it becomes possible to conduct a multi-step electrolytic processing.

After completion of the electrolytic processing, the power source 48 is disconnected, and the rotation of the substrate holder 42 and the electrode section 46 are stopped. Thereafter, the substrate holder 42 is raised, and substrate W is transferred to the transfer robot 36 after moving the arm 40. The transfer robot 36 takes the substrate W from the substrate holder 42 and, if necessary, transfers the substrate W to the reversing machine 32 for reversing it, and then returns the substrate W to the cassette in the loading/unloading unit 30.

It is to be noted here that when a liquid like ultrapure water which itself has a large resistivity is used, the electric resistance can be lowered by bringing the ion exchanger 90 into contact with the substrate W, whereby the requisite voltage can also be lowered and hence the power consumption can be reduced. The "contact" does not imply "press" forgiving a physical energy (stress) to a workpiece as in CMP. Accordingly, the electrolytic processing apparatus of this embodiment employs the vertical-movement motor 50 for bringing the substrate W into contact with or close to the electrode section 46, and does not have such a press mechanism as usually employed in a CMP apparatus that presses a substrate against a polishing member. In this regard, according to a CMP apparatus, a substrate is pressed against a polishing surface generally at a pressure of about 20-50 kPa, where as in the electrolytic processing apparatus of this embodiment, the substrate W may be contacted with the ion exchanger 90 at a pressure of less than 20 kPa. Even at a pressure less than 10 kPa, a sufficient removal processing effect can be achieved.

According to this embodiment, in the case of carrying out processing by contacting the substrate W and the ion exchangers 90 of electrode members 82, the processing progresses within the contact ranges between the ion exchangers 90 of the electrode section 46 and the to-be-processed surface of the substrate W. It is therefore necessary to adjust the contact width between the ion exchanger 90 and the to-be-processed surface of the substrate W by adjusting the extent of pressing by the substrate W (i.e. the distance between the electrode section 46 and the substrate W). However, since the electrode member 82 is long, it is difficult to adjust the distance between the electrode section 46 and the substrate W with high precision over the full length in the long direction. Further, since the electrode section 46 makes a scroll movement and the substrate W moves in the Y direction (see FIGS. 5 and 9), the above distance may change with the relative movements. Furthermore, depending upon how the ion exchangers 90 are mounted in the respective electrode members 82, the height of the ion exchangers 90 may vary among the electrode members 82, posing the same problem.

Figure 12A:
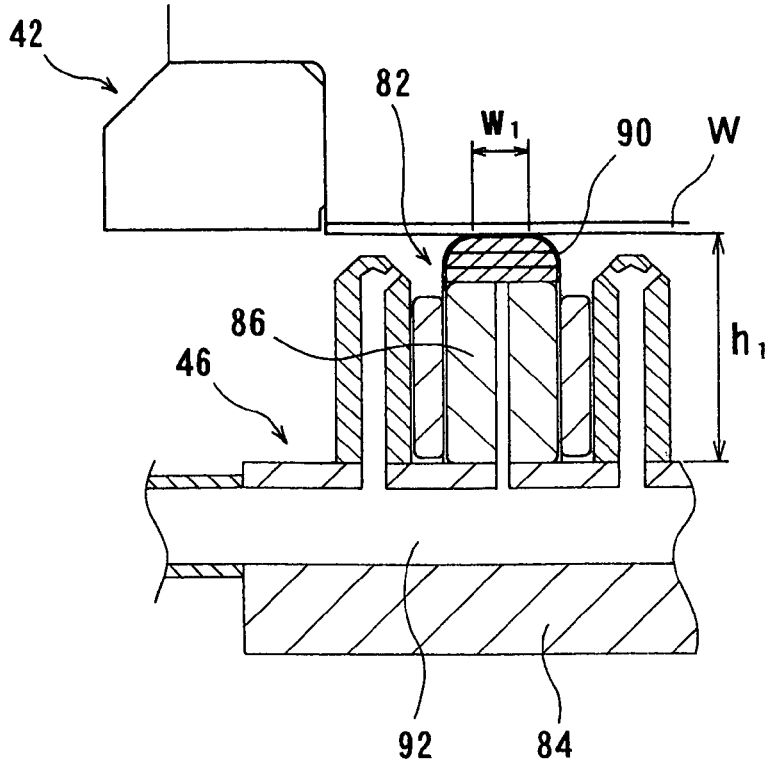
FIGS. 12A and 12B are diagrams illustrating the electrode section of an electrolytic processing apparatus according to an embodiment of the present invention, showing the states at different extents of pressing by a substrate.
Figure 12B:
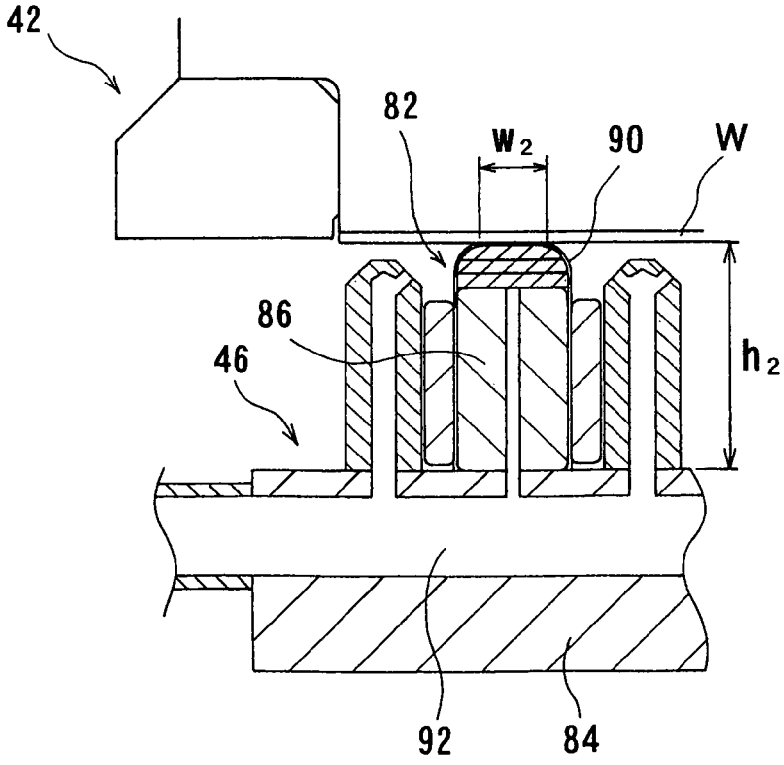

For example, as shown in FIG. 12A, when the distance between the upper surface of the electrode section 46 and the substrate W is h, (=17.7 mm), the contact width between the ion exchanger 90 and the to-be-processed surface of the substrate W is $W_1$ (=4.4 mm). When the distance between the upper surface of the electrode section 46 and the substrate becomes $h_2$ (=17.5 mm), as shown in FIG. 12B, the contact width between the ion exchanger 90 and the to-be-plated surface of the substrate W becomes $w_2$ (=5.2 mm), thus showing a remarkable change in the contact width. Since electrolytic processing progresses within the contact range between the ion exchangers 90 and the to-be-processed surface of the substrate W, such a change in the contact width of the portion of the ion exchanger 90 to be actually used in processing could prevent a uniform processing.

Figure 13A:
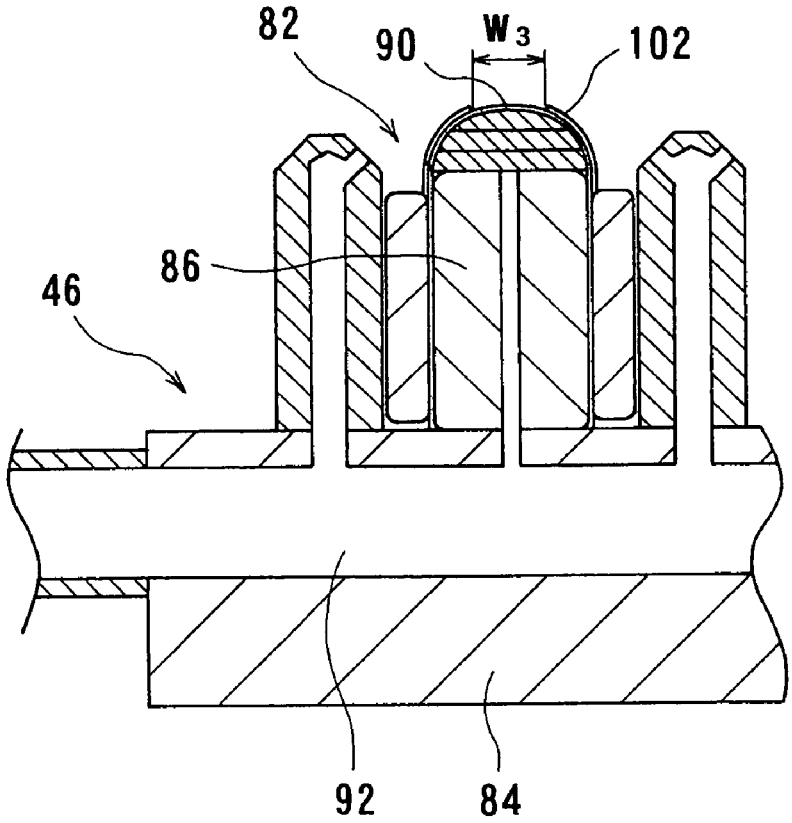
FIG. 13A is a cross-sectional view of an electrode member of an electrolytic processing apparatus according to another embodiment of the present invention.
Figure 13B:
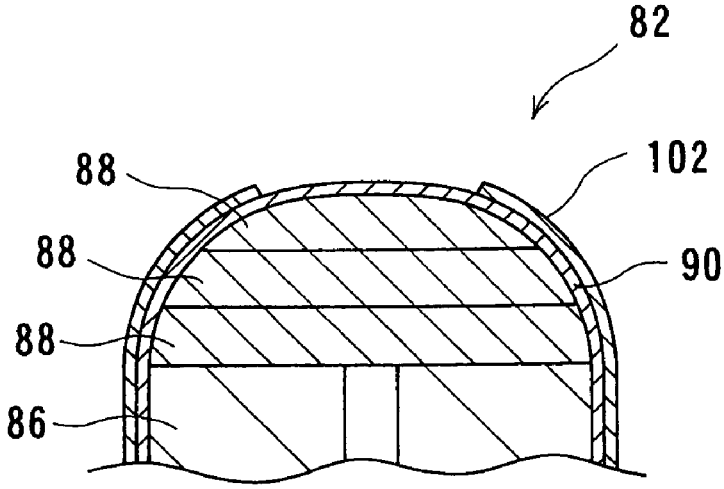
FIG. 13B is an enlarged view of a portion of FIG. 13A.

From this standpoint, it is preferred to provide a contact width restriction section to the electrode member 82 for restricting the contact width between such a portion of the ion exchanger 90 as used in processing and the substrate W to a constant width. FIG. 13A is a cross-sectional view of an electrode member of an electrolytic processing apparatus according to another embodiment of the present invention, which is provided with such a contact width restriction section, and FIG. 13B is an enlarged view of a portion of FIG. 13A. According to this embodiment, an insulating film is employed as the contact width restriction section. Thus, as shown in FIGS. 13A and 13B, an insulating film 102 is attached to the surface of the ion exchanger 90 except the top portion, so that the ion exchanger 90 is exposed within the range of the width $W_3$ (e.g. 4 mm) at the top of the ion exchanger 90. The insulating film 102 may be any electrically insulating one. For example, a vinyl tape with a thickness of 0.1 mm may be used.

Figure 14A:
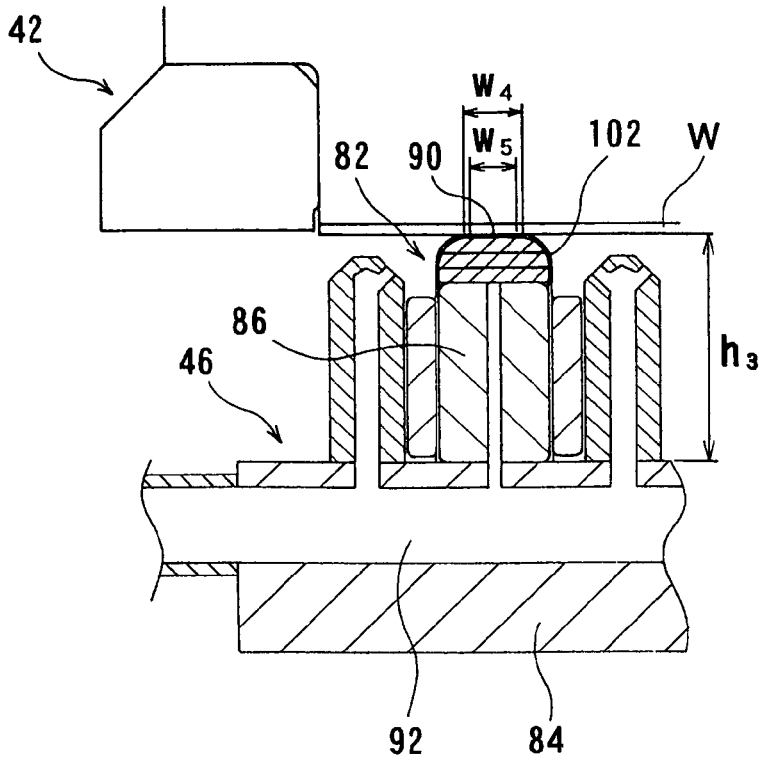
FIGS. 14A and 14B are diagrams illustrating the electrode section of the electrolytic processing apparatus according to another embodiment of the present invention, showing the states at different extents of pressing by a substrate.
Figure 14B:
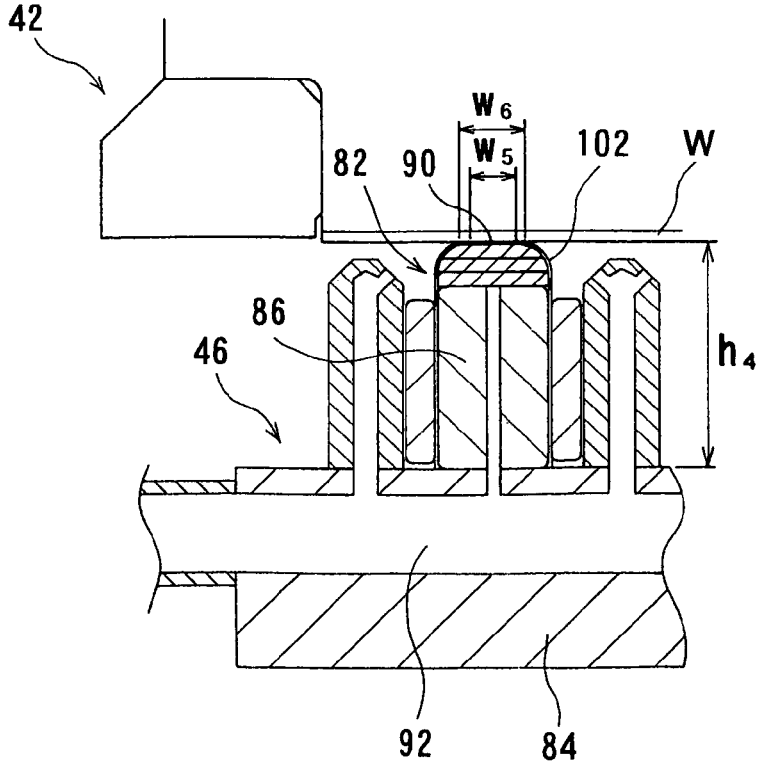

When carrying out processing using such an electrode member 82, the extent of pressing by the substrate is set to be higher than a certain extent of pressing so that at least the exposed portion of the ion exchanger 90, i.e. the portion with the width $W_3$, may contact the substrate. Under such conditions, as shown in FIG. 14A, when the distance between the upper surface of the electrode section 46 and the substrate W is $h_3$ (=17.7 mm), the contact width between the electrode member 82 and the to-be-processed surface of the substrate W is $w_4$ (=4.6 mm), where as the width of the ion exchanger 90 in actual contact with the to-be-processed surface of the substrate W is $W_5$ (=3.5 mm). As shown in FIG. 14B, when the distance between the upper surface of the electrode section 46 and the substrate W becomes $h_4$ (=17.5 mm), the contact width between the electrode member 82 and the to-be-processed surface of the substrate W becomes $w_6$ (=5.2 mm), where as the width of the ion exchanger 90 in actual contact with the to-be-processed surface of the substrate W remains $w_5$ (=3.5 mm), i.e. unchanged from the value shown in FIG. 14A. Thus, according to this embodiment, the contact width between the to-be-processed surface of the substrate W and the ion exchanger 90 can be kept constant by the insulating film 102 attached to the surface of the ion exchanger 90 regardless of changes in the extent of pressing by the substrate W, whereby a uniform processing can be effected.

Though, in this embodiment, the insulating film 102 is attached to the front surface of the ion exchanger 90 except the top portion, it is possible to attach an insulating film to the back surface of the ion exchanger 90 except the top portion. Also in this case, the effective range for ion exchange can be restricted, and therefore the same effect can be expected.

Figure 15A:
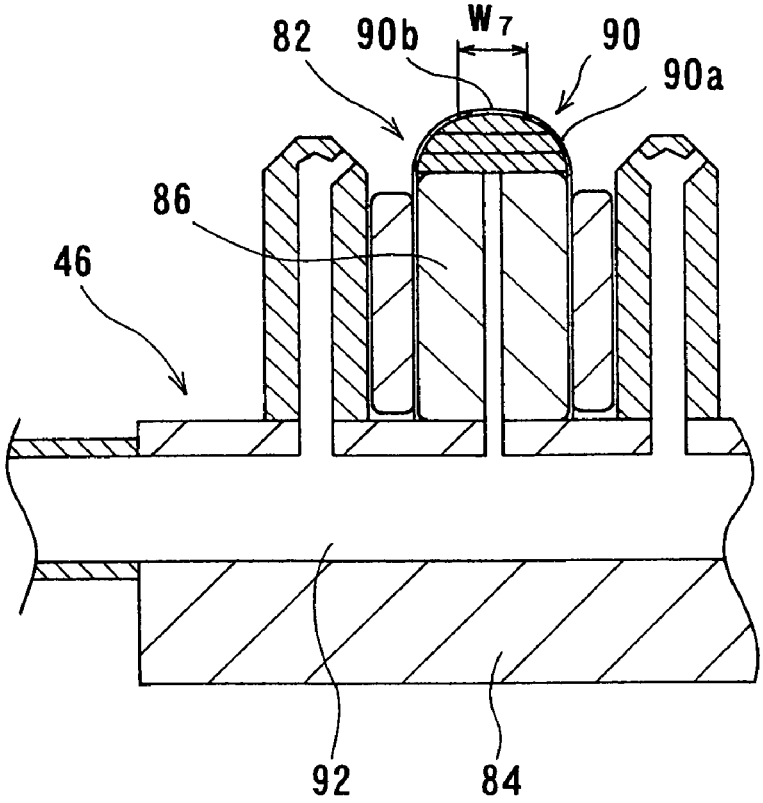
FIG. 15A is a cross-sectional view of an electrode member of an electrolytic processing apparatus according to still another embodiment of the present invention.
Figure 15B:
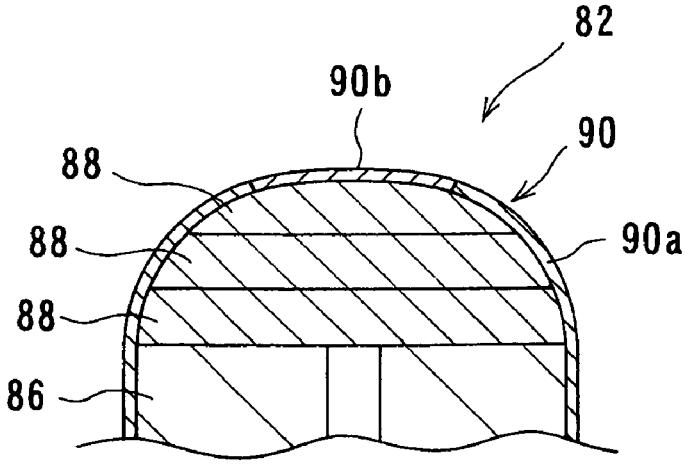
FIG. 15B is an enlarged view of a portion of FIG. 15A.

FIG. 15A is a cross-sectional view of an electrode member of an electrolytic processing apparatus according to still another embodiment of the present invention, and FIG. 15B is an enlarged view of a portion of FIG. 15A. The electrode member 82 of this embodiment employs a member having no ion exchange ability as a contact width restriction section. Thus, according to this embodiment, as shown in FIGS. 15A and 15B, the portion 90*a* of the ion exchanger 90 other than the top portion does not have the ion-exchange ability, and only the portion 90*b* with a width $W_7$ (e.g. 4 mm) at the top of the ion exchanger 90 has the ion-exchange ability. These portions 90*a*, 90*b* can be formed integrally, for example, by irradiating y-rays and carrying out graft polymerization while shutting off with lead the portion 90*a* not to be given the ion-exchange ability.

Figure 16A:
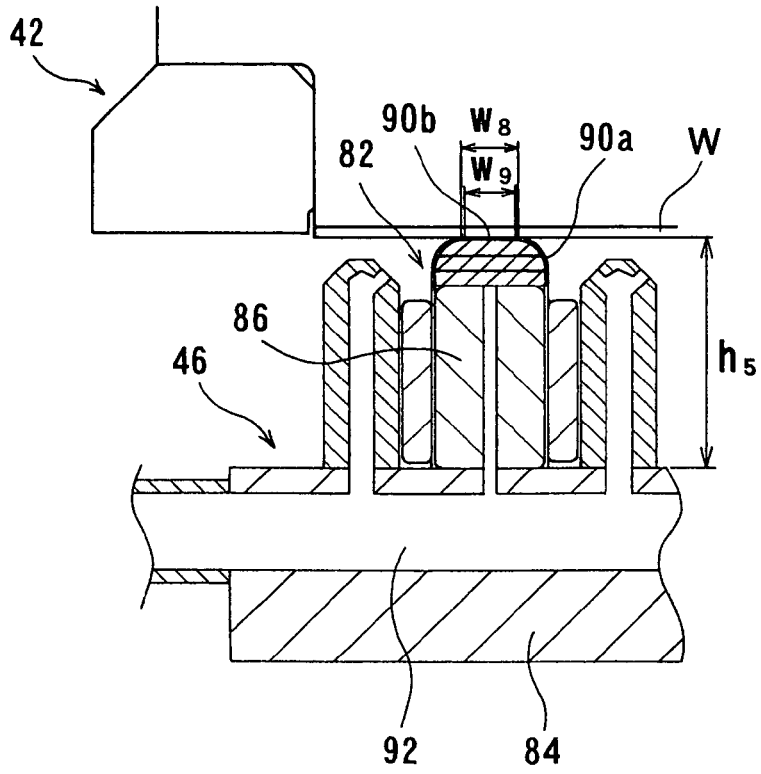
FIGS. 16A and 16B are diagrams illustrating the electrode section of the electrolytic processing apparatus according to still another embodiment of the present invention, showing the states at different extents of pressing by a substrate.
Figure 16B:
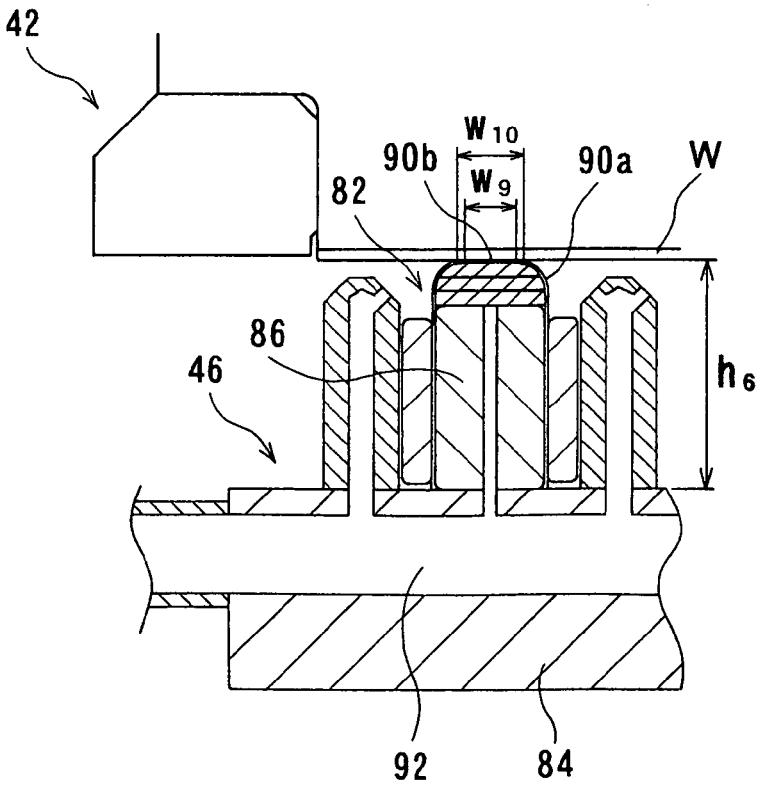

According to this embodiment, the extent of pressing by the substrate is set to be higher than a certain extent of pressing so that at least the entire surface of the portion 90*b* having the ion-exchange ability may contact the substrate. Under such conditions, as shown in FIG. 16A, when the distance between the upper surface of the electrode section 46 and the substrate W is $h_5$ (=17.7 mm), the contact width between the ion exchanger 90 and the to-be-processed surface of the substrate W is $w_8$ (=4.4 mm), whereas the width of the portion at which the processing progresses (i.e. the portion having the ion-exchange ability) is $w_9$ (=4 mm). As shown in FIG. 16B, when the distance between the upper surface of the electrode section 46 and the substrate W becomes $h_6$ (=17.5 mm), the contact width between the electrode member 82 and the to-be-processed surface of the substrate W becomes $w_{10}$ (=5.2 mm), whereas the width of the portion at which the processing progresses (i.e. the portion having the ion-exchange ability) remains $w_9$ (=4 mm), i.e. unchanged from the value shown in FIG. 16A. Thus, according to this embodiment, the width of the portion at which the processing progresses can be kept constant by the member 90*a* having no ion-exchange ability regardless of changes in the extent of pressing by the substrate W, whereby a uniform processing can be effected. Further, this embodiment can eliminate the need to attach the insulating film 102 to the ion exchanger 90 as in the above-described embodiment. According to the above-described embodiment, the thickness of the insulating film 102 attached to the front surface of the ion exchanger 90 can have some influence on the above-described contact width. In the case of attaching the insulating film 102 to the back surface of the ion exchanger 90, the diffraction of the electric field to the front surface of the ion exchanger 90 can cause some variations in the processing on that surface. According to this embodiment, on the other hand, the use of the ion exchanger 90, formed integrally of the portion 90*b* having the ion-exchange ability and the portion 90*a* having no ion-exchange ability, can eliminate such drawbacks.

Figure 17A:
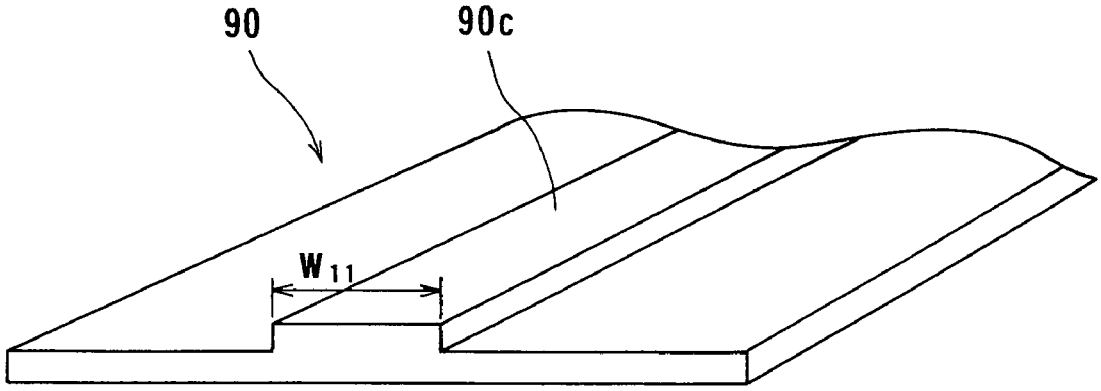
FIG. 17A is a fragmental perspective view of an ion exchanger for use in an electrode member of an electrolytic processing apparatus according to still another embodiment of the present invention.
Figure 17B:
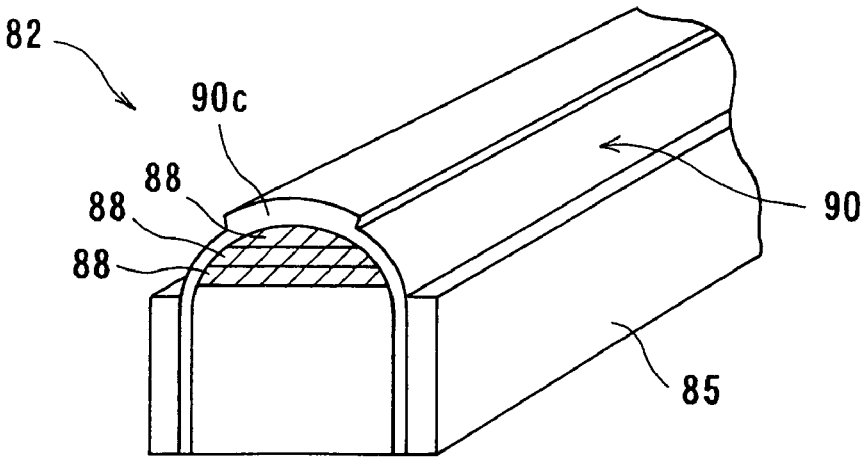
FIG. 17B is a fragmental perspective view of the electrode member in which the ion exchanger shown in FIG. 17A is mounted.

FIG. 17A is a fragmental perspective view of an ion exchanger for use in an electrode member of an electrolytic processing apparatus according to still another embodiment, and FIG. 17B is a fragmental perspective view of the electrode member with which the ion exchanger shown in FIG. 17A is provided. According to the electrode member 82 of this embodiment, a raised portion is provided as a contact width restriction section in the ion exchanger. Thus, as shown in FIGS. 17A and 17B, the ion exchanger 90 has at its top a raised portion 90*c* with a width $w_{11}$. Such a raised portion 90*c* can be formed by extrusion molding of the ion exchanger 90 using a die corresponding to the shape of the raised portion 90*c*.

Figure 18A:
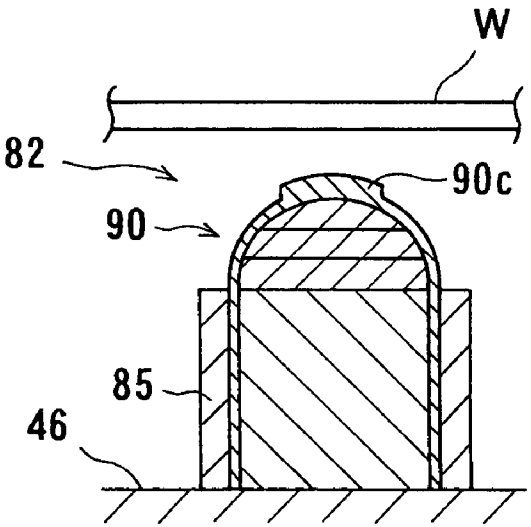
FIGS. 18A through 18C are diagrams illustrating the electrode section of the electrolytic processing apparatus according to still another embodiment of the present invention, showing the states at different extents of pressing by a substrate.
Figure 18B:
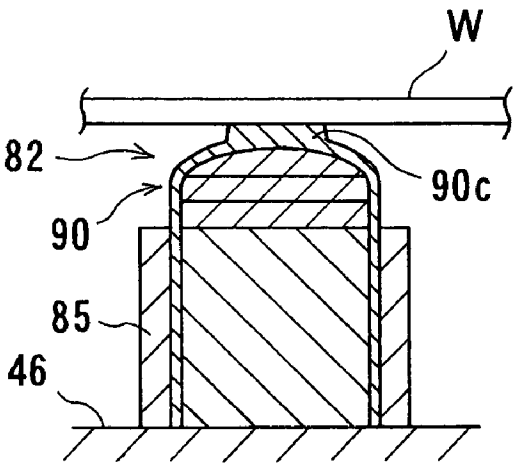
Figure 18C:
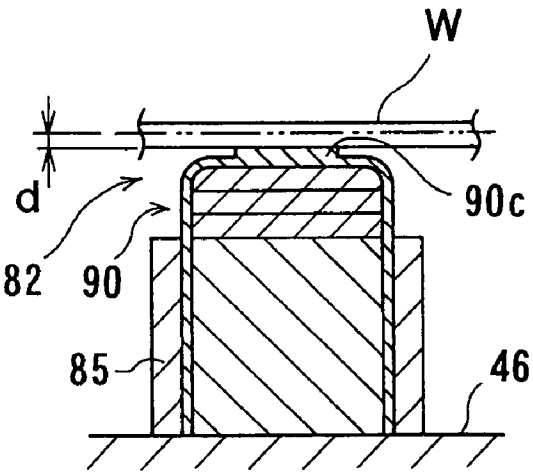

According to this embodiment, the extent of pressing by the substrate is set to be higher than a certain extent of pressing so that at least the entire surface of the raised portion 90*c* of the ion exchanger 90 may contact the substrate. Under such conditions, even when the substrate W is pressed downward from the position shown in FIG. 18A to come into contact with the surface of the raised portion 90*c* of the ion exchanger 90 as shown in FIG. 18B, and further pressed downward for a distance d as shown in FIG. 18C, the ion exchanger 90 contacts the substrate W only within the entire surface of the raised portion 90*c*, and therefore the contact width is kept constant. Thus, according to this embodiment, the contact width between the to-be-processed surface of the substrate W and the ion exchanger 90 can be kept constant by the raised portion 90*c* provided in the ion exchanger 90 regardless of changes in the extent of pressing by the substrate W, whereby a uniform processing can be effected.

Figure 19:
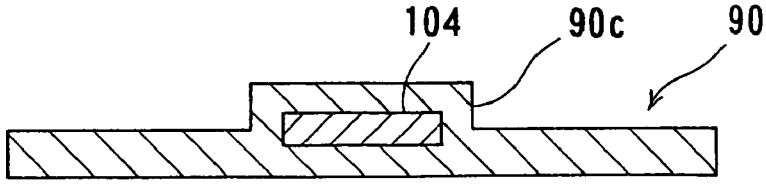
FIG. 19 is a vertical sectional view showing a variation of the ion exchanger for use in the electrolytic processing apparatus according to still another embodiment of the present invention.
Figure 20A:
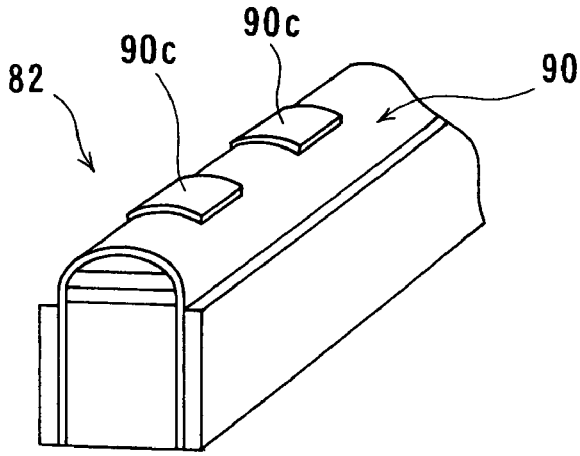
FIGS. 20A and 20B are fragmental perspective views showing variations of the electrode member for use in the electrolytic processing apparatus according to still another embodiment of the present invention.
Figure 20B:
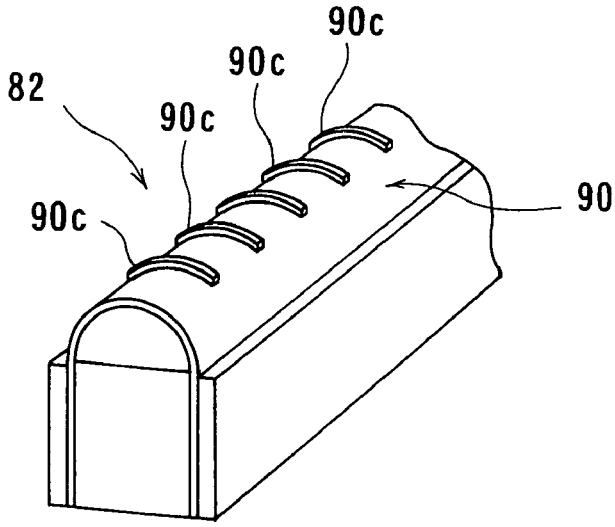

In this embodiment, as shown in FIG. 19, it is possible to incorporate an electrochemically inactive member 104, such as a fluoroplastics, into the raised portion 90*c*. The incorporation of such a member 104 into the raised portion 90*c* of the ion exchanger 90 can enhance the mechanical strength of the ion exchanger 90. Further, as shown in FIG. 20A, it is possible to provide raised portions 90*c* only in part of the top portion of the ion exchanger 90 at a given pitch in the long direction of the electrode member 82. In this case, as shown in FIG. 20B, the width of each raised portion 90*c* in the long direction of the electrode member 82 may be shortened. By thus shortening the width of the raised portion 90*c* in the long direction of the electrode member 82, as compared to the electrode member 82 shown in FIG. 20A, pure water or ultrapure water can be supplied to the to-be-processed surface more easily, thus preventing an abnormal processing due to shortage of pure water or ultrapure water.

Figure 21:
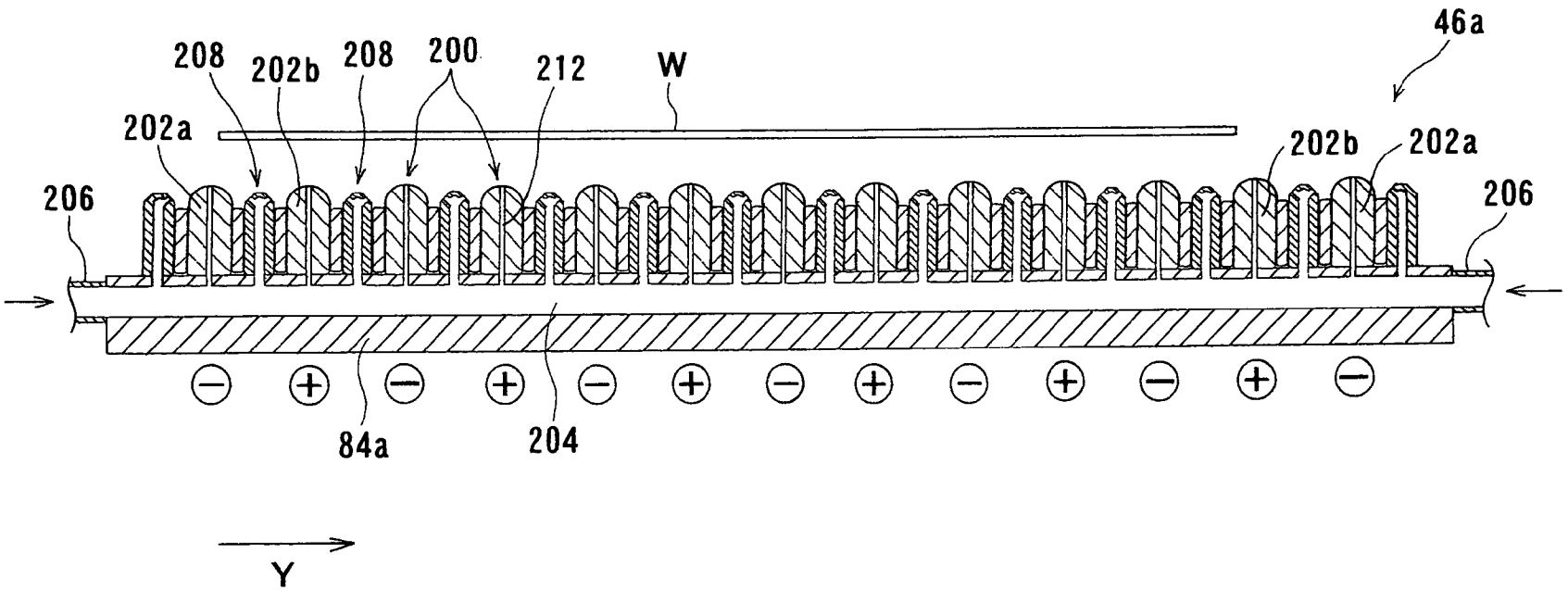
FIG. 21 is a cross-sectional view of the electrode section of an electrolytic processing apparatus according to still another embodiment of the present invention (corresponding to FIG. 9)
Figure 22:
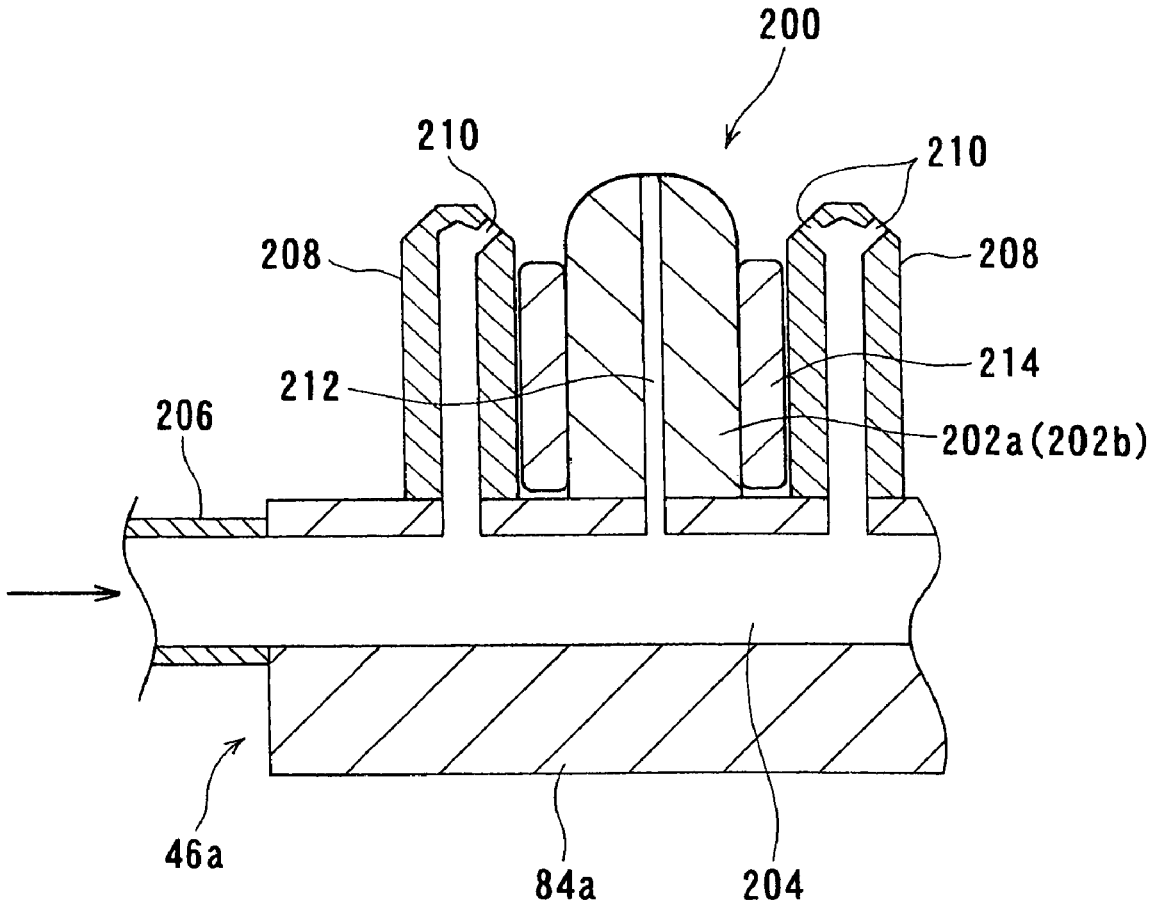
FIG. 22 is an enlarged view of a portion of FIG. 21.

FIG. 21 shows a cross-sectional view of the electrode section of an electrolytic processing apparatus according to still another embodiment of the present invention, and FIG. 22 shows an enlarged view of a portion of FIG. 21. As with the above-described embodiments, the electrode section 46*a* of this embodiment includes a plurality of rectangular linearly-extending electrodes 200 which are disposed in parallel on a tabular base 84*a*. According to this embodiment, the electrodes 200 do not have an ion exchanger on their upper surfaces. The electrodes 200 are connected alternately to the cathode and to the anode of a power source and, according to this embodiment, the electrodes 200 connected to the cathode of the power source serves as processing electrodes 202*a* and the electrodes 200 connected to the anode serves as feeding electrodes 202*b*.

As shown in FIG. 22, a flow passage 204 for supplying pure water, more preferably ultrapure water or an electrolysis solution, to the to-be-processed surface is formed in the interior of the base 84*a* of the electrode section 46*a*, and the flow passage 204 is connected to a fluid supply source (not shown) via a fluid supply pipe 206. On both sides of each electrode 200, fluid supply nozzles 208 are provided for supplying the pure water, electrolysis solution, or the like supplied from the flow passage 204 to between the substrate W and the electrode 200. In each fluid supply nozzle 208, a plurality of supply orifices 210 are provided at a given pitch in the long direction for supplying the pure water, electrolysis solution, or the like toward the portion of the substrate W opposed to or in contact with the electrode 200. The pure water, electrolysis solution, or the like in the flow passage 204 is supplied from the supply orifices 210 of the fluid supply nozzles 208 to the entire to-be-processed surface of the substrate W.

In the interior of each electrode 200, through-holes 212 that communicate with the flow passage 204 and vertically penetrate the electrode 200 are formed. With such a construction, the pure water, electrolysis solution, or the like in the flow passage 204 is supplied through the through-holes 212 to between the electrodes 200 and the substrate W. A holding plate 214 is interposed between the electrode 200 and the fluid supply nozzle 208.

As in this embodiment, it is possible not to provide an ion exchanger on the surface of the electrode 200. According to this embodiment, the plurality of electrodes 200 are disposed in parallel, and the feeding electrodes 202*b* and the processing electrodes 202*a*, facing a workpiece, are allowed to come close to the workpiece. This can facilitate feeding of electricity to e.g. the conductive film 6 (see FIG. 1B) on a substrate. Further, each feeding electrode 202*b* and each processing electrode 202*a* are of the same shape, and the feeding electrodes 202*b* and the processing electrodes 202*a* are disposed at even intervals, so that the proportions of the feeding electrodes 202*b* and of the processing electrodes 202*a* to the substrate become substantially equal. This can prevent feeding of electricity from concentrating in certain portions of the substrate, and can feed electricity evenly to the entire surface of the substrate.

Though an ion exchanger is not provided in the embodiment shown in FIGS. 21 and 22, it is possible to interpose a member other than anion exchanger between the electrodes and a workpiece. In that case, a water-permeable member, such as a sponge, may be used so that ions can move with a liquid present between the electrodes and the workpiece.

In the case of not interposing such a member between the electrodes and a workpiece, the distance between the workpiece and the electrodes, and the distance between adjacent electrodes are set so that the resistance between the workpiece and the electrodes becomes smaller than the resistance between adjacent electrodes. This allows ions to move between the electrodes and the workpiece rather than between adjacent electrodes, whereby the electric current flows preferentially as follows: feeding electrode→workpiece→processing electrode.

When etching and removing an unnecessary ruthenium (Ru) film formed on or adhering to the surface of a substrate W by the electrolytic processing apparatus of this embodiment, an electrolytic solution containing a halide, for example, is supplied between the processing electrodes 202*a*, feeding electrodes 202*b* and the ruthenium film as the to-be-processed portion of the substrate W. The feeding electrodes 202*b* are connected to the anode of a power source and the processing electrodes 202*a* are connected to the cathode so that the ruthenium film on the surface of the substrate W becomes an anode and the processing electrodes 202*a* become a cathode, and the electrolytic solution is supplied between the substrate W and the processing electrodes 202*a*, feeding electrodes 202*b* to etch and remove the to-be-processed portion facing the processing electrodes 202*a*.

With regard to the electrolytic solution, water or an organic solvent such as an alcohol, acetonitrile, dimethylform amide, dimethyl sulfoxide, etc. may be used as a solvent for a halide. An appropriate solvent may be selected depending on the intended usage of the ruthenium film to be processed, the cleaning step necessary after processing, the surface condition of the ruthenium film, etc. For a substrate for use in semiconductor manufacturing, it is preferred to use pure water, more preferably ultrapure water, in order to best avoid impurity contamination of the substrate.

An electrolytic solution of any halide may be employed insofar as etching processing of the ruthenium film can progress through an electrochemical interaction, and a compound generated during electrolytic reacts with ruthenium and the reaction product can be dissolved in the electrolytic solution or volatilized and removed. Specific examples of usable electrolytic solutions may include an aqueous solution of a hydrohalogenic acid such as HCl, HBr or HI, an aqueous solution of a halogen oxo acid such as $HClO_3$, $HBrO_3$, $HIO_3$, HClO, HBrO or HIO, an aqueous solution of a halogen oxo acid salt such as $NaClO_3$, $KClO_3$, NaClO or KClO, and an aqueous solution of a neutral salt such as NaCl or KCl. An appropriate electrolytic solution may be selected depending on the intended usage of the ruthenium film after processing and the influence of remaining material upon the usage, the thickness of the ruthenium film, the properties of a film underlying the ruthenium film, etc.

As with the above-described embodiment, in operation of the electrolytic processing apparatus, the substrate W is rotated via the substrate holder 42 (see FIGS. 5 and 6) in such a state that the substrate W is closed to or contact with the processing electrodes 202*a* and the feeding electrodes 202*b*, and the electrode section 46*a* makes the scroll movement, whereby the ruthenium film is etched away by electrochemical action. Further, a halide generated by electrolysis reacts with the ruthenium, whereby etching and removal of the ruthenium film progresses. The substrate surface after processing is cleaned by ultrapure water supplied from the ultrapure water supply nozzle (not shown).

The halide concentration of the halide-containing electrolytic solution is generally 1 mg/l to 10 g/l, preferably 100 mg/l to 1 g/l. The type of halide, the processing time, the processing area, the distance between the ruthenium film as an anode and the processing electrodes as a cathode, the electrolytic voltage, etc. may appropriately be determined depending upon the surface condition of the substrate after electrolytic processing, the capacity for waste liquid treatment, etc. For example, the amount of chemical can be reduced by using an electrolytic solution with a dilute halide concentration and increasing the electrolysis voltage. The processing rate can be increased by increasing the halide concentration of the electrolytic solution.

Figure 23:
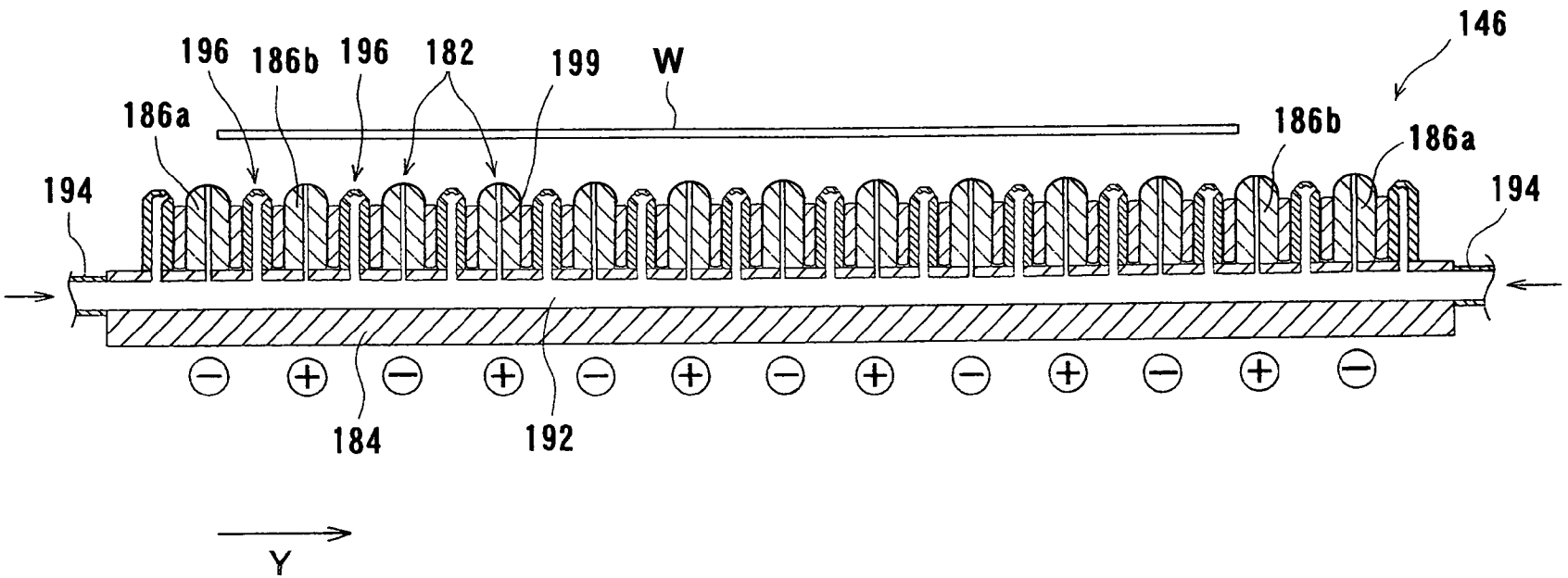
FIG. 23 is a cross-sectional view of the electrode section of an electrolytic processing apparatus according to still another embodiment of the present invention (corresponding to FIG. 9)
Figure 24:
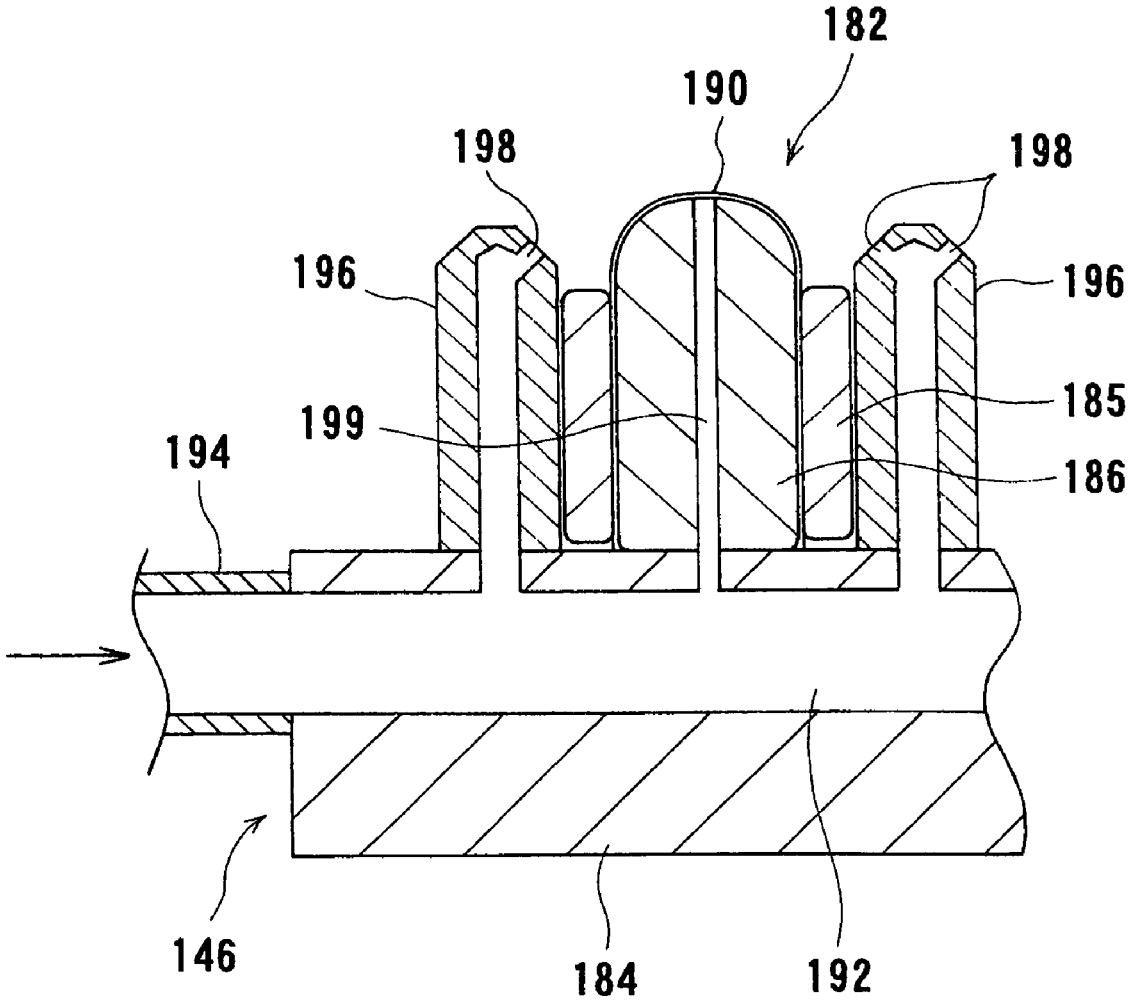
FIG. 24 is an enlarged view of a portion of FIG. 23.

FIG. 23 shows a cross-sectional view of the electrode section of an electrolytic processing apparatus according to still another embodiment of the present invention, and FIG. 24 shows an enlarged view of a portion of FIG. 23. The electrode section 146 of this embodiment includes a plurality of linearly-extending electrode members 182 which are disposed in parallel at an even pitch on a tabular base 184.

As shown in FIG. 24, each electrode member 182 comprises an electrode 186 to be connected to a power source, and an ion exchanger (ion exchange membrane) 190 covering the surface of the electrode 186 integrally. The ion exchanger 190 is mounted to the electrode 186 by means of holding plates 185 disposed on both sides of the electrode 186. The ion exchanger 190 is composed of, for example, a nonwoven fabric having an anion exchange group or a cation exchange group.

The electrodes 186 of adjacent electrode members 182 are connected alternately to the cathode and to the anode of the power source. For example, an electrode (processing electrode) 186*a* is connected to the cathode of the power source, and an electrode (feeding electrode) 186*b* is connected to the anode. When processing copper, for example, the electrolytic processing action occurs on the cathode side, and therefore the electrode 186 connected to the cathode becomes a processing electrode 186*a*, and the electrode 186 connected to the anode becomes a feeding electrode 186*b*. Thus, according to this embodiment, the processing electrodes 186*a* and the feeding electrodes 186*b* are disposed in parallel and alternately.

A flow passage 192 for supplying pure water, more preferably ultapure water, to the to-be-processed surface is formed in the interior of the base 184 of the electrode section 146, and the flow passage 192 is connected to a pure water supply source (not shown) via a pure water supply pipe 194. On both sides of each electrode member 182, pure water jet nozzles are provided 196 for jetting the pure water or ultrapure water supplied from the flow passage 192 to between the substrate W and the ion exchangers 190 of the electrode members 182. In each pure water jet nozzle 196, a plurality of jet orifices 198 are provided along the long direction for jetting pure water or ultrapure water toward the to-be-processed surface of the substrate W facing the electrode members 182, i.e., the portion of the substrate W in contact with the ion exchangers 190. Pure water or ultrapure water in the flow passage 192 is supplied from the jet orifices 198 of the pure water jet nozzles 196 to the entire to-be-processed surface of the substrate W. As shown in FIG. 24, the height of each pure water jet nozzle 196 is lower than the height of the ion exchanger 190 of each electrode member 182, so that the pure water jet nozzle 196 does not contact the substrate W upon contact of the substrate W with the ion exchanger 190 of the electrode member 182. Further, in the interior of the electrode 186 of each electrode member 182, through-holes 199 are formed that reach to the ion exchanger 190 from the flow passage 192. The pure water or ultrapure water in the flow passage 192 is supplied through the through-holes 199 to the ion exchanger 190. The other construction is the same as the embodiment shown in FIGS. 5 through 10.

According to the substrate processing apparatus of this embodiment, as with the above-described embodiments, the substrate W held by the substrate holder 42 (see FIGS. 5 and 6) is allowed to be close to or in contact with the surface of the ion exchangers 190 of the electrode section 146, while the electrode section 146 is allowed to make a scroll movement. The scroll movement allows the processing electrodes 186*a* and the substrate W to make a first relative movement in the Y direction (see FIG. 23), which is a relative reciprocating movement in the Y direction. Simultaneously with the scroll movement, the substrate W held by the substrate holder 42 is moved in the Y direction for a predetermined distance, thereby allowing the substrate W and the processing electrodes 186*a* to make a second relative movement. At the same time, pure water or ultrapure water is jetted from the jet orifices 198 of the pure water jet nozzles 196 to between the substrate W and the electrode members 182, while pure water or ultrapure water is passed through the through-holes 199 of the electrode section 146 to the ion exchangers 190, thereby impregnating the ion exchangers 190 with pure water or ultrapure water. According to this embodiment, the pure water or ultrapure water supplied to the ion exchangers 190 is discharged from the ends in the long direction of each electrode member 182.

A given voltage is applied from the power source to between the processing electrodes 186*a* and the feeding electrodes 186*b*, and electrolytic processing of the conductive film (copper film 6) in the surface of the substrate W is carried out at the processing electrodes (cathodes) 186*a* through the action of hydrogen ions and hydroxide ions produced by the ion exchangers 190. According to this embodiment, the substrate W held by the substrate holder 42 is not rotated during the electrolytic processing.

During the electrolytic processing, as with the above-described embodiment, the voltage applied between the processing electrodes 186*a* and the feeding electrodes 186*b* or the electric current flowing therebetween is monitored by the monitor 38 (see FIG. 4) to detect the end point of processing.

After completion of the electrolytic processing, the power source is disconnected and the scroll movement of the electrode section 146 is stopped, and the processed substrate W is sent to the next process step.

Figure 25A:
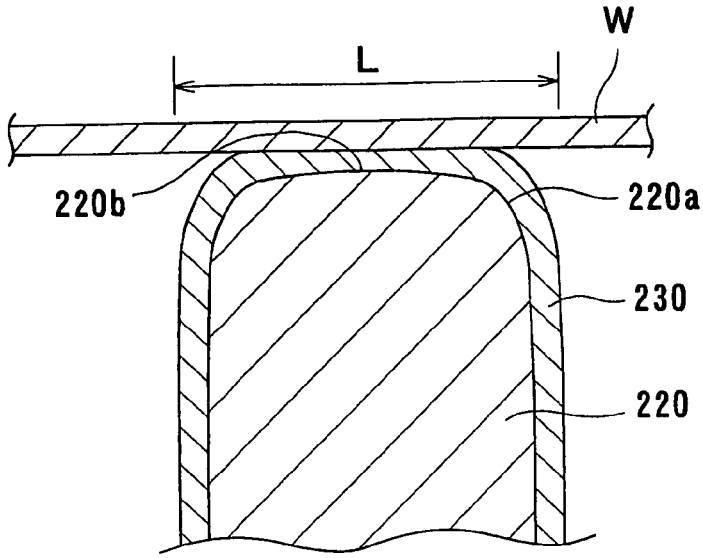
FIG. 25A is a fragmental sectional view of a processing electrode.
Figure 25B:
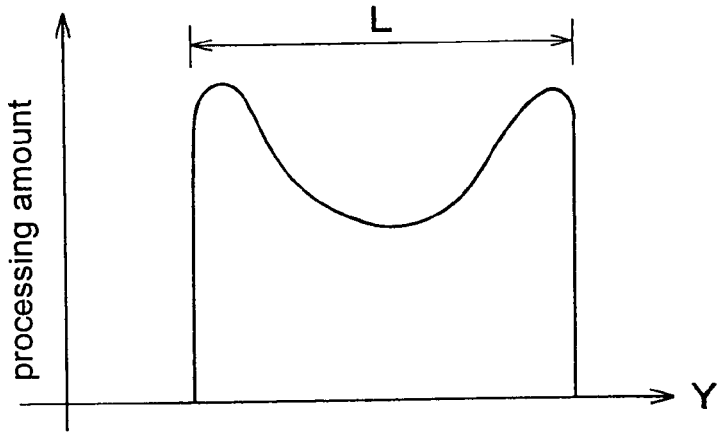
FIG. 25B is a graph showing the processing amount per unit time of a substrate as processed by the processing electrode shown in FIG. 25A.

Considering now one processing electrode, as shown in FIG. 25A, in electrolytic processing, the processing is effected only within the range L in which the substrate W is close to or in contact with an ion exchanger 230 on the surface of the processing electrode 220. The processing amount per unit time of the substrate W processed by the processing electrode 220 in the Y direction (direction perpendicular to the long direction of processing electrode 220) has a distribution as shown in FIG. 25B. Since the electric field concentrates at the end portions 220*a* of the processing electrode 220, the processing rate is high at the end portion 220*a* or its vicinity of the processing electrode 220 compared to the center 220*b* or its vicinity, as shown in FIG. 25B.

Figure 25C:
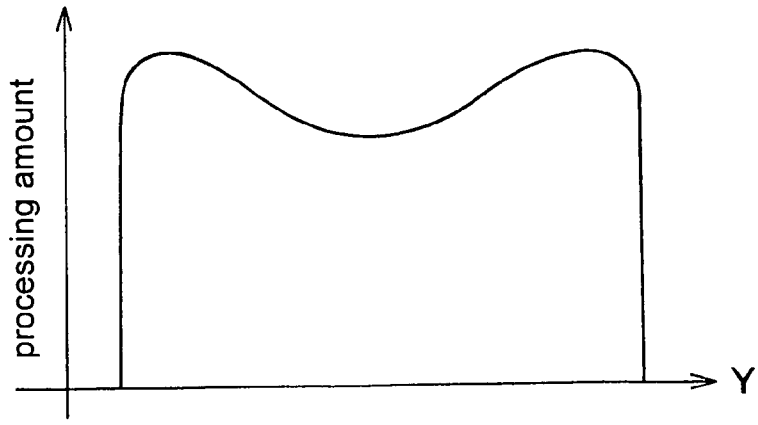
FIG. 25C is a graph showing the processing amount corresponding to that of FIG. 25B, but in the case where the processing electrode makes a scroll movement.

The processing amount thus varies with respect to one processing electrode 220. According to this embodiment, as described above, the electrode section 146 is allowed to make a scroll movement to thereby allow the substrate W and the processing electrodes 186*a* (see FIG. 23) to make a relative reciprocating movement (first relative movement) in the Y direction, thereby reducing the variation in the processing amount. FIG. 25C is a graph showing the processing amount per unit time of the substrate W in the Y direction in the case where the processing electrode 220 makes a scroll movement (first relative movement). As shown in FIG. 25C, the variation in the processing amount can be reduced by the scroll movement; however, the variation cannot be completely eliminated.

Figure 26A:
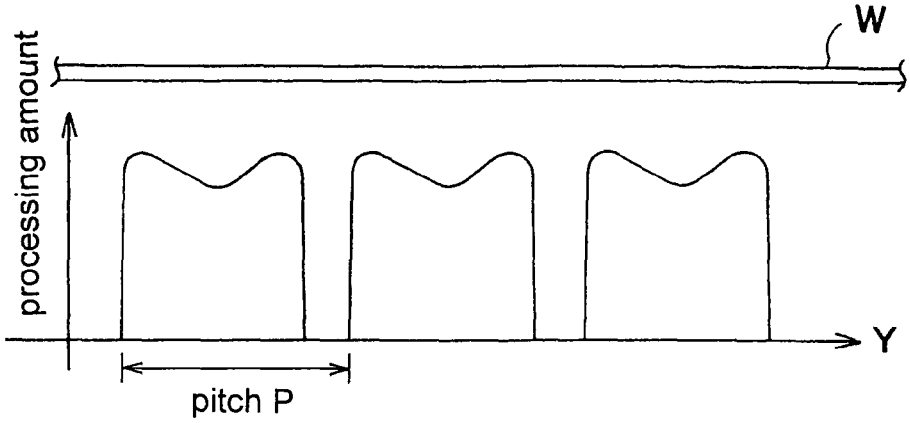
FIGS. 26A through 26C are diagrams illustrating the principle of an electrolytic processing method according to an embodiment of the present invention.
Figure 26B:
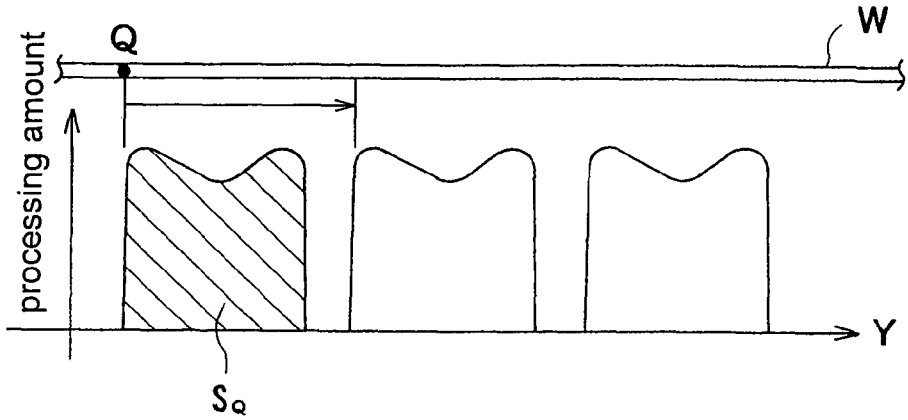
Figure 26C:
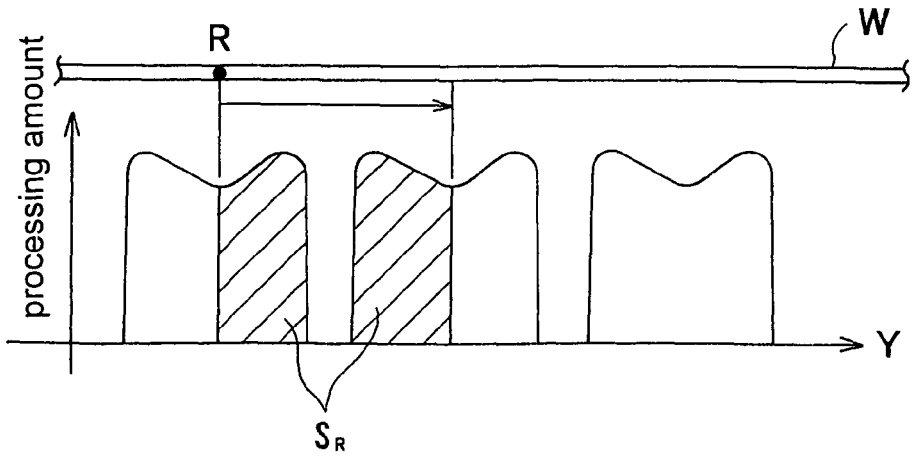

According to this embodiment, in addition to the scroll movement (first relative movement), the substrate W held by the substrate holder 42 is moved in the Y direction for a predetermined distance during electrolytic processing to thereby allow the substrate W and the processing electrodes 220 to make a second relative movement, thereby eliminating the above-described variation in the processing amount. Thus, as shown in FIG. 26A, when only the scroll movement (first relative movement) is carried out in electrolytic processing, a difference in the processing amount of the substrate W is produced in the Y direction, and the processing amount distribution in the Y direction, comprising processing amount distribution units of the same figure appearing every pitch P, is obtained. During the electrolytic processing, the reciprocating motor 56 shown in FIGS. 5 and 6 is driven to move the arm 40 and the substrate holder 42 in the Y direction (see FIG. 23) for a distance corresponding to an integral multiple of the pitch P shown in FIG. 26A, thereby carrying out the second relative movement between the substrate W and the processing electrodes 220. When carrying out such a second relative movement together with the first relative movement, for example, for a distance corresponding to the pitch P, a point Q in the substrate W, shown in FIG. 26B, is processed in an amount corresponding to the area $S_Q$, while a point R in the substrate W, shown in FIG. 26C, is processed in an amount corresponding to the area $S_R$. Since the respective processing amount distribution units are of the same figure, the area $S_Q$ is equal to the area $S_R$, that is, the processing amount at the point Q of the substrate W is equal to that at the point R. Thus, carrying out the second relative movement together with the first relative movement makes it possible to process the entire surface of the substrate W uniformly. In this case, it is preferred that the speed of the second relative movement be constant.

It is possible to repeat the above-described second relative movement, and allow the substrate W to reciprocate relative to the processing electrodes 220 in the Y direction. In this case, though the moving distance of the forward movement and that of the backward movement both should correspond to an integral multiple of the above-described pitch P, the two moving distances are not necessarily equal and may be different. For example, the moving distance of the forward movement may be twice the pitch P, and that of the backward movement may be equal to the pitch P.

Figure 27A:
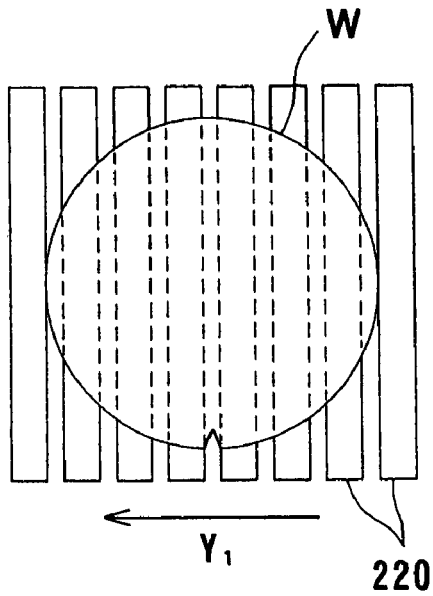
FIGS. 27A through 27D are diagrams illustrating an electrolytic processing method according to another embodiment of the present invention.
Figure 27B:
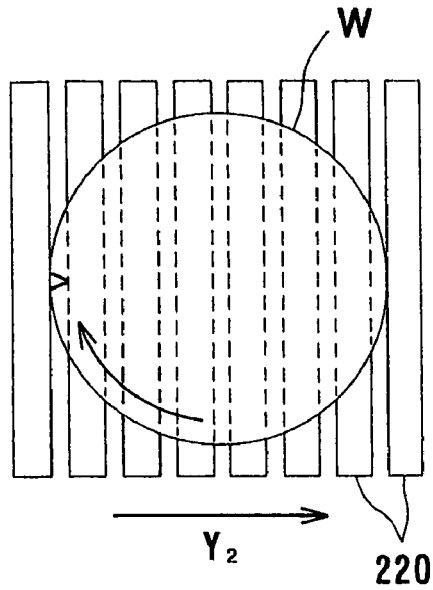
Figure 27C:
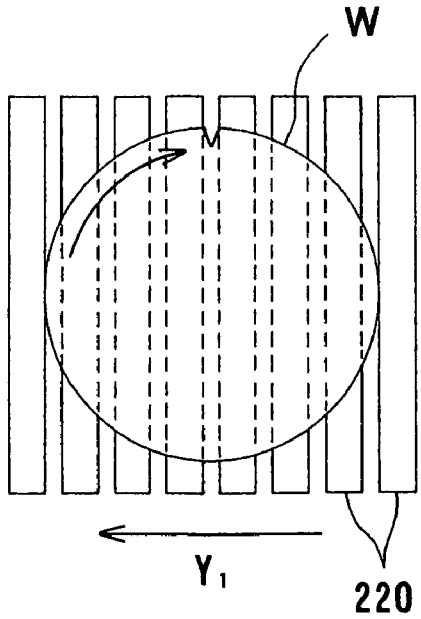

As described above, carrying out the second relative movement together with the first relative movement makes it possible to process the entire surface of the substrate uniformly. In a practical processing, however, there may be a case where a uniform processing cannot be fully effected because of, for example, a variation in the processing rate per unit area in the long direction of processing electrodes or a difference in the processing rate among the electrodes. In such a case, it is preferred to carry out the second relative movement in the following manner:

First, from the position shown in FIG. 27A, the substrate W is moved relative to the processing electrodes 220 in the $Y_1$ direction for a distance corresponding to an integral multiple of the pitch P, described above. Next, the substrate-rotating motor 58 (see FIGS. 5 and 6) is driven to rotate the substrate W counterclockwise 90 degrees, and then the substrate W is moved in the $Y_2$ direction for a distance corresponding to an integral multiple of the pitch P (see FIG. 27B). Similarly, after rotating the substrate W counterclockwise 90 degrees, the substrate W is moved in the $Y_1$ direction for an integral multiple of the pitch P (see FIG. 27C). Further, after rotating the substrate W counterclockwise 90 degrees, the substrate W is moved in the $Y_2$ direction for an integral multiple of the pitch P (see FIG. 27D). By thus changing the moving direction of the substrate W every forward movement (movement in the $Y_1$ direction) and the every backward movement (movement in the $Y_2$ direction) in the second relative movement, even when there is some variation in the processing rate among the processing electrodes, the variation can be evened out on the substrate W and the unevenness of processing can be eliminated as a whole.

It is preferred to repeat the rotation of the predetermined rotational angle, as in the case shown in FIGS. 27A through 27D, so that the substrate W makes at least one revolution until completion of the electrolytic processing of the substrate. Though in the case shown in FIGS. 27A through 27D, the second movement is carried out in four directions with the repetition of 90-degree rotation of the substrate W, the second movement is not limited to such a manner. For example, the second movement may be carried out in eight directions with a repetition of 45-degree rotation of the substrate W. Further, it is possible to change the moving direction of the substrate W, not every forward movement and the every backward movement, but every reciprocating movement in the second relative movement.

Further, though in the case shown in FIGS. 27A through 27D the moving direction of the substrate W is changed every forward movement (movement in the $Y_1$ direction) and every backward movement (movement in the $Y_2$ direction) in the second relative movement, it is possible to first move the substrate W in the $Y_1$ direction, then raise the substrate W while rotating the substrate and return the substrate W to the original position, and then move the substrate again in the $Y_1$ direction, as shown in FIGS. 28A through 28D. By thus changing the moving direction of the substrate W in the second relative movement with the movement in a certain direction ($Y_1$ direction according to the above-described case) in the second relative movement as a unit, the processing strain due to the shape of electrode, the concentration of electric charge and the influence of ion exchanger can be balanced out.

Figure 29:
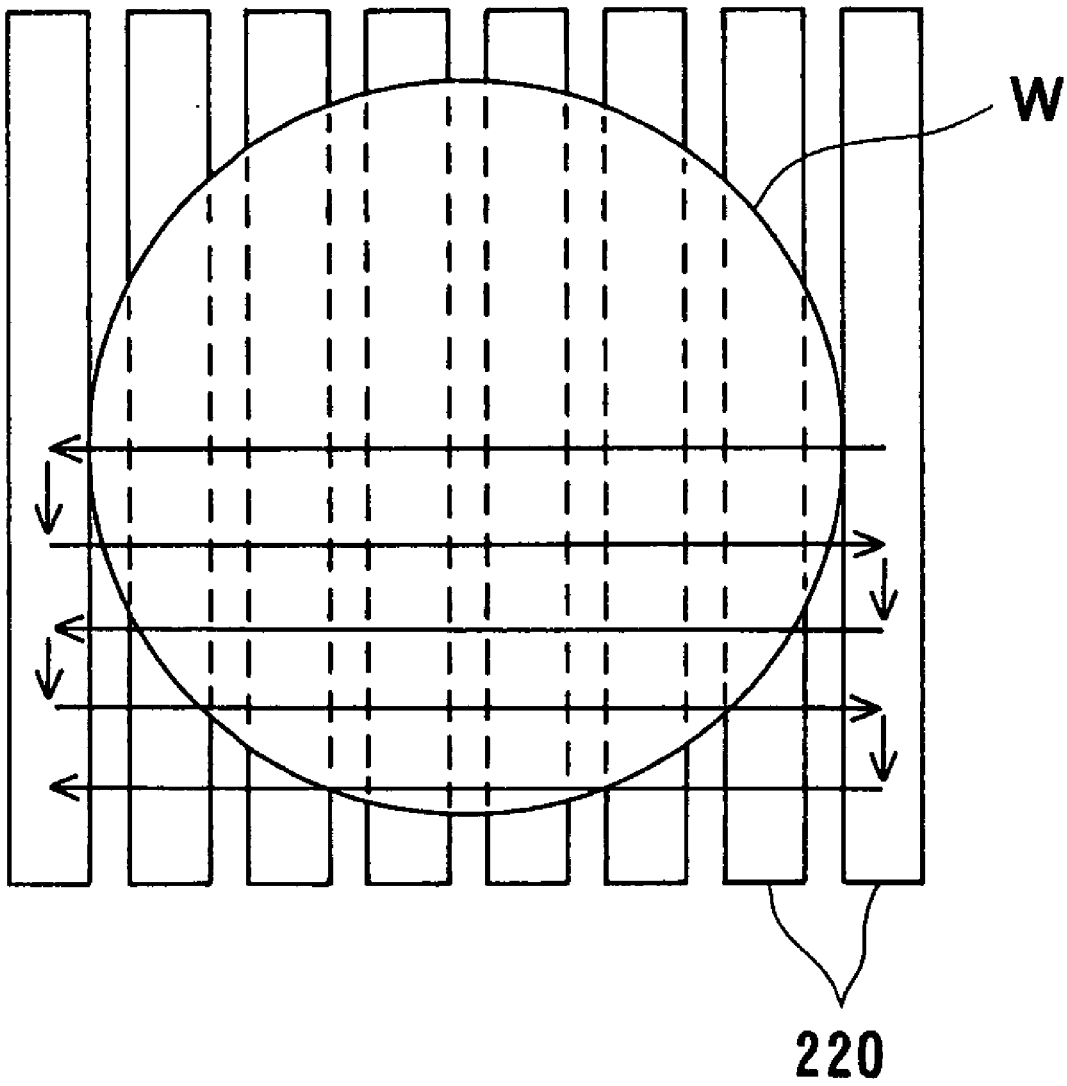
FIG. 29 is a diagram illustrating an electrolytic processing method according to still another embodiment of the present invention.
Figure 30A:
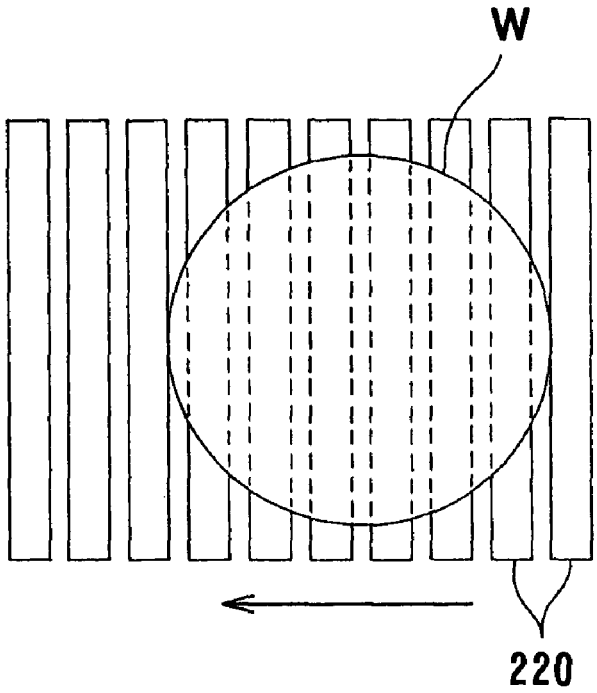
FIGS. 30A and 30B are diagrams illustrating an electrolytic processing method according to still another embodiment of the present invention.
Figure 30B:
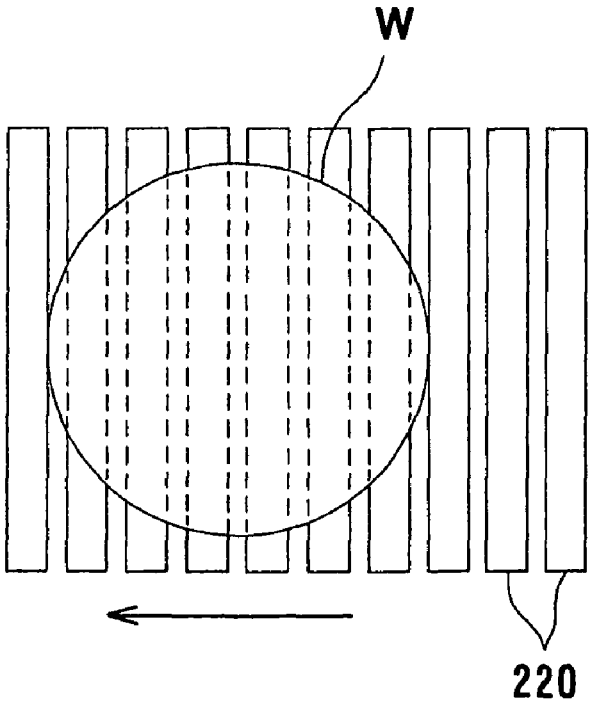

Alternatively, as shown by the arrows in FIG. 29, it is possible to shift the position of the substrate W in the long direction of the processing electrodes 220 between the forward movement and the backward movement in the second relative movement, thus changing the position of the substrate W relative to the processing electrodes 220 in the long direction in the second relative movement. According to this manner, even when there is some variation in the processing rate in the long direction of the processing electrodes 220, the variation can be evened out on the substrate W and the unevenness of processing can be eliminated as a whole. It is possible to change the position of the substrate W relative to the processing electrodes 220 in the long direction in the second relative movement, not between the forward and the backward movements, but with the movement in a certain direction in the second relative movement as a unit. Further, as shown in FIGS. 30A and 30B, it is also possible to shift the position of the substrate W in a direction perpendicular to the long direction of the processing electrodes 220 in the second relative movement.

Figure 27D:
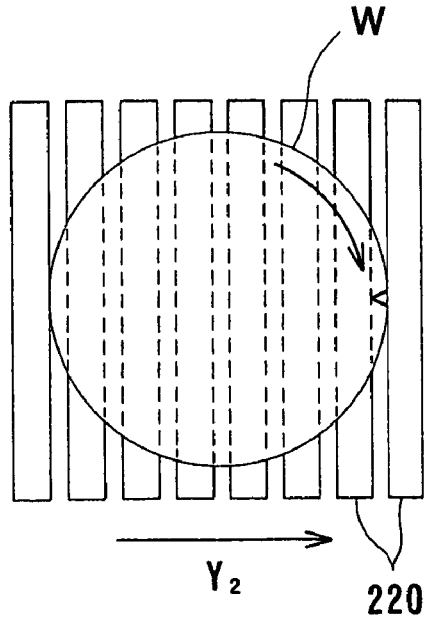
Figure 28A:
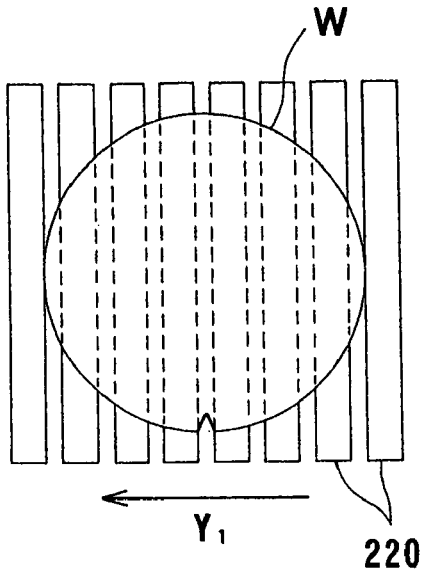
FIGS. 28A through 28D are diagrams illustrating an electrolytic processing method according to still another embodiment of the present invention.
Figure 28B:
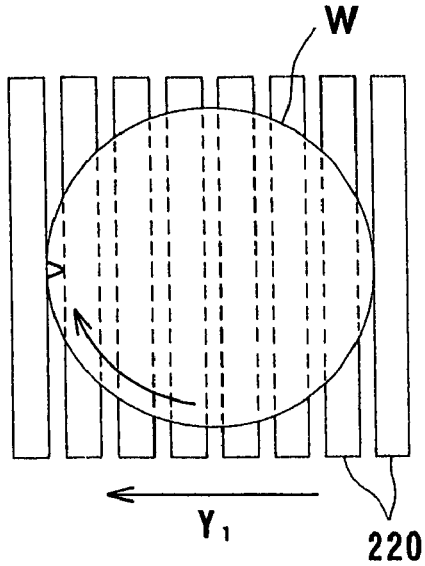
Figure 28C:
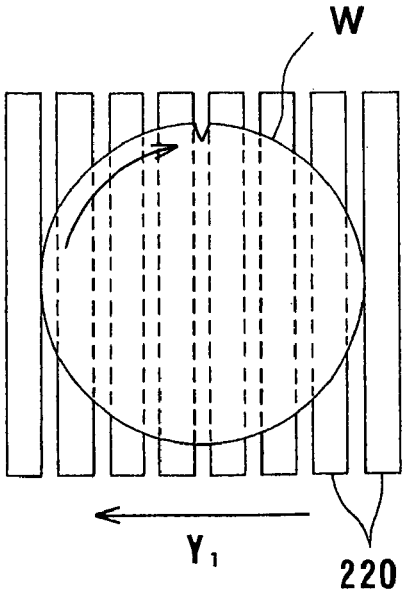
Figure 28D:
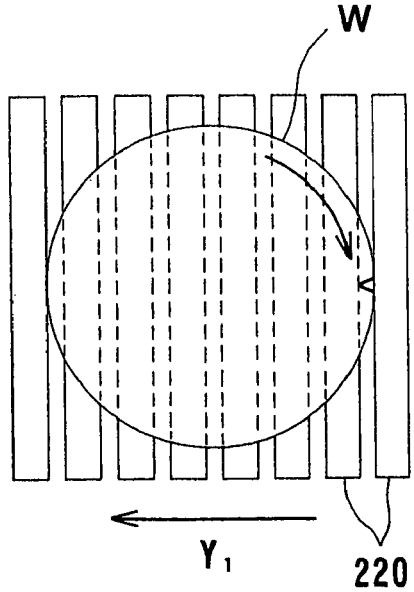
Figure 31A:
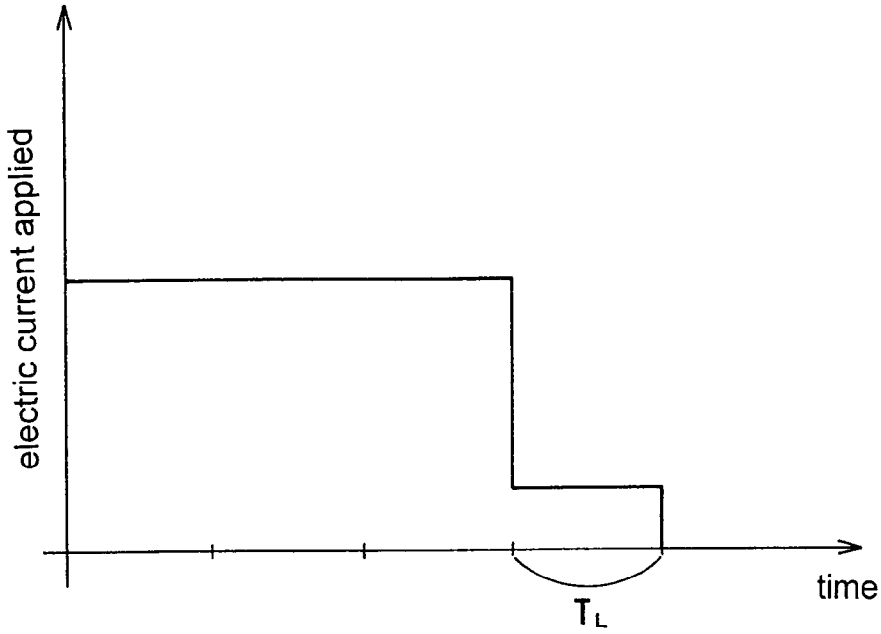
FIG. 31A is a graph showing an electric current applied between a processing electrode and a feeding electrode during electrolytic processing.
Figure 31B:
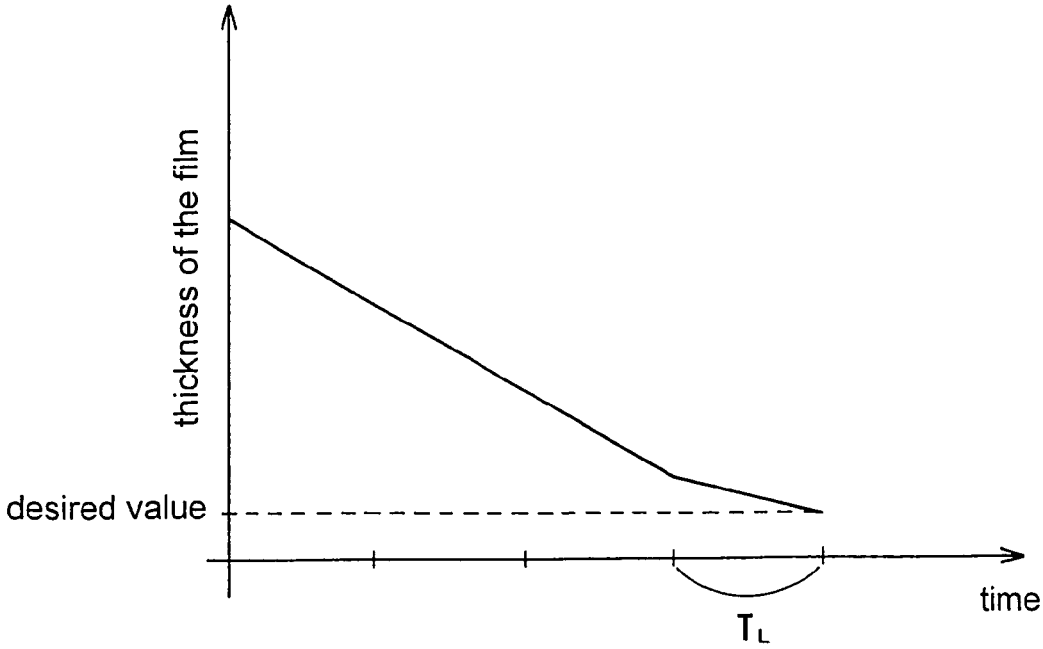
FIG. 31B is a graph showing a change in the thickness of a film on a substrate as observed in the electrolytic processing carried out by applying the electric current shown in FIG. 31A.

It is possible to change the voltage and/or electric current applied between the processing electrodes and the feeding electrodes every process step (i.e. a movement cycle in the second relative movement for a distance corresponding to an integral multiple of the pitch determined in the processing amount distribution obtained in the first relative movement) so as to properly control the processing rate. For example, as shown in FIGS. 31A and 31B, the electric current applied may be made small for the time TL during which the last step, e.g. the step shown in FIG. 27D, is carried out, so that the thickness of the film on the substrate W can reach a desired value. Alternatively, the speed (scanning speed) of the second relative movement may be changed every processing step with the electric current unchanged, thereby properly controlling the processing rate.

Figure 32A:
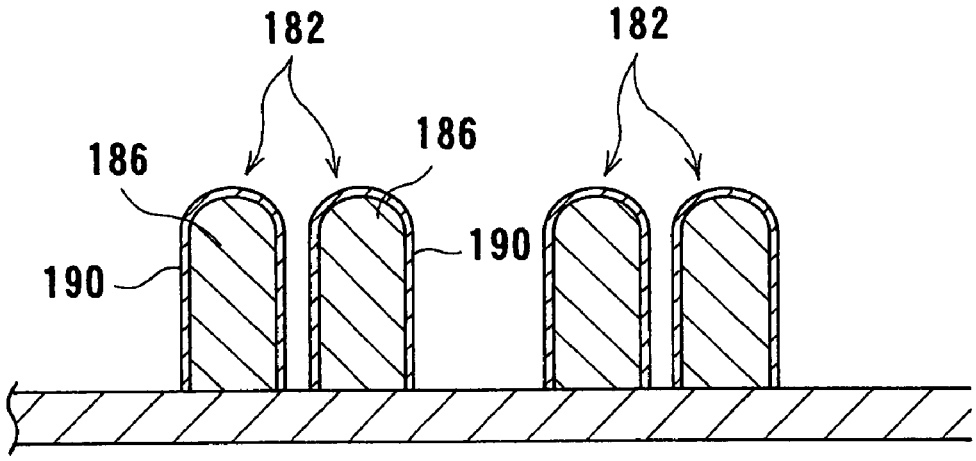
FIGS. 32A and 32B are vertical sectional views of different processing electrodes for use in the electrolytic processing apparatus according to still another embodiment of the present invention.
Figure 32B:
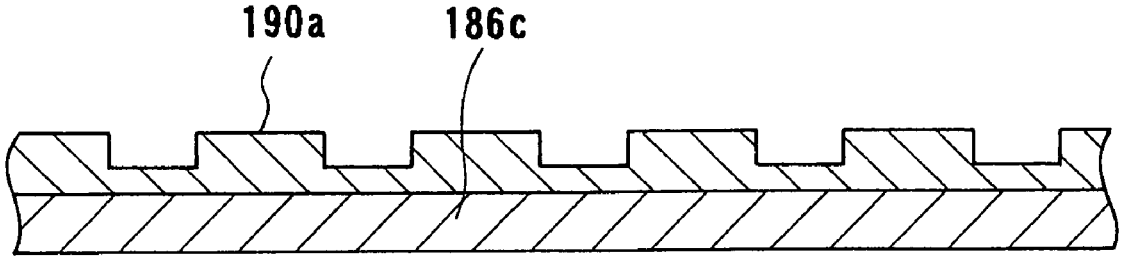

Though in the above-described embodiment the electrode members 182 are disposed in parallel at an even pitch, the present invention may also be applied to cases where the electrode members 182 are not disposed at an even pitch as shown in FIG. 32A. Also in such cases, it is possible to process the entire surface of the substrate W uniformly by carrying out the second relative movement for a distance corresponding to an integral multiple of the pitch determined in the processing amount distribution obtained in the first relative movement. Further, the present invention may be applied also to a tabular processing electrode 186*c* as shown in FIG. 32B, to which an ion exchanger 190*a* having irregularities in the surface is attached.

Though in the above-described embodiment the processing is carried out while allowing the electrode section 146 to make a scroll movement and moving the substrate W in a direction perpendicular to the long direction of the electrode members 182, it is possible, for example, to carry out the first relative movement by allowing the substrate to make a scroll movement and carry out the second relative movement by moving the electrode section 146 in a direction perpendicular to the long direction of the electrode members 182. Further, the first relative movement may be any cyclical movement with a certain orbit insofar as it eventually corresponds to a relative reciprocating movement. For example, besides the above-described scroll movement, a translatory reciprocating movement in the Y direction or a cyclical movement with an oval or polygonal, such as quadrangular or triangular, orbit may be employed.

In the present invention, the speed of motion of the electrode section side may be changed with time.

The speed of motion of the electrode section in one to-and-fro motion may be changed. The speed of motion of the electrode portion may be increased, for example, at the end point of the path of a to-and-fro motion (around the turn of a to-and-fro motion) so as not to stay the electro station at the one point of the substrate for long time.

Figure 33:
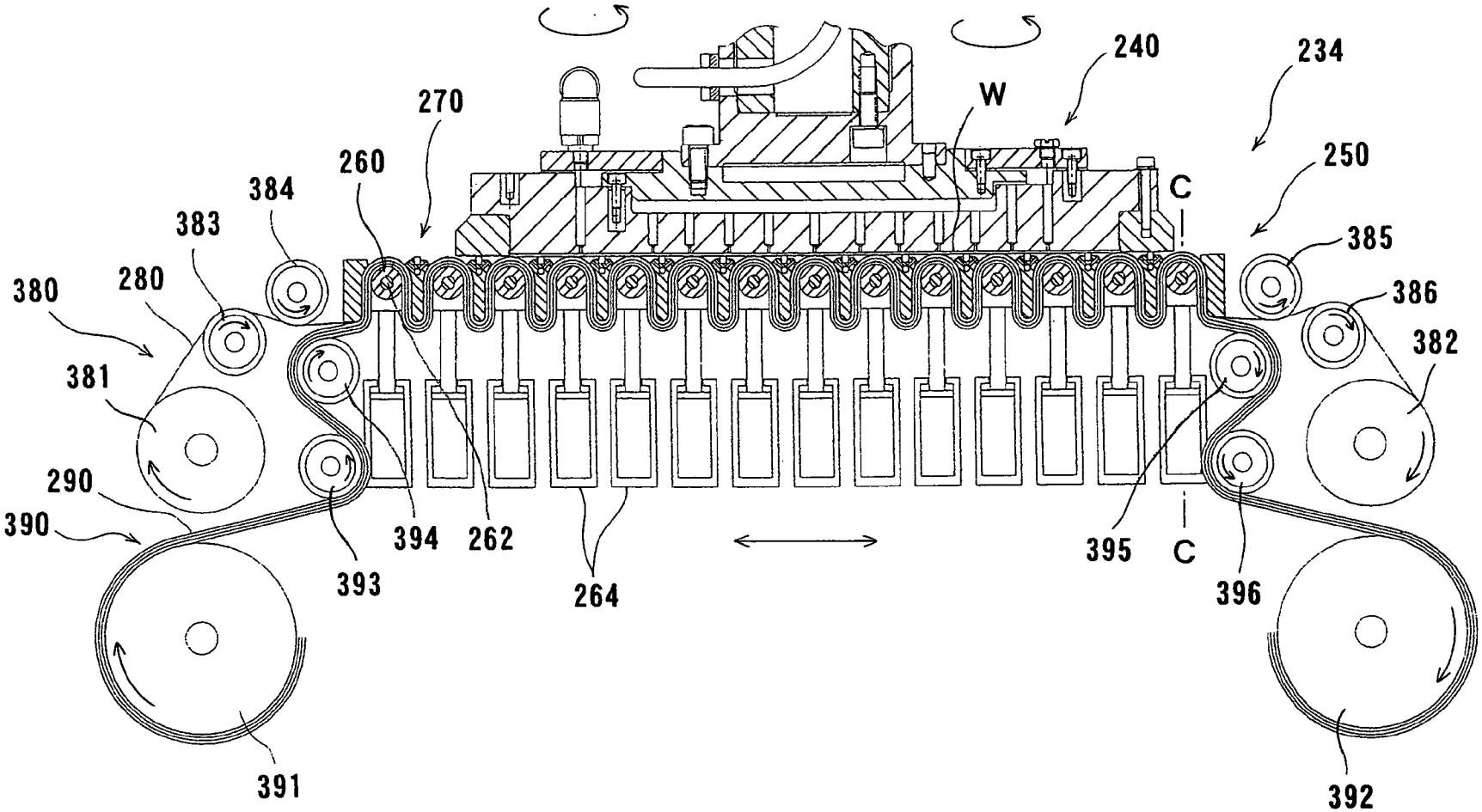
FIG. 33 is a vertical sectional view showing the main portion of an electrolytic processing apparatus according to still another embodiment of the present invention.

FIG. 33 is a sectional view showing the main portion of an electrolytic processing apparatus according to still another embodiment of the present invention. As shown in FIG. 33, the electrolytic processing apparatus 234 includes a substrate holder 240 for attracting and holding a substrate W with its front surface facing downward (face-down), and an electrode section 250 provided below the substrate holder 240. The substrate holder 240 is rotatable and vertically movable by means of a not-shown rotating mechanism and elevating mechanism, and, in addition, can make a scroll movement by means of a not-shown scroll movement mechanism. Further, the electrode section 250 can make a tranalatory reciprocating movement in a horizontal direction by means of a not-shown translatory reciprocating movement mechanism. Thus, according to this embodiment, the scroll movement, which requires a complicated mechanism and involves a large inertia, is effected by the lightweight substrate holder 240, and the translatory reciprocating movement, which is carried out at a low speed with a simple mechanism, is effected by the electrode section 250, whereby the relative movement between the substrate W and the electrode section 250 is carried out efficiently.

Figure 34:
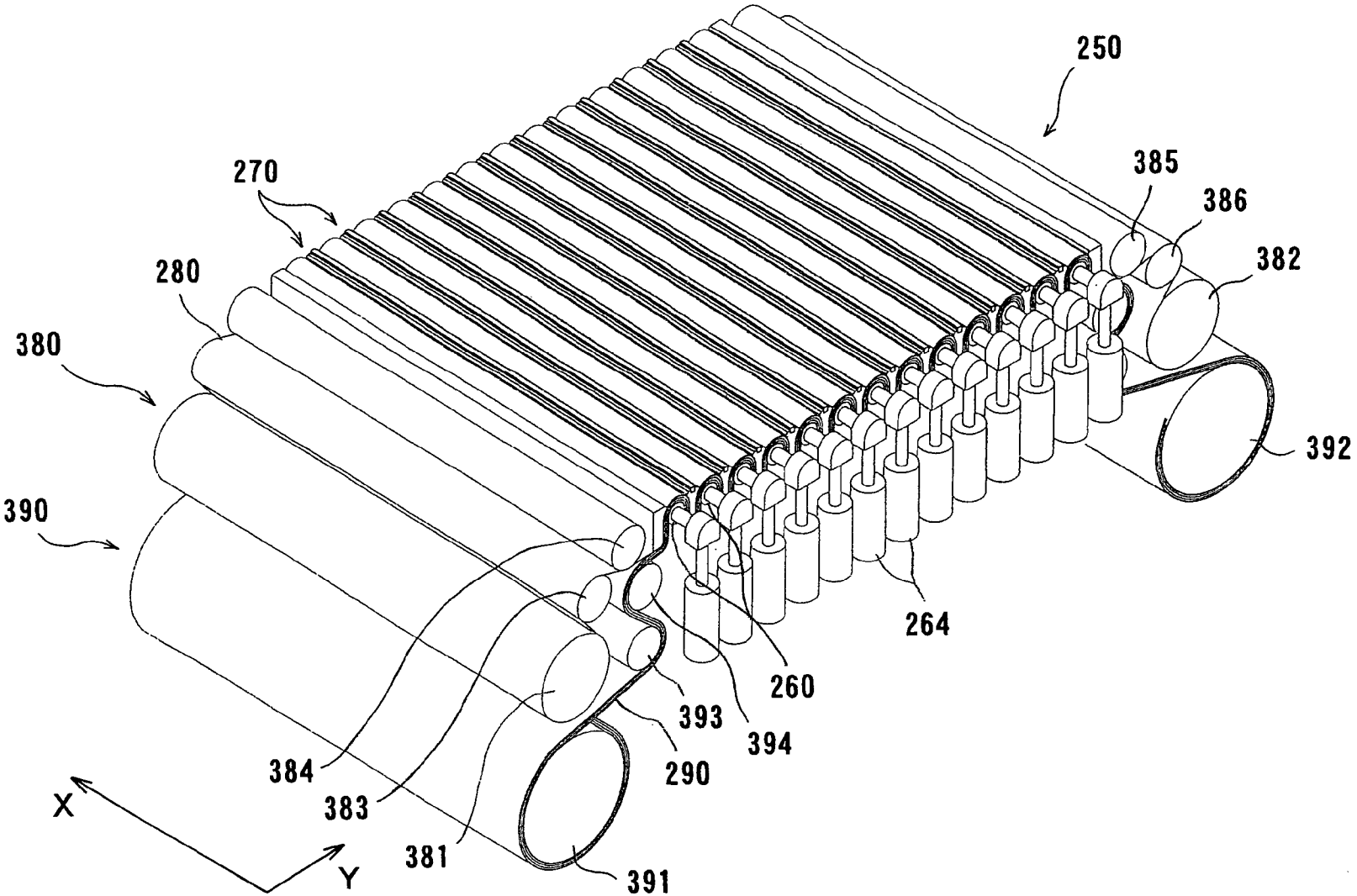
FIG. 34 is a perspective view showing the electrode section of FIG. 33.

FIG. 34 is a perspective view showing the electrode section 250 of FIG. 33. As shown in FIGS. 33 and 34, the electrode section 250 includes a plurality of cylindrical rotatable members 260 and intervening members 270 intervening between adjacent rotatable members 260. Two types of ion exchangers 280, 290, laminated above and below, thread between the rotatable members 260 and the intervening members 270. There are ion exchangers having various properties. For example, an ion exchange membrane with a smooth surface shows an excellent ability to eliminate surface unevenness e.g. in polishing processing of copper in the surface of a semiconductor wafer, but has a small ion exchange capacity. An ion exchange membrane formed of a nonwoven fabric, though its surface unevenness eliminating ability is poor, has a large ion exchange capacity. According to this embodiment, two types of ion exchangers 280, 290, having different properties, are used in combination so as to compensate for each other's defects.

It is preferred that the upper ion exchanger 280 to be opposed to the workpiece have a higher hardness than the lower ion exchanger 280 and also have a good surface smoothness. According to this embodiment, Nafion (trademark, DuPont Co.) with a thickness of 0.2 mm is employed. The term "high hardness" herein means high rigidity and low modulus of elasticity against compression. A material having a high hardness, when used in processing of a workpiece having fine irregularities in the surface, such as a patterned wafer, hardly follows the irregularities and is likely to selectively remove the raised portions of the pattern. The expression "has a surface smoothness" herein means that the surface has few irregularities. Anion exchanger having a surface smoothness is less likely to contact the recesses in the surface of a workpiece, such as a patterned wafer, and is more likely to selectively remove the raised portions of the pattern.

It is preferred to use an ion exchanger having a large ion exchange capacity as the lower ion exchanger 290. According to this embodiment, the ion exchanger 290 has a multi-layer structure of a laminate of three 1 mm-thick C membranes (nonwoven fabric ion exchangers), and thus has an increased total ion exchange capacity. The use of such an ion exchanger having a large ion exchange capacity can prevent the processing products (oxides and ions) produced by the electrolytic reaction from accumulating in the ion exchanger 290 in an amount exceeding the accumulation capacity of the ion exchanger 290. This can prevent the processing products accumulated in the ion exchanger 290 from changing their forms and adversely affecting the processing rate and its distribution. Further, an ion exchange capacity large enough for treating a desired processing amount of workpiece can be secured. The ion exchanger 290 may be of a single membrane, when its ion exchange capacity is sufficiently high.

According to this embodiment, by thus combining the ion exchanger 280 having a surface smoothness with the ion exchanger 290 having a large ion exchange capacity, the defect of small ion exchange capacity of the ion exchanger 280 is compensated for by the ion exchanger 290. Thus, taking-in of the processing product is performed by the ion exchanger 290 having a large ion exchange capacity, while processing of the substrate W is performed by the ion exchanger 280 having a surface smoothness, whereby a high-precision, large-processing amount processing can be effected.

Further, it is preferred to use an ion exchanger having excellent water permeability as the upper ion exchanger 280. By permitting pure water or ultrapure water to flow through the ion exchanger 280, a sufficient amount of water can be supplied to a functional group (sulfonic acid group in the case of a strongly acidic cation-exchange material) to thereby increase the amount of dissociated water molecules, and the processing products (including gasses) formed by the reaction between the to-be-processed material and hydroxide ions (or OH radicals) can be removed by the flow of water, whereby the processing efficiency can be enhanced. The flow of pure water or ultrapure water is therefore necessary, and the flow should desirably be constant and uniform. The constancy and uniformity of the flow leads to constancy and uniformity in the supply of ions and the removal of the processing products, thus leading to constancy and uniformity in the processing efficiency. If the material per se of the ion exchanger 280 has no water permeability, it is possible to provide the ion exchanger with water permeability and permit water to flow therethrough by forming a number of holes. In case that the ion exchanger 280 has poor water permeability, it is desirable that a sufficient amount of water be supplied to both sides of the ion exchanger 280.

Such ion exchangers 280, 290, as with the above-described embodiment, are composed of a nonwoven fabric having an anion exchange group or a cation exchange group.

As shown in FIGS. 33 and 34, the electrode section 250 is provided with an upper feed mechanism 380 for feeding and changing the upper ion exchanger 280, and a lower feed mechanism 390 for feeding and changing the lower ion exchanger 290. The upper feed mechanism 380 includes a feed reel 381 on which the ion exchanger 280 is wound, a take-up reel 382 for rewinding the ion exchanger 280 wound on the feed reel 381, two small-diameter rollers 383, 384 disposed on the feed reel 381 side, and two small-diameter rollers 385, 386 disposed on the take-up reel 382 side. Similarly, the lower feed mechanism 390 includes a feed reel 391 on which the ion exchanger 290 is wound, a take-up reel 392 for rewinding the ion exchanger 290 wound on the feed reel 391, two small-diameter rollers 393, 394 disposed on the feed reel 391 side, and two small-diameter rollers 395, 396 disposed on the take-up reel 392 side.

The ion exchanger 280, wound on the feed reel 381 of the upper feed mechanism 380, passes over the rollers 383, 384 and threads between the rotatable members 260 and the intervening members 270, then passes over the rollers 385, 386 and reaches the take-up reel 382. The ion exchanger 290, wound on the feed reel 391 of the lower feed mechanism 390, passes over the rollers 393, 394 and threads between the rotatable members 260 and the intervening members 270, then passes over the rollers 395, 396 and reaches the take-up reel 392.

The rollers 383, 384, 385, 386 of the upper feed mechanism 380 and the rollers 393, 394, 395, 396 of the lower feed mechanism 390 are rotatable, and respectively impart a tension to the ion exchanger 280, 290. The take-up reels 382, 392 are respectively connected to not-shown motors, and the take-up reels 382, 392 are rotated by the actuation of the motors to respectively rewind the ion exchangers 280, 290 wound on the feed reels 381, 391.

Figure 35:
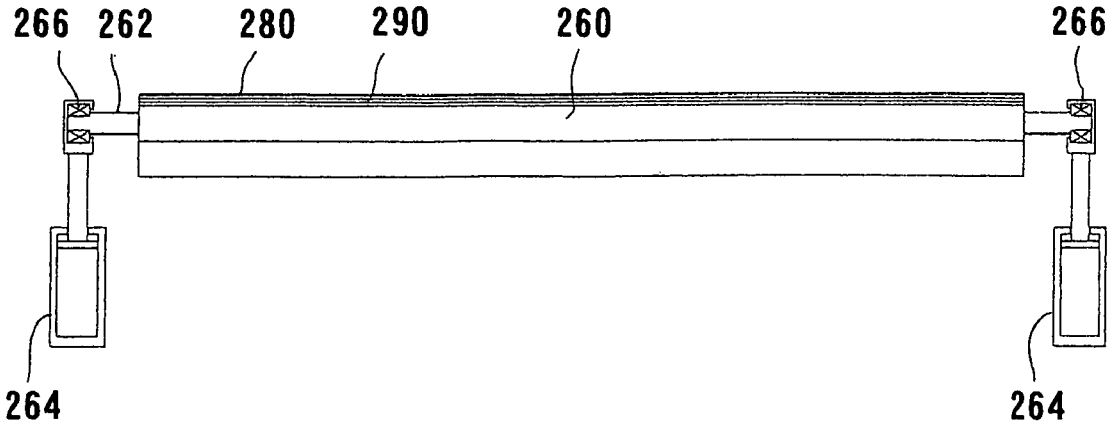
FIG. 35 is a sectional view taken along the line C-C of FIG. 33.
Figure 36:
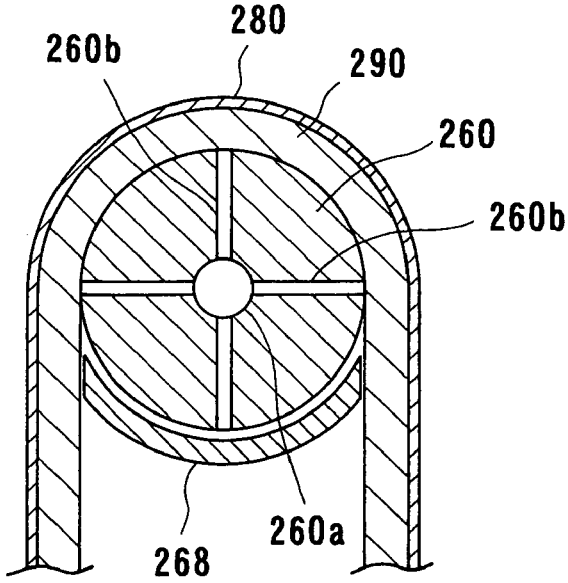
FIG. 36 is an enlarged sectional view of the rotatable member (processing electrode) shown in FIG. 33.

FIG. 35 is a sectional view taken along the line C-C of FIG. 33, and FIG. 36 is an enlarged sectional view of the rotatable member 260 shown in FIG. 33. As shown in FIG. 35, the shaft 262 of the rotatable member 260 is rotatably supported by bearings 266 that are mounted to the upper ends of cylinders 264 disposed on both sides of the rotatable member 260, so that the rotatable member 260 moves vertically by the actuation of the cylinders 264. According to this embodiment, the rotatable member 260 is connected to the cathode of a power source (not shown) and serves as a processing electrode. Thus, the processing electrode (rotatable member) 260 is so designed that it can move close to or away from the substrate W.

As shown in FIG. 36, a water passage hole 260*a*, extending in the axial direction of the rotatable member 260 (the X direction shown in FIG. 34), is formed in the interior of the rotatable member 260, and the water passage hole 260*a* is connected to a not-shown pure water supply source. Further, pure water supply holes 260*b*, extending radially from the water passage hole 260*a*, are formed at a plurality of locations in the axial direction of the rotatable member 260. The upper half surface of the rotatable member 260 and the ion exchanger 290 are in contact with each other, and pure water, more preferably ultrapure water, is supplied from the pure water supply holes 260*b* to the ion exchanger 290. A cover 268 for receiving the pure water or ultrapure water supplied from the pure water supply holes 260*b* is provided beneath the rotatable member 260. Owing to the cover 268, pure water or ultrapure water can be efficiently supplied to the ion exchanger 290 located above the cover 268.

Figure 37:
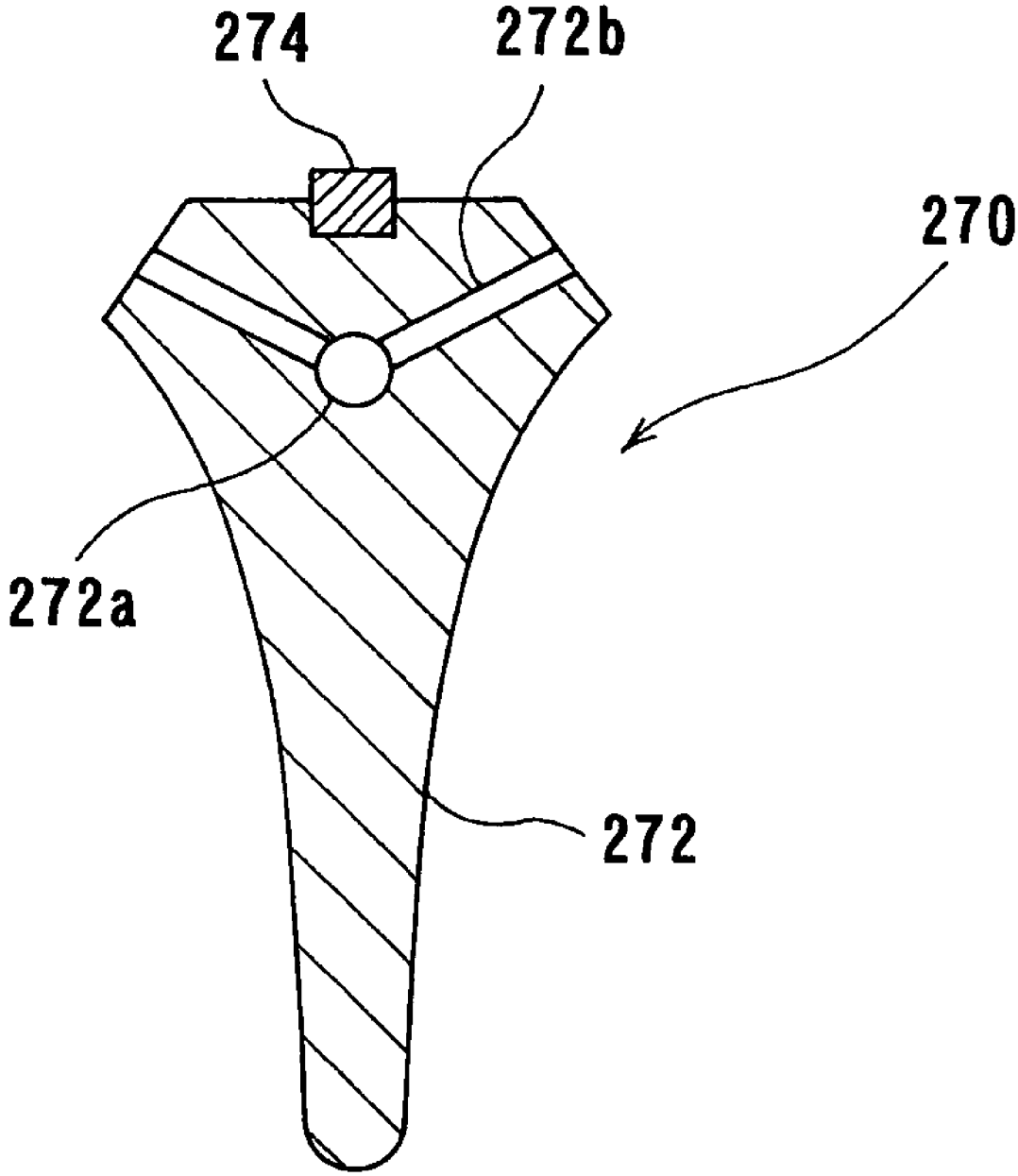
FIG. 37 is an enlarged view of the intervening member shown in FIG. 33.

FIG. 37 is an enlarged sectional view of the intervening member 270 shown in FIG. 33. As shown in FIG. 37, the intervening member 270 comprises a body 272 whose cross-section is vertically long and a feeding electrode 274 provided at the top of the body 272. The body 272 is formed of an electrochemically inactive and rigid material, for example, an engineering-plastic such as polyetheretherketone (PEEK), polyphenylene sulfide (PPS) or fluoroplastics. The feeding electrode 274, on the other hand, is formed of a soft conductive material.

As shown in FIG. 37, a water passage hole 272*a*, extending in the long direction of the intervening member 270 (the X direction shown in FIG. 34), is formed in the interior of the body 272, and the water passage hole 272*a* is connected to a not-shown pure water supply surface. Further, pure water supply holes 272*b*, extending obliquely upwardly from the water passage hole 272*a*, are formed at a plurality of locations in the long direction of the intervening member 270. Thus, pure water, more preferably ultrapure water, is supplied from the pure water supply holes 272*b* directly to the to-be-processed surface of the substrate W.

As described above, instead of pure water or preferred ultrapure water, it is possible to use a liquid having an electric conductivity of not more than 500 μS/cm, any desired electrolysis solution, e.g. an electrolysis solution obtained by adding an electrolyte to pure water or ultrapure water, or a liquid obtained by adding a surfactant, etc. to pure water or ultrapure water.

According to this embodiment, the processing electrodes (rotatable members) 260 are connected to the cathode of a power source (not shown), and the feeding electrodes 274 at the tops of the intervening members 270 are connected to the anode of the power source. When processing copper, for example, the electrolytic processing action occurs on the cathode side, and therefore an electrode connected to the cathode becomes a processing electrode, and an electrode connected to the anode becomes a feeding electrode. Depending upon the material to be processed, the processing electrodes (rotatable members) 260 may be connected to the anode of the power source and the feeding electrodes 274 may be connected to the cathode of the power source.

Processing (electrolytic processing) of a substrate by means of the substrate processing apparatus of this embodiment will now be described. First, a substrate W, having e.g. a copper film 6 as a conductive film (to-be-processed portion) in the surface as shown in FIG. 1B, is transferred to the electrolytic processing apparatus 234, where the substrate W is attracted and held by the substrate holder 240 such that the surface of the substrate W in which the conductive film (copper film 6) is formed faces downward. Thereafter, the substrate W held by the substrate holder 240 is brought close to or into contact with the surface of the ion exchanger 280 of the electrode section 250. For example, the substrate W is pressed against the surface of the ion exchanger 280 with the extent of pressing of e.g. about 0.5 mm. The substrate holder 240 and the substrate W are allowed to make a scroll movement and, at the same time, the electrode section 250 is allowed to make a translatory reciprocating movement in the Y direction (direction perpendicular to the long direction of the processing electrodes 260, see FIG. 34). At this time, pure water or ultrapure water is jetted from the pure water supply holes 272*b* of the intervening members 270 to between the substrate W and the electrode section 250, while pure water or ultrapure water is passed through the pure water supply holes 260*b* of the processing electrodes 260 to the ion exchanger 290, thereby impregnating the ion exchanger 290 with pure water or ultrapure water.

A given voltage is applied from the power source to between the processing electrodes 260 and the feeding electrodes 274, and electrolytic processing of the conductive film (copper film 6) in the surface of the substrate W is carried out at the processing electrodes (cathodes) 260 through the action of hydrogen ions and hydroxide ions produced by the ion exchangers 280, 290. The electrolytic processing is effected within the range of contact between the substrate W and the ion exchanger 280 (processing electrode 260) (the contact width is about 5 mm when the substrate W is pressed against the surface of the ion exchanger 280 with the extent of pressing of about 0.5 mm).

During the electrolytic processing, as described above, the voltage applied between the processing electrodes 260 and the feeding electrodes 274 or the electric current flowing therebetween is monitored by the monitor 38 (see FIG. 4) to detect the end point of processing.

After completion of the electrolytic processing, the power source is disconnected and the scroll movement of the substrate holder 240 and the translatory reciprocating movement of the electrode section 250 are stopped, and then the processed substrate W is sent to the next process step.

When the electrolytic processing is continued and the ion exchange capacity of the ion exchanger reaches its limit, a need arises to change the ion exchanger. Operations for changing ion exchangers are generally carried out by hand. Such a manual operation necessitates stopping of the apparatus, increasing the downtime of the apparatus. According to the electrolytic processing apparatus of this embodiment, changes of the ion exchangers 280, 290 can be carried out automatically by the above-described feed mechanisms 380, 390, enabling a speedy change of ion exchanger. Accordingly, the downtime of the apparatus for changes of the ion exchangers 280, 290 can be shortened, leading to an increased throughput. A change of the ion exchangers 280, 290 is preferably carried out during electrolytic processing, or upon completion of electrolytic processing, or during the internal between one processing and the next processing.

Further, the electrolytic processing apparatus of this embodiment is provided with the feed mechanisms 380, 390 each for each of the ion exchangers 280, 290. This makes it possible to change only an ion exchange in need of change by the corresponding feed mechanism, thus lowering the running cost of the apparatus.

When, as in this embodiment, an ion exchanger having a surface smoothness is used as the ion exchanger 280 that comes close to or into contact with the substrate W, and an ion exchanger having a large ion exchange capacity is used as the ion exchanger 290 that does not come close to or into contact with the substrate W, because of the small ion exchanger capacity of the ion exchanger 280 having a surface smoothness, taking-in of the processing product is mainly effected by the ion exchanger 290 having a large ion exchange capacity. In view of this, the change cycle of the ion exchanger 290 having a large ion exchange capacity, which has taken in the processing product, may be shortened compared to that of the ion exchanger 280 having a surface smoothness. Thus, by changing only the ion exchanger 290 having a large ion exchange capacity while using the expensive ion exchanger 280 having a surface smoothness to its wear limit without a change, the running cost of the apparatus can be lowered.

Figure 38:
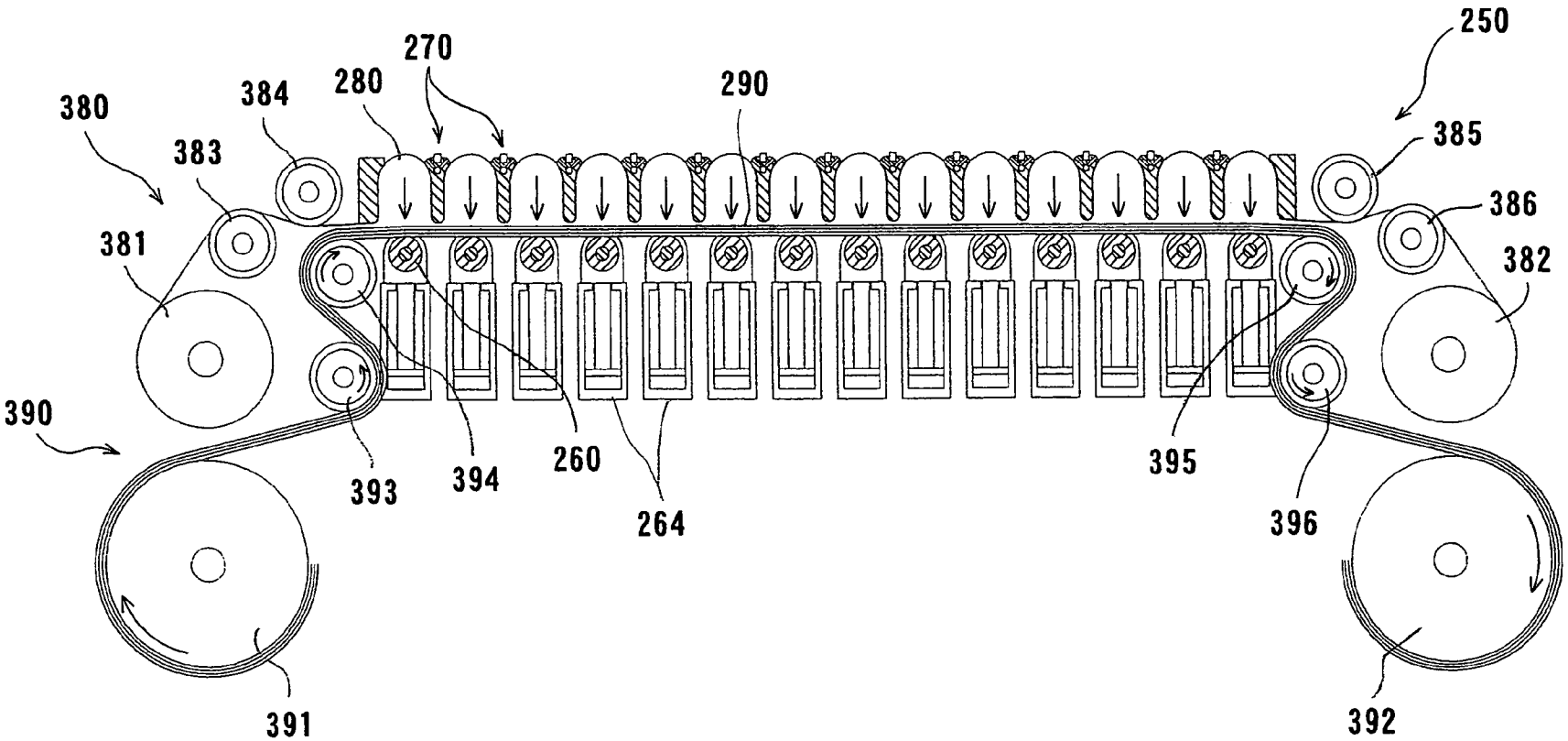
FIG. 38 is a diagram illustrating the state of the electrode section of FIG. 33 upon change of one of the ion exchangers.

In the case of changing only the ion exchanger 290 in the electrolytic processing apparatus 234 of this embodiment, as shown in FIG. 38, the cylinders 264 are driven to move the processing electrodes 260 downwardly. The motor connected to the take-up reel 392 of the lower feed mechanism 390 is then driven to rewind a predetermined amount of the lower ion exchanger 290 on the take-up reel 392, thereby carrying out a change of the ion exchanger 290. Since the taking-in of the reaction product is effected only in the range of the ion exchanger 290 positioned between the processing electrodes 260 and the substrate W, the ion exchanger 290 is rewound in such an amount that the ion exchanger 290 in that range is replaced and the used ion exchanger 290 is not in that range any more.

Figure 39:
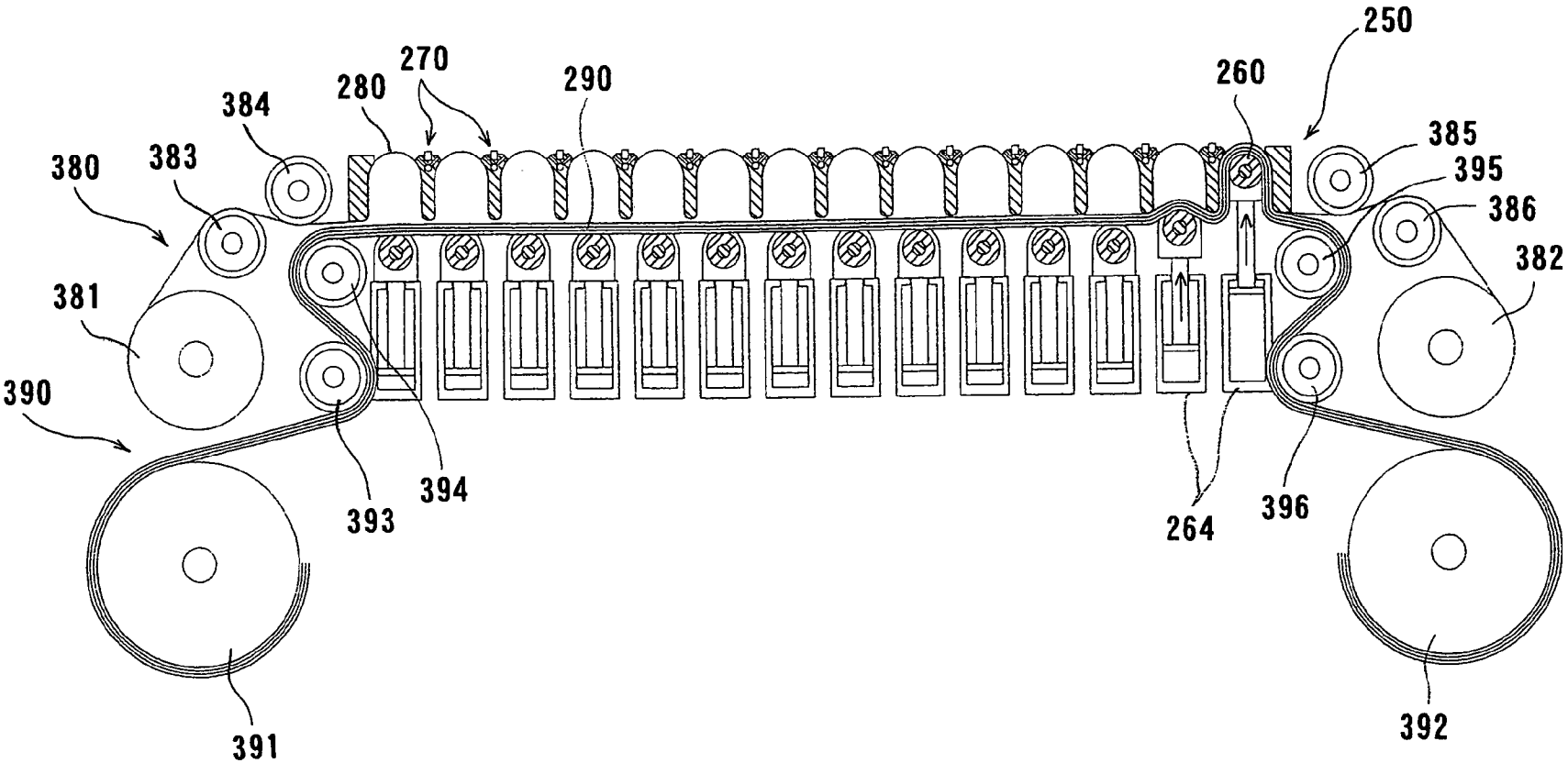
FIG. 39 is a diagram illustrating the state of the electrode section of FIG. 33 upon change of one of the ion exchangers.

After completion of the change of the range of ion exchanger 290 positioned between the processing electrodes 260 and the substrate W, as shown in FIG. 39, the cylinders 264 are driven in order, starting from the one closest to the take-up reel 392, so as to raise the processing electrodes 260 in order. This is because if all of the processing electrodes 260 are raised simultaneously, the ion exchanger 290 could be caught at the lower ends of the intervening members 270. It is possible to first raise a central processing electrode 260 and then to raise the processing electrodes 260 on both sides in order. In this case, part of the ion exchanger 290 rewound on the take-up reel 392 should be returned to the feed reel 391 side again. It is therefore preferred that an extra ion exchanger 290 be rewound on the take-up reel 392 in advance.

Thus, according to the electrolytic processing apparatus of this embodiment, the change cycle of the ion exchanger not to come close to or into contact with the substrate W, i.e. the ion exchanger 290 having a large ion exchange capacity, is shortened compared to the change cycle of the ion exchanger to be close to or in contact with the substrate W, i.e. the ion exchanger 280 having a surface smoothness. By changing only the ion exchanger 290 that has taken in the processing product while using the expensive ion exchanger 280 having a surface smoothness to its wear limit without a change, the running cost of the apparatus can be lowered.

Figure 40:
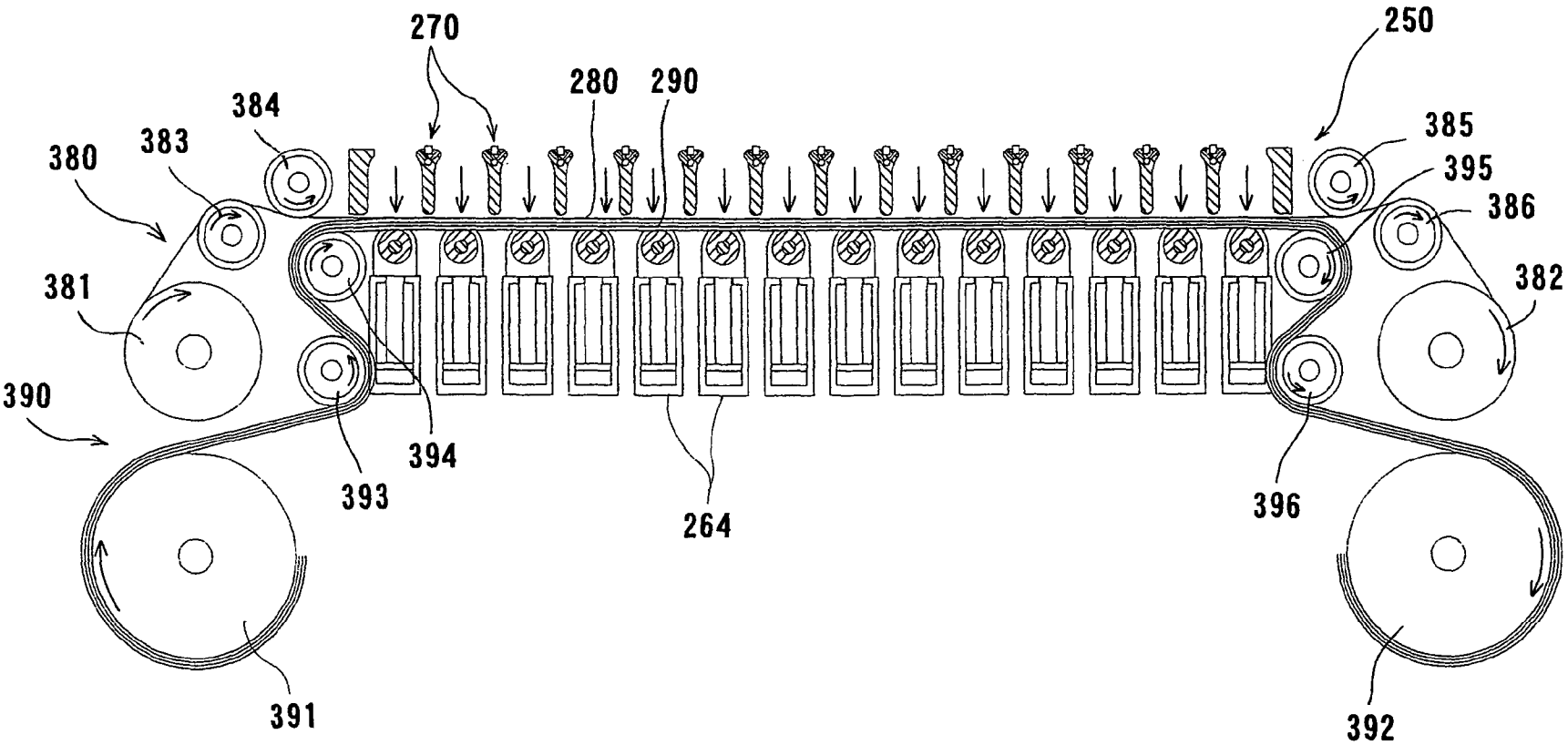
FIG. 40 is a diagram illustrating the state of the electrode section of FIG. 33 upon change of both of the ion exchangers.

It is possible to change both of the ion exchangers 280, 290 simultaneously. In this case, as shown in FIG. 40, the cylinders 264 are driven to move the processing electrodes 260 downwardly. The motors connected to the take-up reel 382 of the upper feed mechanism 380 and to the take-up reel 392 of the lower feed mechanism 390 are then driven to rewind a predetermined amount of the ion exchangers 280, 290 respectively on the take-up reels 382, 392, thereby changing the ion exchangers 280, 290.

Further, the electrolytic processing apparatus of this embodiment can change the ion exchanger even during electrolytic processing. Thus, the motor connected to the take-up reel 382 of the upper feed mechanism 380 and/or the motor connected to the take-up reel 392 of the lower feed mechanism 390 is driven, without lowering the processing electrodes 260, to rewind the ion exchanger 280 and/or the ion exchanger 290 on the take-up reel 382 and/or the take-up reel 392, thereby changing the ion exchanger 280 and/or the ion exchanger 290. The electrolytic processing apparatus 234 of this embodiment, which can thus change the ion exchanger without stopping the apparatus, can further shorten the downtime.

Figure 41:
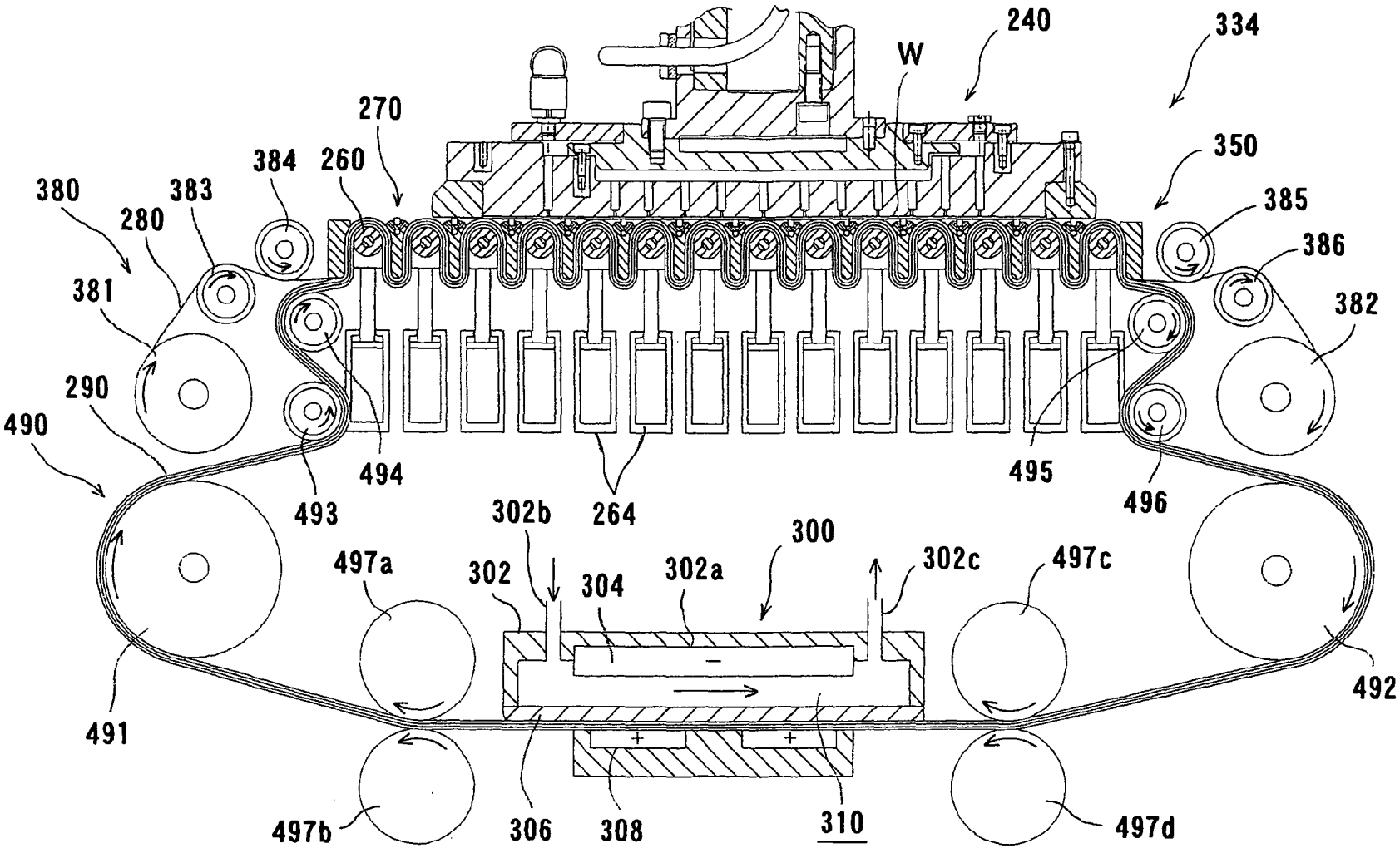
FIG. 41 is a vertical sectional view showing the main portion of an electrolytic processing apparatus according to still another embodiment of the present invention.

FIG. 41 is a vertical sectional view showing the main portion of an electrolytic processing apparatus according to still another embodiment of the present invention. In FIG. 41, the same members or elements as in the above-described embodiment shown in FIGS. 33 through 40, having the same operation or function, are given the same reference numerals, and the description thereof is partly omitted.

According to this embodiment, a lower feed mechanism 490 for feeding and changing the lower ion exchanger 290, includes two reels 491, 492, two rollers 493, 494 disposed on the reel 491 side, two rollers 495, 496 disposed on the reel 492 side, and four rollers 497*a*, 497*b*, 497*c*, 497*d* disposed below the reels 491, 492. The ion exchanger 290, in an endless form, passes over the reel 419, the rollers 493, 494, 495, 496 and the reel 492, passes between the roller 497*c* and the roller 497*d* and then between the roller 497*a* and the roller 497*b*, and returns to the roller 491. The ion exchanger 290 is thus allowed to circulate.

A regeneration device 300 for regenerating the ion exchanger 290 is disposed beneath an electrode portion 350. When electrolytic processing of copper is conducted by using, as the ion exchanger 290, an ion exchanger having a cation-exchange group, the ion-exchange group of the ion exchanger (cation exchanger) 290 is saturated with copper after the processing, whereby the processing efficiency of the next processing is lowered. When electrolytic processing of copper is conducted by using, as the ion exchanger 290, an ion exchanger having an anion-exchange group, fine particles of a copper oxide can be produced and adhere to the surface of the ion exchanger (anion exchanger) 290, whereby particles can contaminate the surface of a next substrate to be processed. Such harmful effects can be eliminated by regenerating the ion exchanger 290 with regeneration device 300.

The regeneration device 300 includes a regeneration electrode holder 302 having a downwardly-open depression 302*a*, a regeneration electrode 304 disposed on the depression 302*a*, a partition 306 closing the downwardly-open end of the depression 302*a*, and an electrode section 308 disposed beneath the partition 306. The ion exchanger 290 for regeneration is poisoned between the partition 306 and the electrode section 308. A discharge portion 310, defined by the partition 306, is formed in the regeneration electrode holder 302. Further, a liquid inlet 302*b* and a liquid outlet 302*c*, communicating with the discharge portion 310, are respectively provided in the regeneration electrode holder 302. A liquid is supplied from the liquid inlet 302*b* into the discharge portion 310. The liquid supplied fills the discharge portion 310, so that the regeneration electrode 304 is immersed in the liquid. Thereafter, the liquid supplied into the discharge portion 310 flows in one in direction in the discharge portion 310 and is discharged sequentially from the liquid outlet 302*c*.

It is desired that the partition 306 does not hinder the migration therethrough of impurity ions removed from the ion exchanger 290 and inhibit permeation therethrough of the liquid (including ions in the liquid) flowing between the partition 306 in the discharge portion 310 and the regeneration electrode 304 into the ion exchanger 290 side. In this regard, ion exchangers permit selective permeation therethrough either cations or anions. Further, a film-type ion exchanger as a partition can prevent intrusion of the liquid flowing between the partition 306 and the regeneration electrode 304 into the ion exchanger 290 side. Thus, a suitably selected film-type ion exchanger can meet the above requirements for the partition 306.

According to this embodiment, the ion exchanger used as the partition 306 has the same type of ion-exchange group as the ion exchanger 290 to be regenerated. That is, when a cation exchanger having a cation-exchange group is used as the ion exchanger 290, a cation exchanger is used also as the partition (ion exchanger) 306. When an anion exchanger having an anion-exchange group is used as the ion exchanger 290, an anion exchanger is used also as the partition (ion exchanger) 306.

It is desired that the liquid to be supplied into the discharge portion 310 be a liquid, such as an electrolytic solution, which has a high electric conductivity and does not form a hardly soluble or insoluble compound through a reaction with ions removed from the ion exchanger to be processed. Thus, the liquid is for discharging those ions, which have moved from the ion exchanger 290 and passed through the partition 306, out of the system by the flow of the liquid. The above liquid having a high conductivity, because of its low electric resistance, can reduce the power consumption in the regeneration apparatus 300. Further the above liquid, which does not form an insoluble compound (by-product) through a reaction with the impurity ions, can prevent adhesion of a solid matter to the partition 306. A suitable liquid may be chosen depending upon the kind of the impurity ion to be discharged. For example, when regenerating the ion exchanger 290 that was used in electrolytic polishing of copper, sulfuric acid with a concentration of 1 wt % or higher may be used.

The regeneration electrode 304 is to be connected to one of the electrodes (e.g. cathode) of the power source, while the electrode portion 308 is connected to the other electrode (e.g. anode) of the power source. Such control is made that, for example, when a cation exchanger is used as the ion exchanger 290, the regeneration electrode 304 should become a cathode, and when an anion exchanger is used as the exchanger 290, the regeneration electrode 304 should become an anode.

One of the electrodes (e.g. cathode) of the power source is connected to the regeneration electrode 304 and the other electrode (e.g. anode) is connected to the electrode portion 308, thereby applying a voltage between the regeneration electrode 304 and the electrode portion 308. At this time, a liquid is supplied into the discharge portion 310 provided inside the regeneration electrode holder 302 so as to fill the discharge portion 310 with the liquid, thereby immersing the regeneration electrode 304 in the liquid and allowing the liquid to flow in one direction in the discharge portion 310 and to be discharged from the liquid outlet 302*c*.

Upon the electrical connection, such control is made that the regeneration electrode 304 should have the opposite polarity to the polarity of the ion exchanger 290 (and of the partition 306). Thus, when a cation exchanger is used as the ion exchanger 290 (and as the partition 306), the regeneration electrode 304 should become a cathode and the electrode portion 308 should become an anode. Conversely, when an anion exchanger is used as the ion exchanger 290 (and as the partition 306), the regeneration electrode 304 should become an anode and the electrode portion 308 a cathode. By the above operation, ions in the ion exchanger 290 are moved toward the regeneration electrode 304, passed through the partition 306, and introduced into the discharge portion 310. The ions thus moved into the discharge portion 310 are discharged out of the system by the flow of the liquid supplied into the discharge portion 306. Regeneration of the ion exchanger 290 is thus effected. When a cation exchanger is used as the ion exchanger 290, cations taken in the ion exchanger 290 pass through the partition 306 and move into the discharge portion 310; when an anion exchanger is used, anions taken in the ion exchanger 290 pass through the partition 306 and move into the discharge portion 310, whereby the ion exchanger 290 is regenerated.

In the above regeneration treatment, as descried above, an ion exchanger having the same type of ion-exchange group as the ion exchanger 290 is used as the partition 306. This prevents migration of impurity ions in the ion exchanger 290 through the partition (ion exchanger) 306 from being hindered by the partition 306, thereby preventing an increase in the power consumption. Further, this inhibits permeation through the partition 306 of the liquid (including ions in the liquid) flowing between the partition 306 and the regeneration electrode 304, thus inhibiting movement of the liquid to the ion exchanger 290 side and preventing re-contamination of the regenerated ion exchanger 290. Furthermore, preferably used as the liquid to be supplied between the partition 306 and the regeneration electrode 304 is a liquid which has an electric conductivity of not less than 50 μS/cm and does not form a hardly soluble or insoluble compound through a reaction with ions removed from the ion exchanger 290. Such a liquid, because of its low electric resistance, can reduce the power consumption in the regeneration section. Moreover the liquid does not form an insoluble compound (by-product) through a reaction with an impurity ion. In this regard, an insoluble compound, if formed, will adhere to the partition 306 whereby the electric resistance between the regeneration electrode 304 and the electrode portion 308 will be changed, making it difficult to control the electrolysis current. Such a problem can thus be prevented. Instead of using pure water or ultrapure water, it is possible to use a liquid having an electric conductivity of not more than 500 μS/cm or an electrolytic solution.

Thus, according to the embodiment of the electrolytic apparatus, the ion exchanger 290 that has been used in electrolytic processing is regenerated automatically, thereby lowering the running cost and, at the same, shortening the downtime.

Though the use in this embodiment of a laminate of the two types of ion exchangers 280, 290 has been described, it is possible to use, instead of the upper ion exchanger 280, a water-permeable member, such as a film comprising a PET base material in which a large number of pores are formed, by superimposing it on the surface of the lower ion exchanger 290. Such a water-permeable member, even if the base material per se has no permeability, can be made water-permeable by forming pores so that water can flow therethrough. The water-permeable member preferably has a smoother surface than the lower ion exchanger 290. In this case, it is preferred to make the change cycle of the ion exchanger shorter than the change cycle of the water-permeable member. Further, though the use in this embodiment of the rotatable members 260 as processing electrodes has been described, it is possible to use the rotatable members 260 as feeding electrodes.

Figure 42:
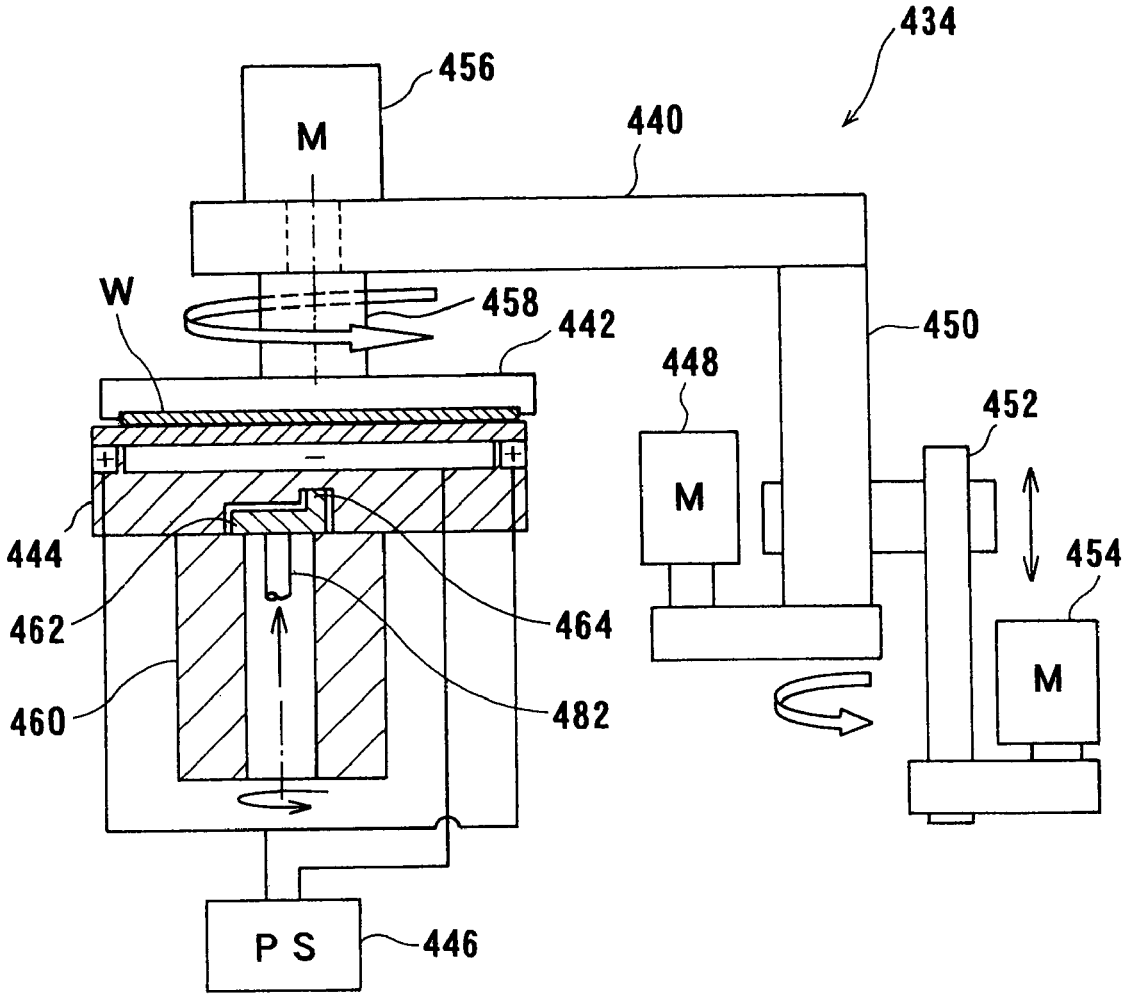
FIG. 42 is a vertical sectional view schematically showing an electrolytic processing apparatus according to still another embodiment of the present invention.

FIG. 42 is a vertical sectional view schematically showing the electrolytic processing apparatus 434 according to still another embodiment of the present invention. As shown in FIG. 42, the electrolytic processing apparatus 434 includes an arm 440 that can pivot horizontally and move vertically, a substrate holder 442, supported at the free end of the arm 440, for attracting and holding the substrate W with its front surface facing downward (face-down), a disk-shaped electrode section 444 positioned beneath the substrate holder 442, and a power source 446 to be connected to the electrode section 444.

The arm 440, which pivots horizontally by the actuation of a pivot motor 448, is connected to the upper end of a pivot shaft 450. The pivot shaft 450, which moves up and down integrated with the arm 440 via a ball screw 452 by the actuation of a vertical-movement motor 454, is engaged with the ball screw 452 that extends vertically. The pivot shaft 450 may be connected to an air cylinder, so that the pivot shaft 450 moves up and down by the actuation of the air cylinder.

The substrate holder 442 is connected to a substrate-rotating motor 456 as a first drive element, which is allowed to move the substrate W held by a substrate holder 442 and the electrode section 444 relatively to each other, via a shaft 458. The substrate holder 442 is rotated by the actuation of the substrate-rotation motor 456. The arm 440 can swing horizontally and move vertically, as described above, the substrate holder 442 can pivot horizontally and move vertically integrated with the pivot arm 440.

A hollow motor 460 as a second drive element, which is allowed to move the substrate W and the electrode section 444 relatively to each other, is disposed below the electrode section 444. A drive end 464 is formed at the upper end portion of the main shaft 462 and arranged eccentrically position to the center of the main shaft 462. The electrode section 444 is rotatably coupled to the drive end 464 via a bearing (not shown) at the center portion thereof. Three or more of rotation-prevention mechanisms, as with the above-described construction shown in FIG. 7, are provided in the circumferential direction between the electrode section 444 and the hollow motor 460.

Further, as shown in FIG. 42, a pure water supply pipe 482 as a pure water supply section for supplying pure water or ultrapure water is disposed in the hollow portion of the hollow motor 460. Pure water or ultrapure water is supplied from the pure water supply pipe 482, via the through-hole (not shown) formed in the central portion of the electrode section 444, to the upper surface of the electrode section 444.

Figure 43:
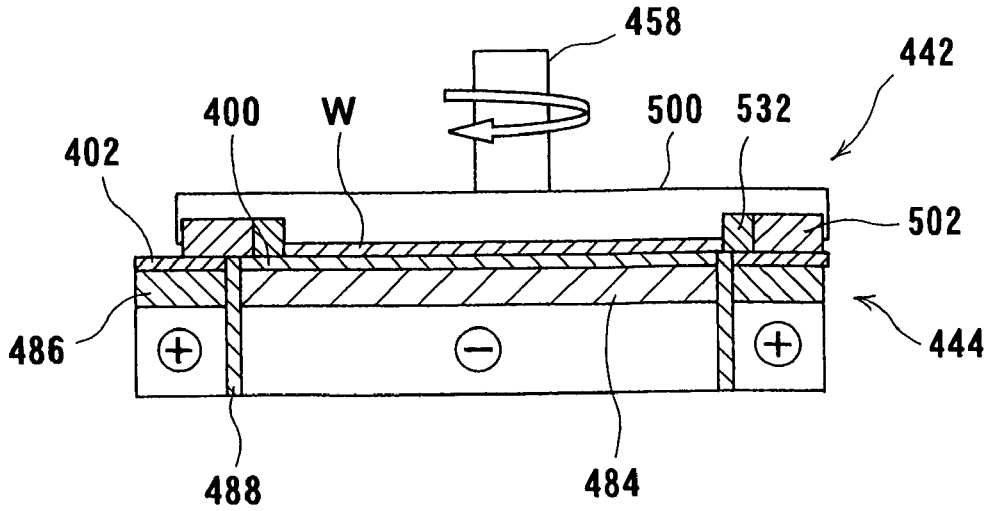
FIG. 43 is a vertical sectional view schematically showing the substrate holder and the electrode section of the electrolytic processing apparatus of FIG. 42.

FIG. 43 is a vertical sectional view schematically showing the substrate holder 442 and the electrode section 444. As shown in FIG. 43, the electrode section 444 includes a disc-shaped processing electrode 484, a ring-shaped feeding electrode 486 that surrounds the circumference of the processing electrode 484, and a ring-shaped insulator 488 that separates the processing electrode 484 from the feeding electrode 486. The upper surface of the processing electrode 484 is covered with an ion exchanger 400 and the upper surface of the feeding electrode 486 is covered with an ion exchanger 402, and these ion exchangers 400, 402 are separated from each other by the insulator 488.

According to this embodiment, the processing electrode 484 is connected to the cathode of a power source 446, and the feeding electrode 486 is connected to the cathode. Depending upon the material to the processed, as described above, the electrode connected to the cathode of the power source 446 may serve as a feeding electrode and the electrode connected to the anode may serve as a processing electrode.

Figure 44:
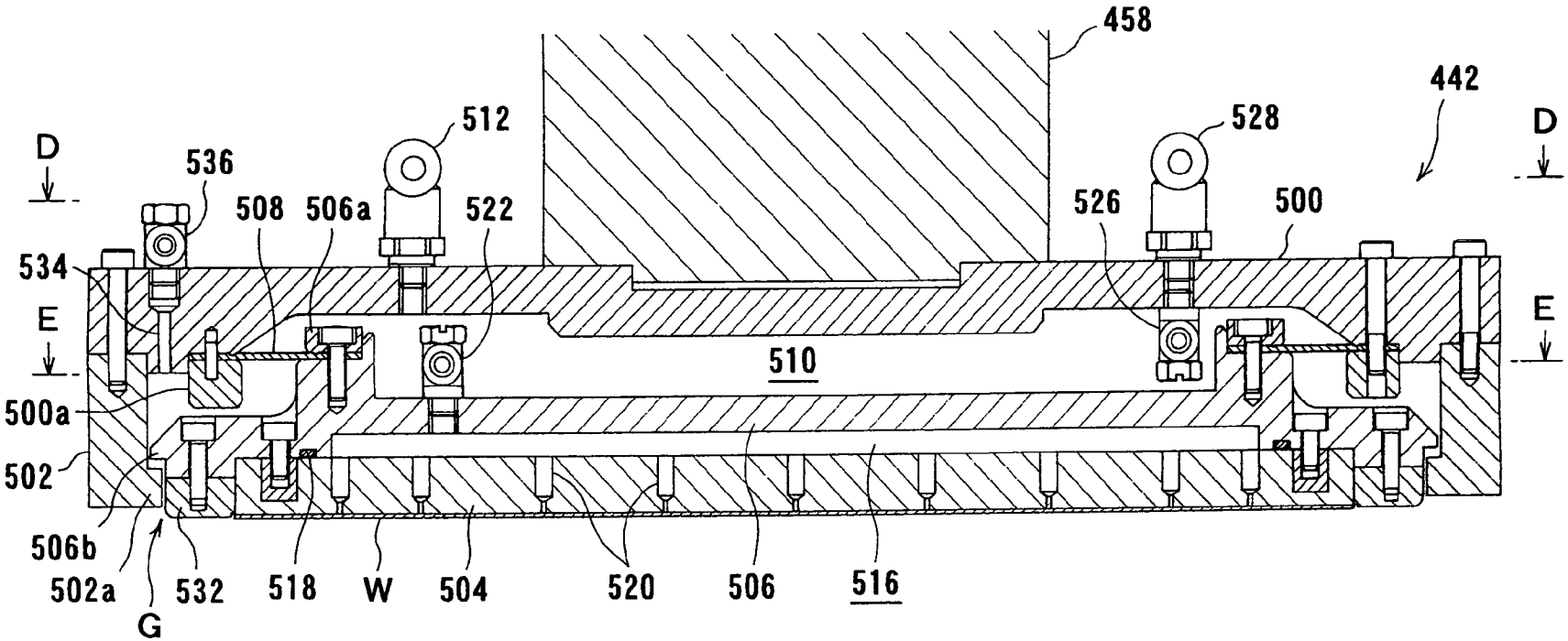
FIG. 44 is a vertical sectional view showing the details of the substrate holder of the electrolytic processing apparatus of FIG. 42.
Figure 45:
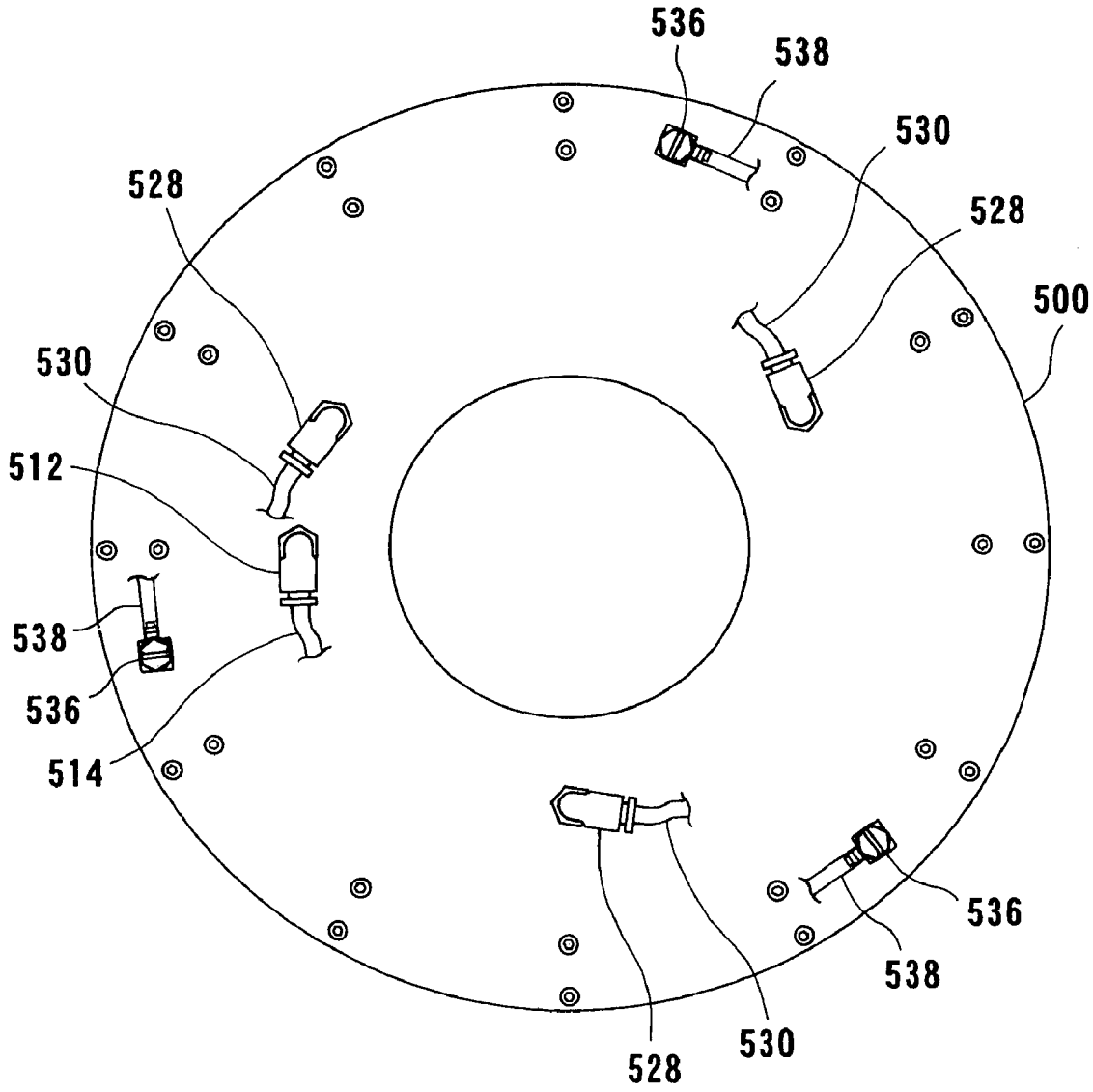
FIG. 45 is a sectional view taken along the line D-D of FIG. 44.
Figure 46:
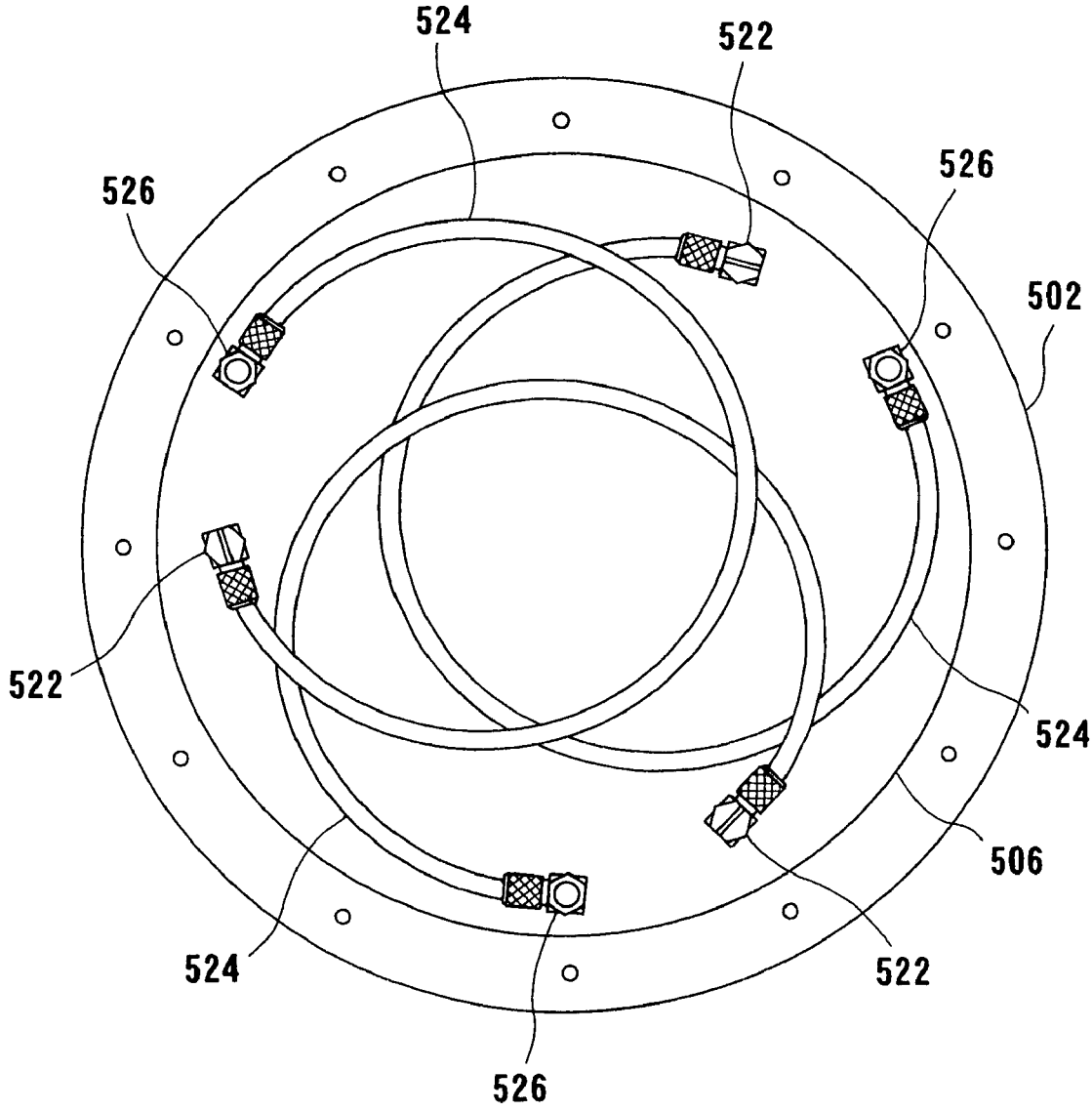
FIG. 46 is a sectional view taken along the line E-E of FIG. 44.

FIG. 44 is a vertical sectional view showing the details of the substrate holder 442, FIG. 45 is a sectional view taken along the line D-D of FIG. 44, and FIG. 46 is a sectional view taken along the line E-E of FIG. 44. As shown in FIG. 44, the substrate holder 442 includes a generally disc-shaped flange portion 500 fixed by not-shown bolts to the lower end of the shaft 458, and a retainer ring 502 disposed at the periphery of the flange portion 500. In the space defined by the flange portion 500 and the retainer ring 502, there are housed a generally disc-shaped chucking plate 504 that contacts a semiconductor substrate W to be held by the substrate holder 442, and a generally disc-shaped stopper plate 506 disposed above the chucking plate 504. The chucking plate 504 and the stopper plate 506 constitutes a chucking member for holding the substrate W.

The chucking member (chucking plate 504 and stopper plate 506) is preferably formed of a resin. The chucking member, when formed of a lightweight resin, can lighten its own weight applied to the substrate whereby the processing can be carried out under a low load, which makes it possible to process the substrate without destroying a fragile material. A polyphenylene sulfide (PPS) resin, for example, may be used to this resin. The chucking member may be formed not of a resin, but a ceramic plate, such as an alumina ceramic.

As shown in FIG. 44, a pressure sheet 508 (elastic member), composed of an elastic film, is stretched between the flange portion 500 and the stopper plate 506. The pressure sheet 508 is held at its one end by a holder ring 500*a* mounted to the lower surface of the flange portion 500, and held at the other end by a holder ring 506*a* mounted to the stopper plate 506. The flange portion 500, the stopper plate 506 and the pressure sheet 508 define a first pressure chamber 510 inside the flange portion 500. The pressure sheet 508 is formed of a rubber material having excellent strength and durability, such as ethylene-propylene rubber (EPDM), polyurethane rubber or silicone rubber.

As shown in FIGS. 44 and 45, a connector 512, communicating with the first pressure chamber 510, is provided in the upper surface of the flange portion 500. A fluid can be supplied through a tube 514 (see FIG. 45), extending from the connector 512, into the first pressure chamber 510 to thereby pressurize the first pressure chamber 510, or the fluid can be drawn through the tube 514 out of the first pressure chamber 510 to thereby depressurize the first pressure chamber 510. Accordingly, the substrate W as a workpiece can contact the ion exchangers 400, 402 at a desired pressure as provided by the fluid supplied to the first pressure chamber 510.

Further, a second pressure chamber 516 is formed between the chucking plate 504 and the stopper plate 506. An O-ring 518 is disposed between the chucking plate 504 and the stopper plate 518, and the second pressure chamber 516 is sealed with the O-ring 518. A plurality of through-holes 520, communicating with the second pressure chamber 516 and opening to the lower surface of the chucking plate 504, are formed in the chucking plate 504.

Further, as shown in FIGS. 44 and 46, connectors 522, communicating with the second pressure chamber 516, are provided in the upper surface of the stopper plate 506, and connectors 526, connected to tubes 524 extending from the connector 522, are provided in the lower surface of the flange portion 500. The connectors 526 communicate with connectors 528 provided in the upper surface of the flange portion 500. A fluid can be supplied through tubes 530 (see FIG. 45), extending from the connector 528, into the second pressure chamber 516 to thereby pressurize the second pressure chamber 516, or the fluid can be drawn through the tubes 530 out of the second pressure chamber 516 to thereby depressurize the second pressure chamber 516. Thus, it is possible to attract by vacuum the upper surface of the semiconductor substrate W to the lower surface of the chucking plate 504 or supply the pressurized fluid to the upper surface of the substrate W. The pressure in the second pressure chamber 516 can be controlled independent of the first pressure chamber 510.

As shown in FIG. 44, a guide ring 532, which is to be positioned on the outer side of the substrate W, is mounted to the lower surface of the peripheral portion of the stopper plate 506. According to this embodiment, when rotating the substrate W and, at the same time, allowing the electrode section 444 to make a scroll movement while allowing the substrate W to be in contact with the ion exchangers 400, 402, part of the guide ring 532 is always positioned above the feeding electrode 486 and the processing electrode 484. The guide ring 532 is formed of, for example, a polycarbonate resin or a polychlorotrifluoroethylene (PCTFE) resin. The substrate W is held in the depression defined by the guide ring 532 and the chucking plate 504, whereby a lateral displacement of the substrate W is restricted.

Further, as shown in FIG. 44, cleaning liquid passages 534 are formed in the peripheral portion of the flange portion 500. The cleaning liquid passages 534 communicate with a slight gap G between the outer circumferential surface of the guide ring 532 and the inner circumferential surface of the retainer ring 502. Connectors 536, communicating with the cleaning liquid passages 534, are provided in the upper surface of the flange portion 500. A cleaning liquid (pure water) can be supplied through tubes 538 (see FIG. 45), extending from the connectors 536, into the cleaning liquid passages 534 and further into the gap G.

Figure 47:
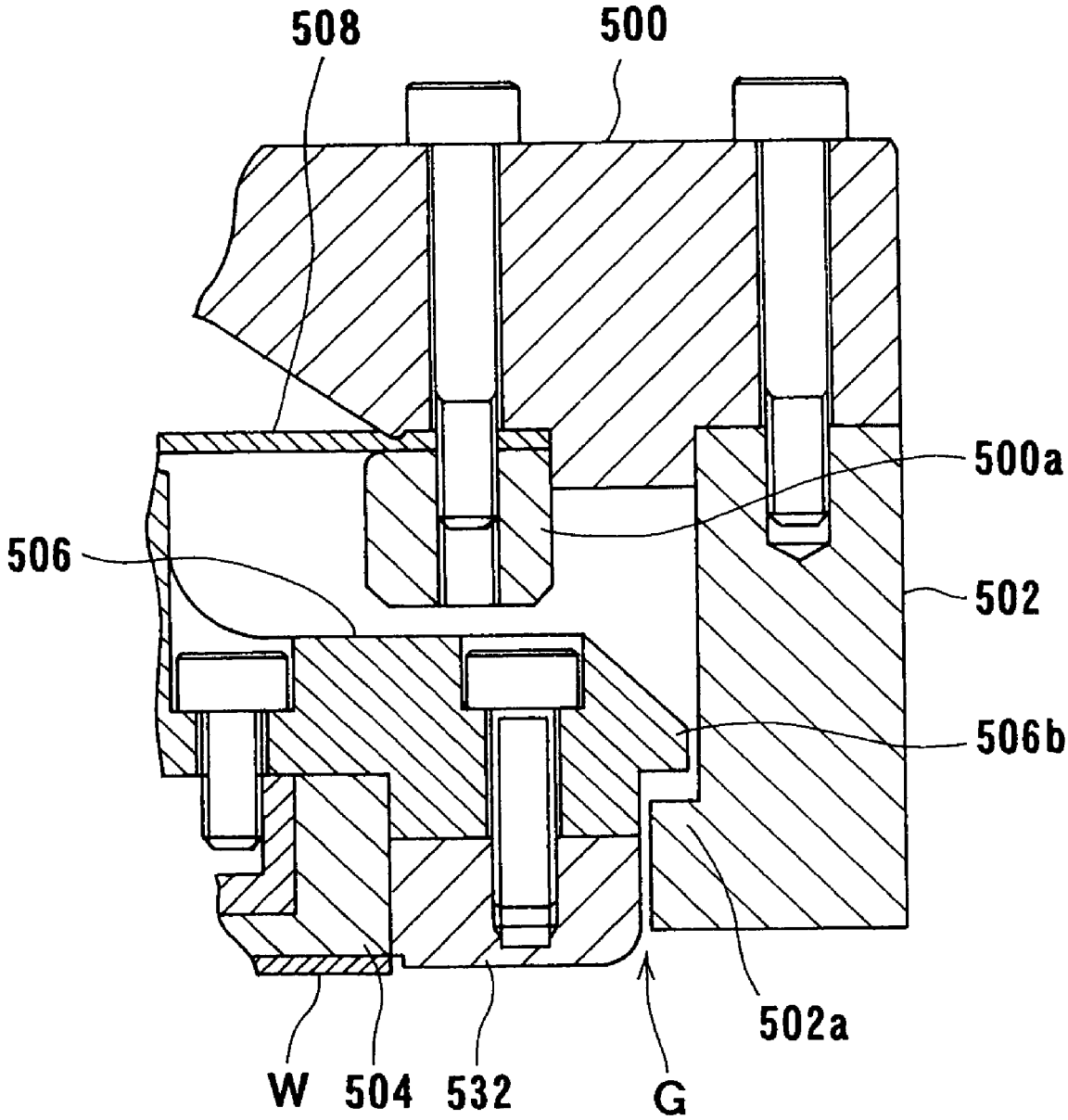
FIG. 47 is an enlarged view of a portion of FIG. 44.

Owing to the slight gap G between the outer circumferential surface of the guide ring 532 and the inner circumferential surface of the retainer ring 502, the chucking member, comprising the stopper plate 506, the guide ring 532 and the chucking plate 504, can move vertically or float with respect to the flange portion 500 and the retainer ring 502. Thus, the chucking member can move in the axial direction (vertical direction) of the shaft 458 with respect to the flange portion 500 fixed to the shaft 458, that is, the chucking member can be in a floating state. As shown in FIG. 47, an inward-protruding portion 502*a* is provided in the lower portion of the retainer ring 502, while a plurality of outward-protruding protrusions 506*b* are provided in the stopper plate 506. By the engagement of the protrusions 506*b* of the stopper plate 506 with the upper surface of the protruding portion 502*a* of the retainer ring 502, the downward movement of the chucking member, comprising the stopper plate 506, etc., is restricted to a certain position. During non-electrolytic processing (polishing) time, the chucking member, comprising the stopper plate 506, the guide ring 532 and the chucking plate 504, is supported by the protruding portion 502*a* of the retainer ring 502.

Processing (electrolytic processing) of a substrate by the substrate processing apparatus of this embodiment will now be described. First, a substrate W, having e.g. a copper film 6 as a conductive film (to-be-processed portion) in the surface as shown in FIG. 1B, is transferred to the electrolytic processing apparatus 434, where the substrate W is attracted and held by the substrate holder 442 such that the surface of the substrate W in which the conductive film (copper film 6) is formed faces downward. Thus, a fluid is drawn from the second pressure chamber 516 in the substrate holder 442, thereby attracting the substrate W to the lower surface of the chucking plate 504 by vacuum suction through the through-holes 520. Thereafter, the arm 440 is moved to move the substrate holder 442 holding the substrate W to a processing position right above the electrode section 444. Next, the vertical-movement motor 454 is driven to lower the substrate holder 442 so as to bring the substrate W held by the substrate holder 442 into contact with the surface of the ion exchangers 400, 402 of the electrode section 444. In this case, positioning of the substrate holder 442 is effected upon contact of the substrate W with the ion exchangers 400, 402 (or immediately before the contact). In this state, the substrate-rotating motor 456 (first drive section) is driven to rotate the substrate W and, at the same, the hollow motor 460 (second drive section) is driven to allow the electrode section 444 to make a scroll movement, while pure water or ultrapure water is supplied from the through-holes of the electrode section 444 to between the substrate W and the ion exchangers 400, 402.

A given voltage is applied from the power source 446 to between the processing electrode 484 and the feeding electrode 486, and electrolytic processing of the conductive film (copper film 6) in the surface of the substrate W is carried out at the processing electrode (cathode) 484 through the action of hydrogen ions and hydroxide ions produced by the ion exchangers 400, 402. Though the processing progresses only in the portion of the substrate W facing the processing electrode 484, the relative movement between the substrate W and the processing electrode 484 makes it possible to process the entire surface of the substrate W. Upon the processing, a fluid is supplied into the first pressure chamber 510 to press the substrate W against the ion exchangers 400, 402 at a desired pressure. Thus, in carrying out electrolytic processing of the semiconductor substrate W, the force applied from the ion exchangers 400, 402 to the semiconductor substrate W is properly adjusted by the fluid supplied to the first pressure chamber 510. The electrolytic processing is usually carried out while attracting the substrate W to the lower surface of the chucking plate 504 by drawing a fluid from the second pressure chamber 516. It is, however, possible to carry out the electrolytic processing while applying a back pressure to the substrate W by supplying the fluid to the second pressure chamber 516.

As described above, during the processing, the stopper plate 506 does not engage with the retainer ring 502 and can move independent of the flange portion 500 and the retainer ring 502, and can therefore float. Thus, owing to the flexibility of the pressure sheet 508 and to the slight gap G between the inner circumferential surface of retainer ring 502 and the outer circumferential surface of the guide ring 532, the chucking plate 504, holding the substrate W, can move vertically with a certain degree of freedom.

During the processing, the guide ring 532 is positioned on the outer side of the substrate W. If the guide ring 532, at least its surface portion, is formed of an electrically conductive material, the area of conductive material will be expanded. This can prevent concentration of the current density in the edge portion of the substrate W and equalize the current density over the entire surface of the substrate, making it possible to equalize the processing rate over the entire surface of the substrate W and carry out a uniform processing stably. As a material for the conductive portion of such a guide ring 532, it is possible to use, besides the common metals and metal compounds, carbon, relatively inactive noble metals, conductive oxides or conductive ceramics. Electrochemically inactive materials are preferred. When an electrochemically inactive material is employed for the guide ring 532, the guide ring 532 is not processed, and therefore the life of the guide ring 532 can be prolonged. It is also possible to use as the guide ring 532 an insulating member, e.g. of a resin, coated with a conductive material, for example, a substrate whose surface is covered with a hardly oxidizable material such as platinum or with a conductive oxide such as iridium oxide. Such a guide ring 532 can be produced by attaching platinum or iridium to the surface of e.g. a titanium substrate by coating or plating, and then carrying out sintering at a high temperature to stabilize and strengthen the product. Ceramics, in general, are obtained by heat treatment of an inorganic starting material, and ceramics with a variety of properties are now commercially produced using various materials including oxides, carbides and nitrides of metals and nonmetals, among which are ceramics having an electric conductivity.

As with the above-described embodiments, during the electrolytic processing, the voltage applied between the processing electrode 484 and the feeding electrode 486, or the electric current flowing therebetween is monitored by the monitor 38 (see FIG. 4).

After completion of the electrolytic processing, the power source 446 is disconnected, and the rotation of the substrate holder 442 and the scroll movement of the electrode section 444 are stopped. Thereafter, the substrate holder 442 is raised, and the arm 440 is moved to transfer the substrate W to the transfer robot 36 (see FIG. 4). When transferring the substrate W to the transfer robot 36, a fluid (e.g. a mixture of compressed air or nitrogen and pure water) is supplied to the second pressure chamber 516, and the fluid is jetted from the through-holes 520 of the chucking plate 504 to release the semiconductor substrate W.

As described above, pure water or ultrapure water is supplied between the substrate W and the ion exchangers 400, 402 during the electrolytic processing, instead of pure water or ultrapure water, it is possible to use a liquid having an electric conductivity of not more than 500 μS/cm, an electrolysis solution obtained by adding an electrolyte to pure water or ultrapure water, or a liquid obtained by adding a surfactant, etc. to pure water or ultrapure water.

As also described above, the ion exchangers 400, 402 of the electrode section 444 are formed of e.g. a nonwoven fabric having an anion exchange group or a cation exchange group, and the use of ion exchangers 400, 402 having excellent water permeability is preferred.

According to the electrolytic processing apparatus of this embodiment, the load on a substrate during electrolytic processing can be reduced. Thus, when the substrate holder 442 is lowered so that the substrate W comes into contact with the ion exchangers 400, 402, the load applied to the substrate W during processing is the sum of the own weight of the chucking member (chucking plate 504, stopper plate 506 and guide ring 532) and the load of pressure of the fluid supplied to the first pressure chamber 510. Accordingly, by adjusting the pressure of the fluid supplied to the first pressure chamber 510, a pressure at which the substrate contacts the processing electrode 484 can be controlled with high precision. It is therefore possible to control the surface pressure between the substrate W and the processing electrode 484 so that it is lower than a pressure at which a semiconductor device can be destroyed, making it possible to process the substrate without destroying a fragile material.

Further, according to the electrolytic processing apparatus of this embodiment, since a mechanical polishing action is not involved, a strong pressing by the substrate W as in CMP is not necessary. In the case where a fragile material is used as the interconnect material of the substrate W, it is preferred to adjust the pressure of the fluid supplied to the first pressure chamber 510 so that the pressure applied to the substrate W from the processing electrode 484 or the ion exchangers 400, 402 becomes not more than 19.6 kPa (200 gf/cm$^2$), more preferably not more than 6.86 kPa (70 gf/cm$^2$), most preferably not more than 686 Pa (7 gf/cm$^2$, 0.1 psi), and carry out processing of the substrate W under such a low load.

Though in this embodiment the substrate W is attracted directly to the lower surface of the chucking plate 504, it is possible to interpose a backing sheet between the chucking plate 504 and the substrate W, and hold the substrate W on the backing sheet. Further, the substrate holder 442 of the electrolytic processing apparatus of this embodiment is not limited to application to electrolytic processing using pure water or ultrapure water, but also applicable to electrolytic processing using an electrolysis solution as a processing liquid. In the case of using an electrolysis solution as a processing liquid, it is preferred to provide, not an ion exchange, but a sponge-like water-permeable member for removing metal ions that have been dissolved out of the substrate surface.

Figure 48:
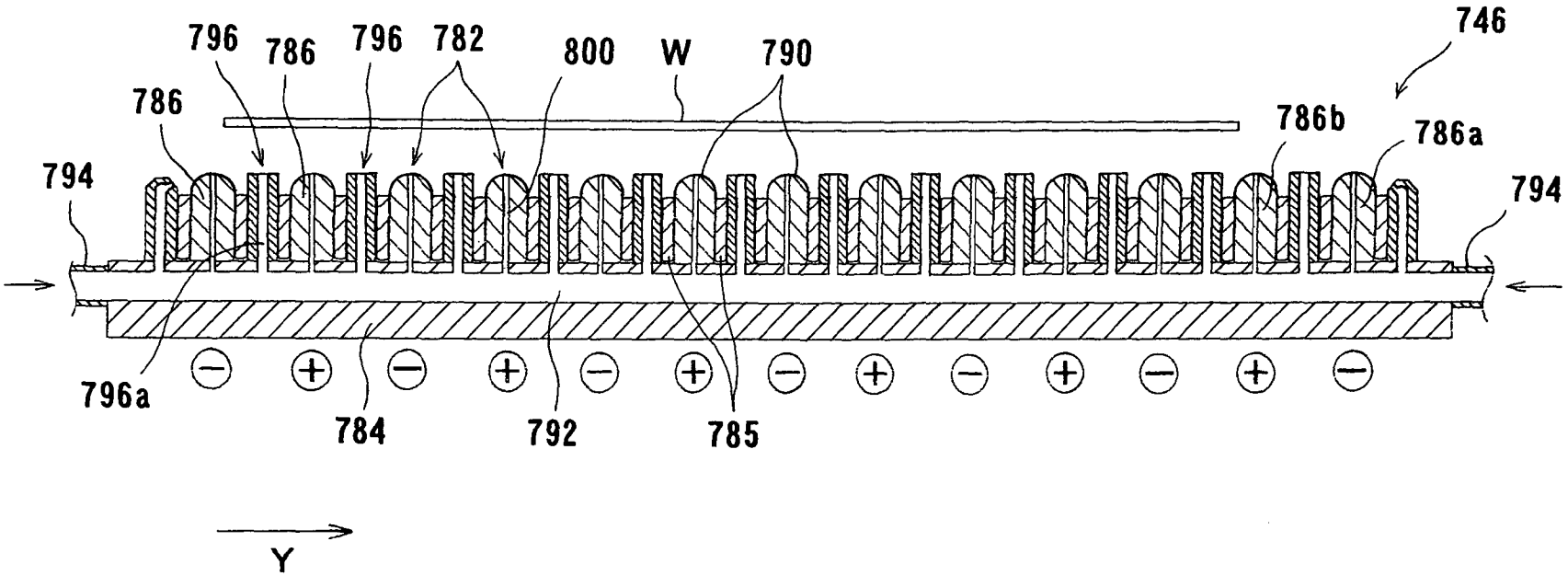
FIG. 48 is a vertical sectional view showing the electrode section of an electrolytic processing apparatus according to still another embodiment.

FIG. 48 is a cross-sectional view of the electrode section of an electrolytic processing apparatus according to still another embodiment of the present invention. As shown in FIG. 48, the electrode section 746 of this embodiment, as with the above-described embodiment shown in FIGS. 5 through 10, includes a plurality of rectangular linearly-extending electrode members 782 which are disposed in parallel at an even pitch on a tabular base 784.

Each electrode member 782 comprises an electrode 786 to be connected to a power source, and an ion exchanger (ion exchange membrane) 790 covering the surface of the electrode 786 integrally. The ion exchanger 790 is mounted to the electrode 786 by means of holding plates 785 disposed on both sides of the electrode 786. As with the above-described embodiment, the ion exchanger 790 is composed of, for example, a nonwoven fabric having an anion exchange group or a cation exchange group.

According to this embodiment, the electrodes 786 of adjacent electrode members 782 are connected alternately to the cathode and to the anode of the power source. For example, an electrode (processing electrode) **786*a* is connected to the cathode of the power source and an electrode (feeding electrode) 786*b* is connected to the anode. As described above, when processing copper, for example, the electrolytic processing action occurs on the cathode side, and therefore the electrode 786 connected to the cathode becomes a processing electrode 786*a*, and the electrode 786 connected to the anode becomes a feeding electrode 786*b*. Thus, according to this embodiment, the processing electrodes 786***a* and the feeding electrodes 786*b* are disposed in parallel and alternately.

A flow passage 792 for supplying pure water, more preferably ultrapure water, to the to-be-plated surface is formed in the interior of the base 784 of the electrode section 746, and the flow passage 792 is connected to a pure water supply source (not shown) via a pure water supply pipe 794. On both sides of each electrode member 782, contact members 796 are provided that contact the surface of the substrate W. Through-holes 796*a*, communicating with the flow passage 792, are formed in the interior of each contact member 796, and pure water or ultrapure water is supplied through the through-holes 796*a* to between the substrate W and the ion exchangers 790 of the electrode members 782.

Figure 49A:
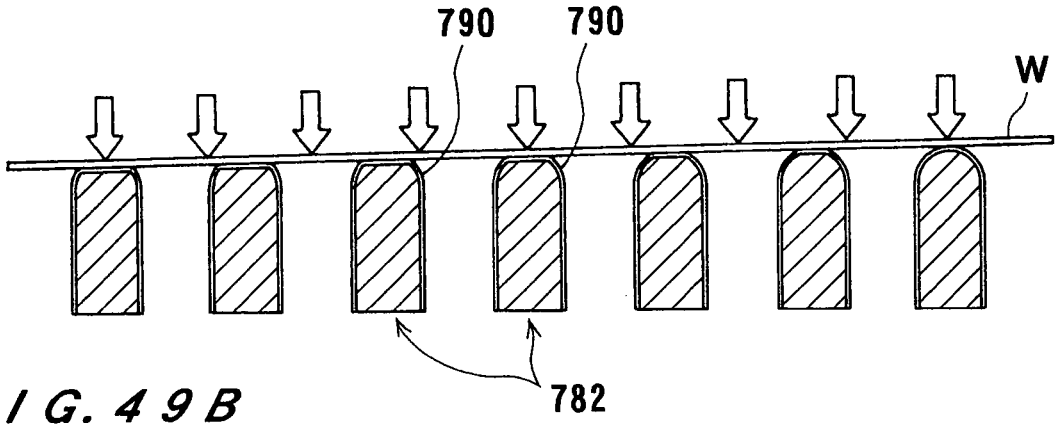
FIG. 49A is a schematic diagram illustrating the operation of an electrolytic processing apparatus in the case of not providing a contact member.

It is ideal that the substrate W contacts the ion exchangers 790 uniformly over all of the electrode members 782. With the substrate holder 442 of the above-described embodiment shown in FIGS. 42 through 47, because a gimbal mechanism is constructed by the elastic member linking the flange portion and the chucking member, a substrate W can follow the surface of an electrode and contact the electrode (ion exchanger) uniformly. However, in cases where ion exchangers, having an elasticity, are disposed in parallel as in this embodiment, since the ion exchangers do not have such an elasticity as a polishing surface as employed in CMP, the substrate W could tilt due to a relative movement between the electrode members 782 and the substrate W, the supply of pure water, etc., leading to a failure in making a uniform contact with the ion exchangers 790, as shown in FIG. 49A. Especially, according to the substrate holder 442 of the embodiment shown in FIGS. 42 through 47, contact between the whole substrate surface and the electrode is controlled by adjusting the pressure of the fluid supplied to the first pressure chamber 510. Accordingly, in the case where a plurality of electrodes (ion exchangers) is disposed, it is difficult with the substrate holder 442 to effect such a control that the substrate W contacts all the electrodes (ion exchangers) uniformly.

Figure 49B:
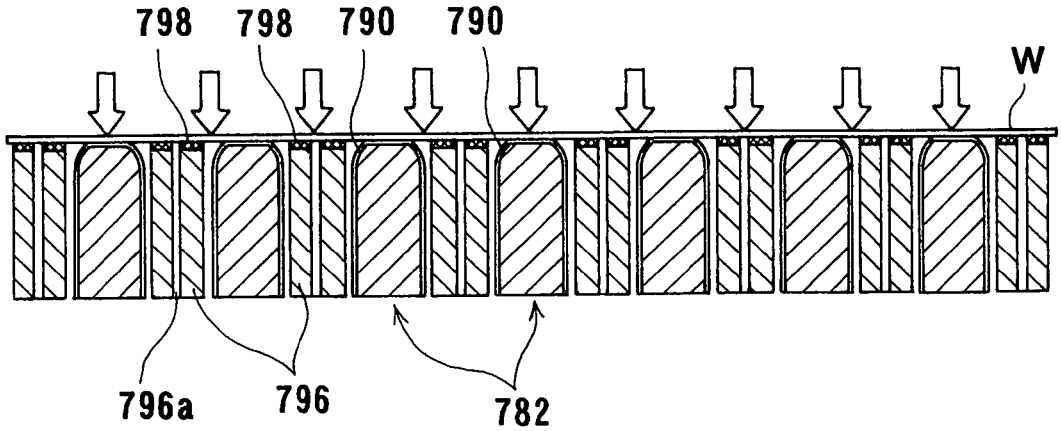
FIG. 49B is a schematic diagram illustrating the operation of an electrolytic processing apparatus in the case of providing a contact member.

In view of the above, according to this embodiment, the contact members 796 are provided on both sides of each electrode member 782. The height of each contact member 796 is set so that it is slightly lower than the height of the ion exchanger 790 of each electrode member 782. Accordingly, when the substrate W is brought into contact with the ion exchangers 790 of the electrode members 782, the surface of the substrate W comes to be supported by the contact members 796. Thus, as shown in FIG. 49B, after pressing the substrate W against the ion exchangers 790 to a certain extent, the substrate W comes into contact with the upper surfaces of the contact members 796. Accordingly, if it is attempted to further press the substrate W against the ion exchangers 790, the pressing force is received by the contact members 796, and therefore the contact area between the substrate W and the ion exchangers 790 does not change. Thus, according to this embodiment, the substrate W can be prevented from tilting, and the contact area can be kept constant, whereby a uniform processing can be effected.

As shown in FIG. 49B, it is preferred to mount on the upper surface of each contact member 796 a buffer member 798 formed of a material having such an elasticity as not to damage the surface of the substrate W. POLYTEX pad (trademark, Rodel, Inc.), for example, may be used as such a buffer member 798.

In the interior of the electrode 786 of each electrode member 782, through-holes 800 are formed that reach from the flow passage 792 to the ion exchanger 790. The pure water or ultrapure water in the flow passage 792 is supplied through the through-holes 800 to the ion exchangers 790.

This embodiment is not limited to electrolytic processing using an ion exchanger. When using, for example, an electrolysis solution as a processing liquid, a processing member to be mounted on the surfaces of the electrodes is not limited to an ion exchanger, but a soft polishing pad or nonwoven fabric, or the like may also be used. Also in that case, the above-described contact member and substrate holder are useful in obtaining a good processing performance.

According to the electrolytic processing apparatus with such a construction, as with the above-described embodiments, the substrate W held by the substrate holder 742 is allowed to be in contact with the surface of the ion exchangers 790 of the electrode section 746, while the electrode section 746 is allowed to make a scroll movement. At this time, pure water or ultrapure water is supplied from the through-holes 796*a* of the contact members 796 to between the substrate W and the electrode members 782, while pure water or ultrapure water is passed through the through-holes 800 of the electrode section 746 to the ion exchangers 790, thereby impregnating the ion exchangers 790 with pure water or ultrapure water. According to this embodiment, the pure water or ultrapure water supplied to the ion exchangers 790 is discharged from the ends in the long direction of each electrode member 782. A given voltage is applied from the power source to between the processing electrodes 786*a* and the feeding electrodes 786*b*, and electrolytic processing of the conductive film in the surface of the substrate W is carried out at the processing electrodes (cathodes) 786*a* through the action of hydrogen ions and hydroxide ions produced by the ion exchanger 790.

Figure 50:
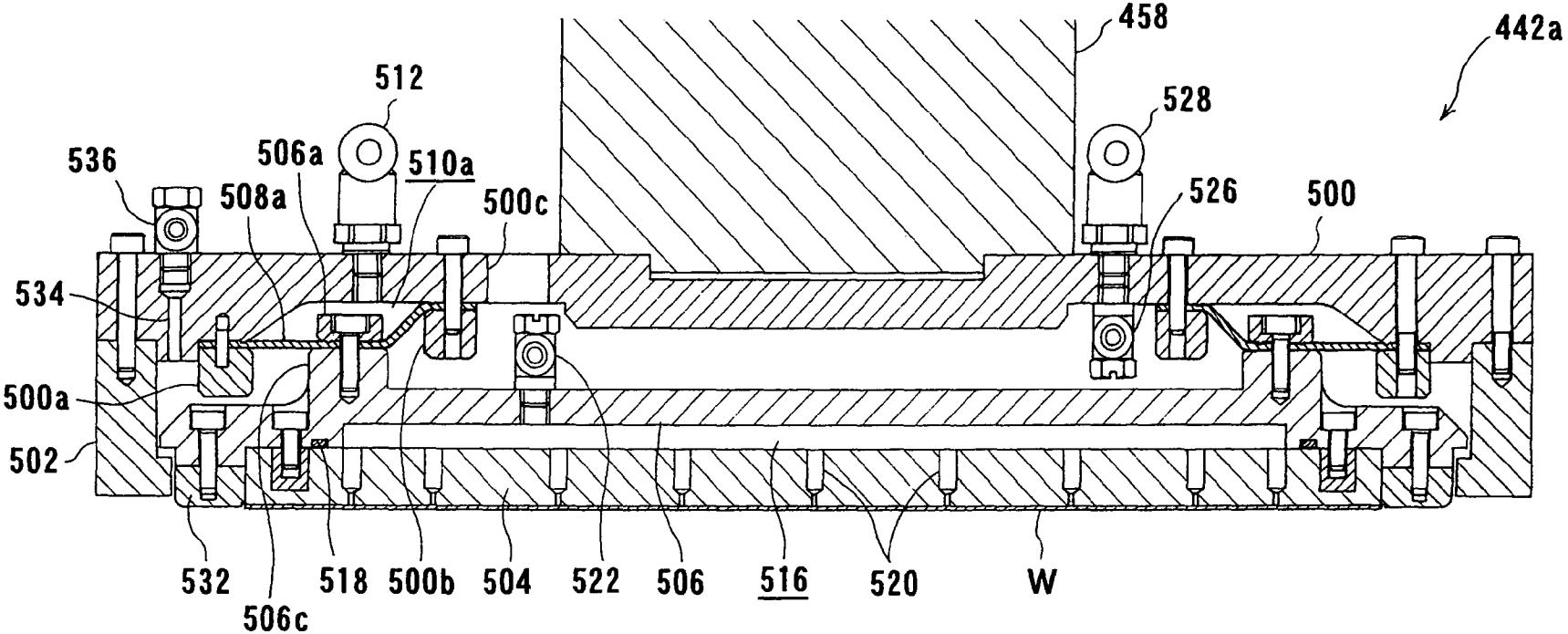
FIG. 50 is a vertical sectional view showing the substrate holder of an electrolytic processing apparatus according to still another embodiment of the present invention.
Figure 51:
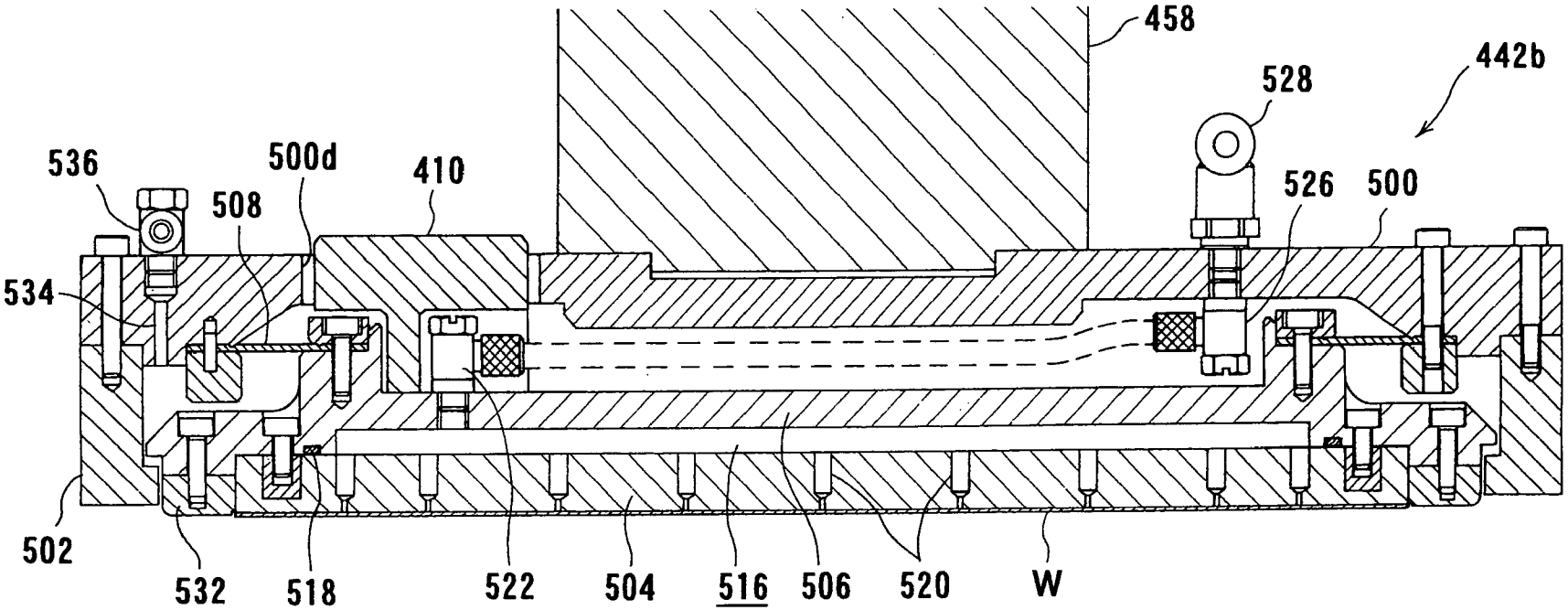
FIG. 51 is a vertical sectional view showing the substrate holder of an electrolytic processing apparatus according to still another embodiment of the present invention.
Figure 52:
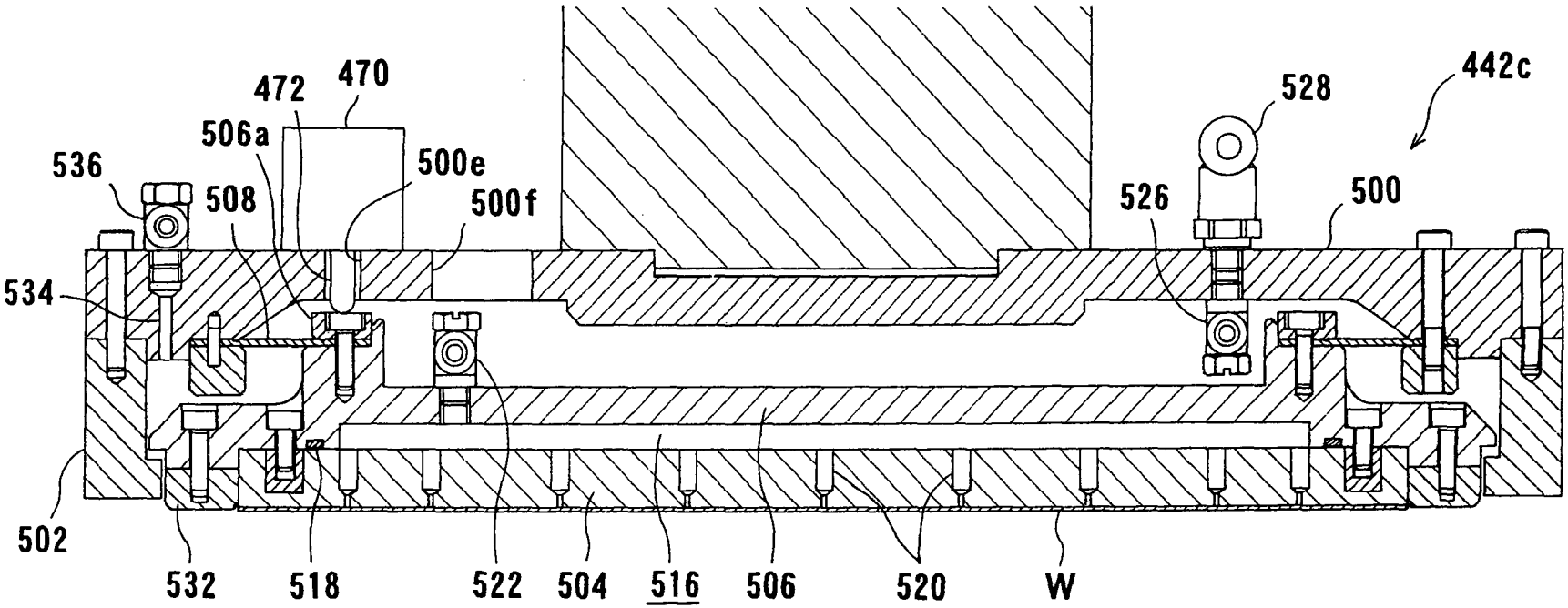
FIG. 52 is a vertical sectional view showing the substrate holder of an electrolytic processing apparatus according to still another embodiment of the present invention.

In the case of using the electrode section 746 having the plurality of electrode members 782 disposed in parallel, the whole surface of the substrate W does not contact the electrodes 786 (ion exchangers 400, 402), that is, the contact area is relatively small. Accordingly, as compared to the case where the contact is made over the whole surface of the substrate W, the surface pressure applied to the substrate W should necessarily be higher, whereby, in some cases, ideal processing conditions cannot be realized. A substrate holder for solving such a problem will be described below with reference to FIGS. 50 through 52. In FIGS. 50 through 52, the same members or elements as in the embodiment shown in FIGS. 42 through 47, having the same operation or function, are given the same reference numerals, and the description thereof is partly omitted.

FIG. 50 is a vertical sectional view showing a substrate holder according to still another embodiment of the present invention. According to the substrate holder 442*a* shown in FIG. 50, the pressure sheet 508*a* (elastic member) is held by the holder rings 500*a*, 500*b* mounted to the lower surface of the flange portion 500, and is mounted at the middle portion to the stopper plate 506 by the holder ring 506*a*. Thus, according to this embodiment, a first pressure chamber 510*a* is formed between the flange portion 500 and the pressure sheet 508*a*. An air vent 500*c* is formed in the upper surface of the flange portion 500, so that the space above the stopper plate 506 is open to atmospheric pressure.

As with the above-described embodiment, the first pressure chamber 510*a* communicates with the connector 512, so that a fluid can be supplied through the connector 512 into the first pressure chamber 510*a* to pressurize the first pressure chamber 510*a*. According to this embodiment, the pressure of the fluid supplied to the first pressure chamber 510*a* is applied only on the upper surface of the holder ring support portion 506*c* (see FIG. 50). The pressing area is thus smaller as compared to the substrate holder shown in FIG. 40. This makes it possible to lower the surface pressure applied to the substrate W and effect a low-load pressing.

FIG. 51 is a vertical sectional view showing a substrate holder according to still another embodiment of the present invention. According to the substrate holder 442*b* shown in FIG. 51, a weight 410 of a predetermined weight is mounted on the upper surface of the stopper plate 506. The weight 410 is disposed in an opening 500*d* formed in the upper surface of the flange portion 500, and moves vertically together with the chucking member (chucking plate 504 and stopper plate 506). According to this embodiment, no pressure chamber is formed between the flange portion 500 and the stopper plate 506, and the space above the stopper plate 506 is open to atmospheric pressure.

According to the substrate holder of such a construction, the surface pressure applied to the substrate W can be adjusted by mounting the weight 410 of an appropriate weight to the chucking member. Thus, the surface pressure applied to the substrate W can be made low with such a simple structure, enabling a low-load processing.

FIG. 52 is a vertical sectional view showing a substrate holder according to still another embodiment of the present invention. According to the substrate holder 442*c* shown in FIG. 52, an air cylinder 470 for pressing the chucking member (chucking plate 504 and stopper plate 506) is mounted in the upper surface of the flange portion 500. The rod 472 of the air cylinder 470 is inserted into a rod hole 500*e* formed in the flange portion 500, and the end of the rod 472 contacts the holder ring 506*a* of the stopper plate 506. Accordingly, by the actuation of the air cylinder 470, the rod 472 presses the stopper plate 506 to thereby move the chucking member vertically. According to this embodiment, there is formed no pressure chamber between the flange portion 500 and the stopper plate 506, and the space above the stopper plate 506 is open to atmospheric pressure.

According to the substrate holder 442*c* of such a construction, the force pressing the chucking member downward, i.e. the surface pressure applied to the substrate W, can be adjusted by appropriately controlling the air cylinder 470. This makes it possible to make the surface pressure applied to the substrate low and effect a low-load pressing. Further, when a need arises to alter the processing parameters, etc., it is necessary with the embodiment shown in FIG. 51 to change the weight of the weight 410 to deal with the case. According to this embodiment, on the other hand, the case can be dealt with by simply regulating the pressing force of the air cylinder 470.

Figure 53:
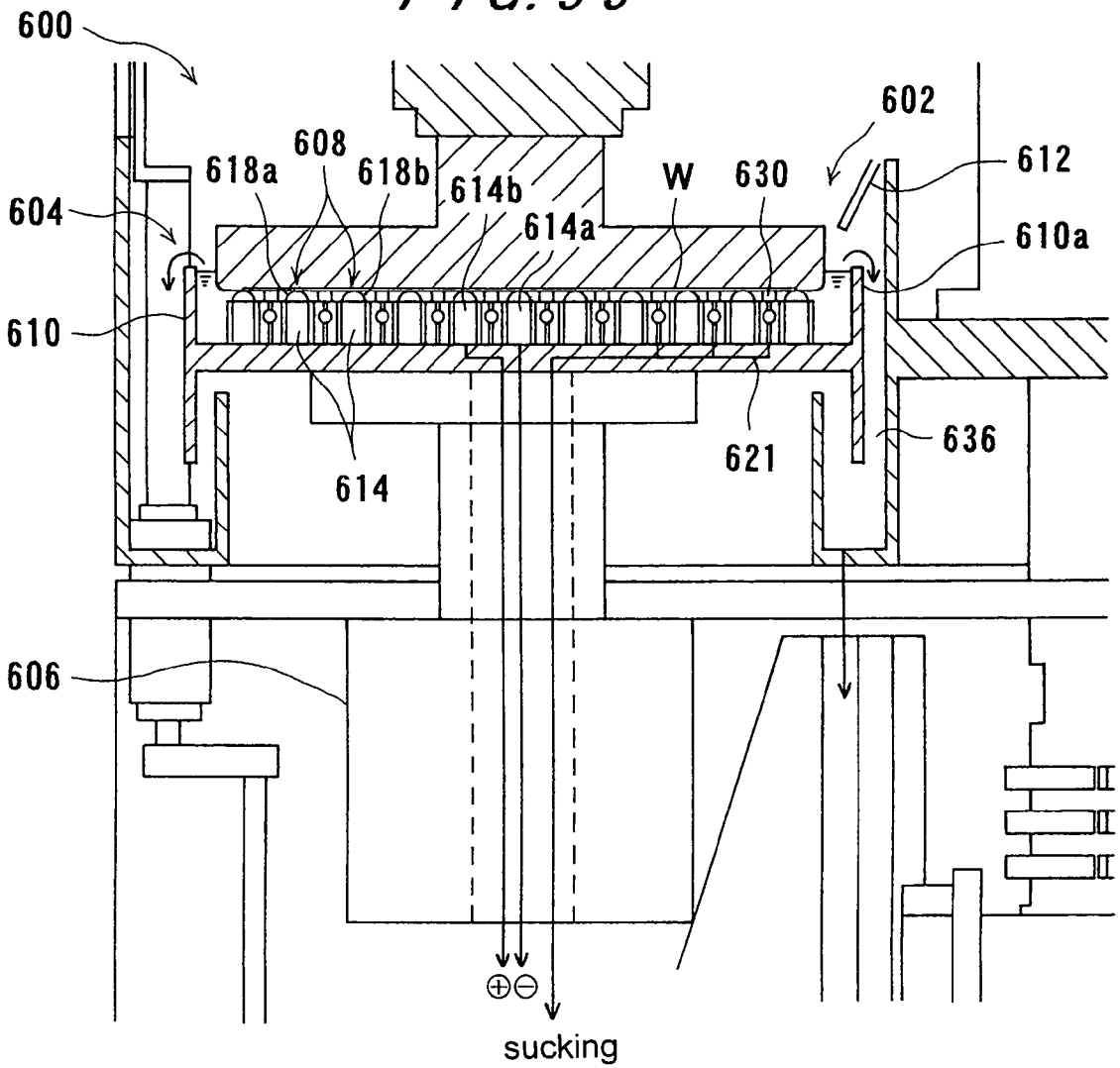
FIG. 53 is a vertical sectional view showing the main portion of an electrolytic processing apparatus according to still another embodiment of the present invention.
Figure 54:
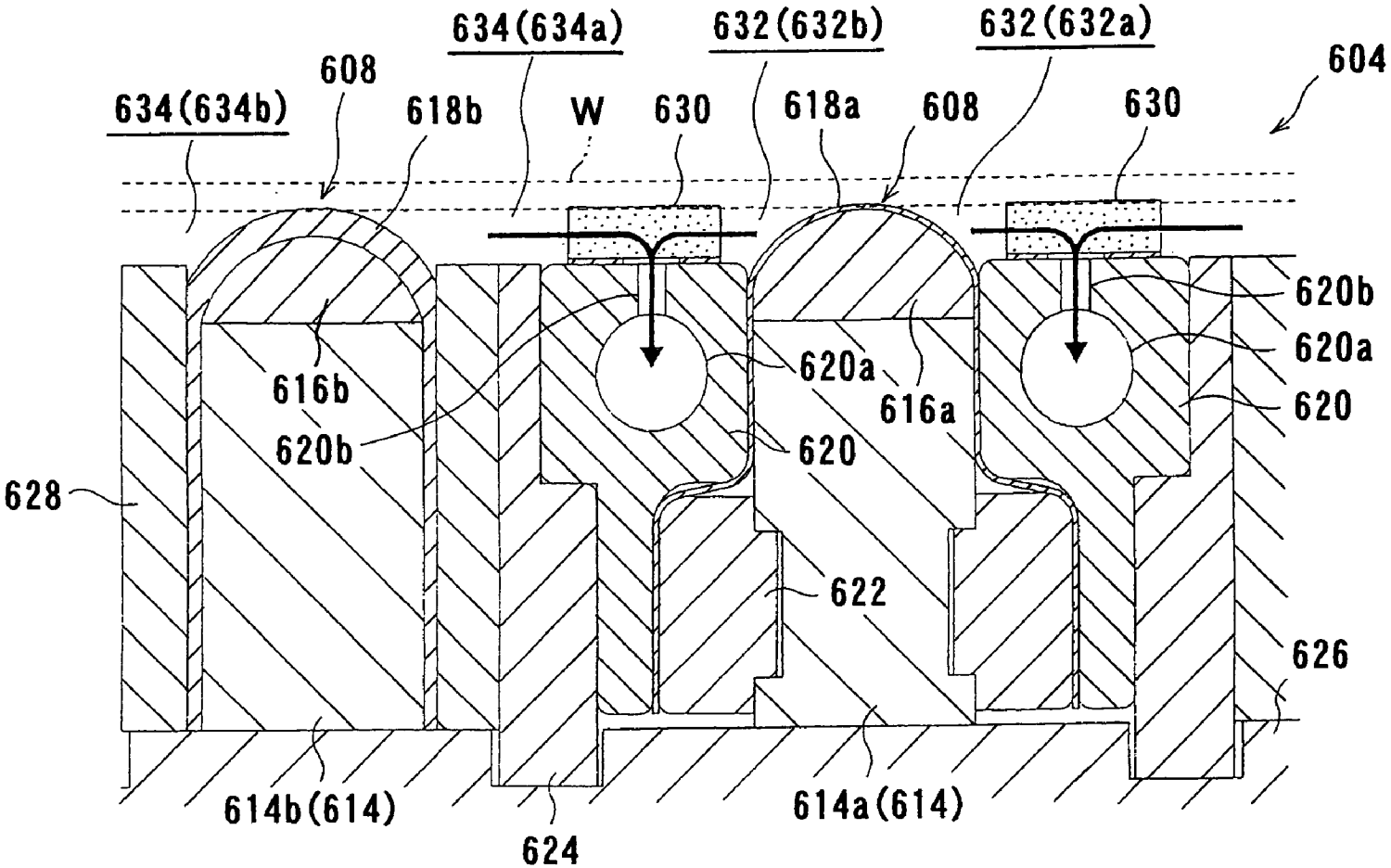
FIG. 54 is an enlarged view of a portion of FIG. 53.

FIG. 53 is a vertical sectional view showing the main portion of an electrolytic processing apparatus according to still another embodiment of the present invention, and FIG. 54 is an enlarged view of a portion of FIG. 53. As shown in FIG. 53, the electrolytic processing apparatus 600 includes a substrate holder 602 for holding a substrate W with its front surface facing downward, and a rectangular electrode section 604 provided below the substrate holder 602. The substrate holder 602, as with the substrate holder 42 shown in FIGS. 5 and 6, is rotatable and movable vertically and horizontally. The electrode section 604 is provided with a hollow scroll motor 606 and, by the actuation of the scroll motor 606, makes a circular movement without rotation, a so-called scroll movement (translational rotary movement).

The electrode section 604 includes a plurality of linearly-extending electrode members 608 and a vessel 610 which opens upwardly. The plurality of electrode members 608 are disposed in parallel at an even pitch in the vessel 610. Further, positioned above the vessel 610, a liquid supply nozzle 612 is disposed for supplying liquid, such as ultrapure water or pure water, into the vessel 610. The electrode members 608 each include an electrode 614 to be connected to a power source in the apparatus. The electrodes 614 are connected alternately to the cathode and to the anode of the power source, that is, electrodes (processing electrodes) 614*a* and electrodes (feeding electrodes) 614*b* are connected alternately to the cathode and to the anode of the power source. Thus, as described above, when processing copper, for example, the electrolytic processing action occurs on the anode side, and therefore the electrode 614 connected to the cathode becomes a processing electrode 614*a* and the electrode 614 connected to the anode becomes a feeding electrode 614*b*.

With respect to of each processing electrode 614*a* connected to the cathode, as shown in detail in FIG. 54, an ion exchanger 616*a* composed e.g. of a nonwoven fabric is mounted on the upper portion of the electrode. The processing electrode 614*a* and the ion exchanger 616*a* are covered integrally with a second ion exchanger 618*a* composed of ion exchange membrane which shuts off permeation therethrough of a liquid and permits only ions to pass therethrough. Similarly, an ion exchanger 616*b* composed e.g. of a nonwoven fabric is mounted on the upper portion of each feeding electrode 614*b* to be connected to the anode, and the feeding electrode 614*b* and the ion exchanger 616*b* are covered integrally with a second ion exchanger 618*b* which shuts off permeation therethrough of a liquid and permits only ions to pass therethrough. Accordingly, ultrapure water or a liquid passes through through-holes (not shown) provided at certain locations along the long direction of the electrode 614 and can move freely within the ion exchanger 616*a* or 616*b* composed of a nonwoven fabric and easily reach the active points, having water dissociation catalytic activity, within the nonwoven fabric, while the flow of the liquid is shut off by the ion exchanger 618*a* or 618*b*, which constitutes the below-described second partition.

A pair of liquid suction nozzles 620 is disposed on both sides of each processing electrode 614*a* connected to the cathode of the power source. In the interior of each liquid suction nozzle 620, a liquid flow passage 620*a*, extending in the long direction, is provided, and liquid suction holes 620*b*, which opens upward and communicates with the liquid flow passage 620*a*, are provided at certain locations along the long direction. As shown in FIG. 53, the liquid flow passage 620*a* communicates with a liquid discharge passage 621, and the liquid is discharged out from the liquid discharge passage 621.

The processing electrode 614*a* and the pair of liquid suction nozzles 620 are integrated by a pair of tap bars 622, and held between a pair of insert plates 624 and fixed on a base 626. On the other hand, the feeding electrode 614*b*, with its surface covered with the ion exchanger 618*b*, is held between a pair of holding plates 628 and fixed on the base 626.

The ion exchangers 616*a*, 616*b* are, for example, composed of a nonwoven fabric having an anion exchange group or a cation exchange group. As described above, it is possible to use a laminate of an anion exchanger having an anion exchange group and a cation exchanger having a cation exchange group, or impart both of anion exchange group and cation exchange group to the ion exchangers 616*a*, 616*b* themselves. A polyolefin polymer, such as polyethylene or polypropylene, or other organic polymers may be used as the base material of the ion exchangers. With respect to the base material of the electrodes 614 of the electrode members 608, rather than metals or metal compounds widely used for electrodes, it is preferred to use carbon, a relatively inactive noble metal, a conductive oxide or a conductive ceramic, as also described above.

A partition 630, composed of e.g. a continuous-pore porous material having elasticity, is mounted on the upper surface of each liquid suction nozzle 620 over the full length in the long direction. The thickness of the partition 630 is set at such a thickness that when the substrate W held by the substrate holder 602 is brought close to or into contact with the ion exchangers 618*a*, 618*b* of the electrode members 608 to carry out electrolytic processing of the substrate W, the upper surface of the partition 630 comes into pressure contact with the substrate W held by the substrate holder 602. Accordingly, upon electrolytic processing, flow paths 632 formed between the processing electrodes 614*a* and the substrate W, and flow paths 634 formed between the feeding electrodes 614*b* and the substrate, which are separated by the partitions 630, are formed in parallel between the electrode section 604 and the substrate holder 602. Further, each flow path 632 formed between the processing electrode 614*a* and the substrate W is separated into two flow paths 632*a*, 632*b* by the ion exchanger 618*a* as a second partition composed of an ion exchange membrane, while each flow path 634 formed between the feeding electrode 614*b* and the substrate W is separated into two flow paths 634*a*, 634*b* by the ion exchanger 618*b* as a second partition composed of an ion exchange membrane.

By the actuation of a suction pump connected to the liquid discharge passage 621, the liquid flowing along the flow paths 632, 634 flows into the partitions 630, then passes through the liquid suction holes 620*b*, the liquid flow passage 620*a* and the liquid discharge passage 621 and is discharged out. The use as the partition 630 a continuous-pore porous material thus cannot completely separate (shut off) the flow of the liquid, but can shut off the flow only partly. In this regard, however, a complete separation (shut-off) of the liquid is not necessary, and it is sufficient if the flow of the liquid can be blocked to a certain degree.

A polyurethane sponge may be used as the continuous-pore porous material having elasticity that constitutes the partition 630. The partition 630 may also be composed of a nonwoven fabric, a foamed polyurethane, a PVA sponge or an ion exchanger.

According to this embodiment, upon electrolytic processing, the vessel 610 is filled with a liquid, such as ultrapure water or pure water, supplied from the liquid supply nozzle 612, while a liquid, such as ultrapure water or pure water, is kept supplied from the through-holes (not shown) provided in the electrodes 614 to the ion exchangers 616*a*, 616*b* composed of a nonwoven fabric disposed on the upper portions of the processing electrodes 614*a* and the feeding electrodes 614*b*. An overflow channel 636 for discharging the liquid that has overflowed a circumferential wall 610*a* of the vessel 610 is provided outside the vessel 610. The liquid that has overflowed the circumferential wall 610*a* flows through the overflow channel 636 into a waste liquid tank (not shown).

During electrolytic processing, the suction pump connected to the liquid discharge passage 621 is driven, so that the liquid flowing along the flow paths 632 formed between the processing electrode 614*a* and the substrate W, and the flow paths 634 formed between the feeding electrodes 614*b* and the substrate is discharged out. Thus, upon electrolytic processing which is an electrochemical processing, the flows of the liquid flowing between the substrate W and the feeding electrodes 614*b* at which a gas generation reaction mainly occurs can at least partly be separated from the flows of the liquid flowing between the processing electrodes 614*a* and the substrate W, and the respective flows can be controlled independently, whereby the gas bubbles generated can be removed effectively.

It has been confirmed that when the flow paths 632 formed between the processing electrodes 614*a* and the substrate W are separated from the flow paths 634 formed between the feeding electrodes 614*b* and the substrate by using e.g. polyurethane sponges as the partitions 630 in a so-called multi-bar electrode system, the formation of pits decreases about on a single-digit order. This is considered to be due to the facts that (1) movement of the gas bubbles on the feeding electrode side to the surface of the workpiece is shut off by the partitions and (2) the flow path on the processing electrode side is restricted (i.e. the cross-sectional area of the flow path is decreased) by the partitions, whereby the flow velocity of ultrapure water on the processing electrode side is increased.

Figure 55:
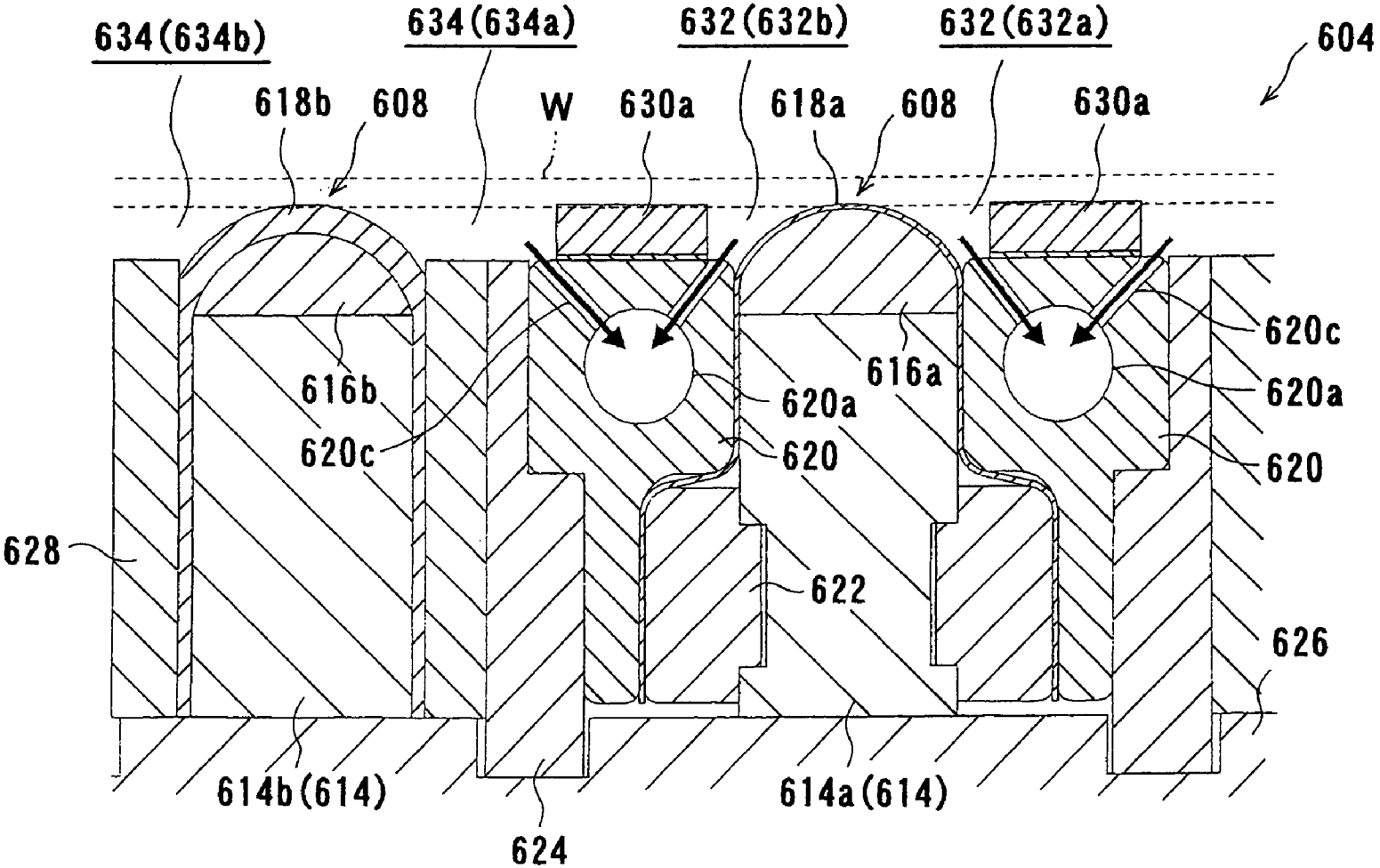
FIG. 55 is a view corresponding to FIG. 54, showing a variation of the electrode section.

FIG. 55 shows a variation of the electrode section 604. This embodiment employs as the partition 630*a* an elastic material, such as a rubber, which is not permeable to a liquid, and employs as the liquid suction nozzle 620 one having two liquid suction holes 620*c* which open to both sides of the partition 630*a*. The other construction is the same as the above-described embodiment. According to this embodiment, separation of the flow paths 632 formed between the processing electrodes 614*a* and the substrate W from the flow paths 634 formed between the feeding electrodes 614*b* and the substrate can be made complete.

Though not shown diagrammatically, it is possible to replace one of the pair of liquid suction nozzles, disposed on both sides of the processing electrode, with a liquid supply nozzle having liquid supply holes provided at certain locations along the long direction. By carrying out the supply of the liquid by means of the liquid supply nozzle and suction of the liquid by means of the liquid suction nozzle simultaneously, it becomes possible to more securely control the flow of the liquid flowing along the flow paths 632 formed between the processing electrodes 614*a* and the substrate W and the flow of the liquid flowing along the flow paths 634 formed between the feeding electrodes 614*b* and the substrate, and decrease the amount of the liquid that flows across the partitions into the adjacent spaces. It is also possible to replace both of the nozzles, disposed on both sides of the processing electrode, with liquid supply nozzles so as to push out the liquid flowing along the electrodes. Also in this case, the processing is carried out while the vessel 610 is kept filled with the liquid and the substrate is kept immersed in the liquid. It is therefore desirable to supply the processing liquid from the liquid supply nozzle 612.

In the above-described embodiments that show the case of mounting an ion exchanger on the electrode, the shape of the electrode and the liquid for use in processing are not particularly limited provided that the contact member 796 or the partition 630 can be provided between adjacent electrodes. Thus, the shape of electrode is not limited to a bar-like shape, but any shape of electrode can be selected, and a plurality of such electrodes may be disposed so that they will be opposed to a workpiece. It is possible to mount a water-permeable scrub member other than anion exchanger on the electrode. Further, it is possible to make the contact member or the partition higher than the electrode surface, thereby preventing direct contact between a workpiece and the electrode and making the surface of the electrode exposed. Even in the case of not mounting an ion exchanger on the surface of the electrode, the second partition for partitioning the flow of the liquid between a workpiece and the electrode is preferably provided.

According to the above-described embodiment shown in FIGS. 42 through 47, it is possible to arbitrarily control a pressure at which a substrate contacts the processing electrode by adjusting the pressure of the fluid supplied to the first pressure chamber 510. Accordingly, the surface pressure between the substrate and the processing electrodes can be so controlled that it is lower than a pressure at which a semiconductor devices can be destroyed, making it possible to process the substrate without destroying a fragile material.

According to the embodiment shown in FIG. 51, the surface pressure applied to a substrate can be adjusted by attaching the weight 410 of an appropriate weight to the chucking member. Thus, the surface pressure applied to the substrate can be made low with such a simple structure, enabling a low-load processing.

According to the embodiment shown in FIG. 52, by appropriately controlling the air cylinder 470, the force pressing the chucking member downward, i.e. the surface pressure applied to a substrate, can be adjusted, making it possible to make the surface pressure applied to the substrate low and effect a low-load processing. Further, even in the case where the processing parameters, etc. are altered, the case may be dealt with by simply regulating the pressing force of the air cylinder.

According to the embodiment shown in FIG. 48, after pressing a workpiece against the ion exchangers to a certain extent, the workpiece comes into contact with the upper surfaces of the contact members. Accordingly, the contact area can be kept constant, whereby a uniform processing can be effected.

Further, according to the embodiment shown in FIGS. 53 through 55, the gas bubbles generated mainly at the feeding electrodes can be removed effectively, whereby the formation of pits in the surface of a workpiece, which would be caused by the gas bubbles, can be prevented.

As described herein above, according to the present invention, unlike a CMP processing, electrolytic processing of a workpiece, such as a substrate, can be effected through an electrochemical action without causing any physical defects in the workpiece that would impair the properties of the workpiece. Further, the present electrolytic processing apparatus and method can effectively remove (clean) matter adhering to the surface of the workpiece. Accordingly, the present invention can omit a CMP processing entirely or at least reduce a load upon CMP. Furthermore, the electrolytic processing of a substrate can be effected even by solely using pure water or ultrapure water. This obviates the possibility that impurities such as an electrolyte will adhere to or remain on the surface of the substrate, can simplify a cleaning process after the removal processing, and can remarkably reduce a load upon waste liquid disposal.

While the present invention has been described above in terms of certain preferred embodiments, the present invention is not limited to the above-described embodiments and many variations and modifications can be made within the technical concept of the invention.

This invention relates to an electrolytic processing apparatus and electrolytic processing method useful for processing a conductive material formed in the surface of a substrate, especially a semiconductor wafer, or for removing impurities adhering to the surface of a substrate.

What is claimed is:

1. An electrolytic processing method for electrolytically processing a surface of a workpiece, comprising:

bringing the workpiece into contact with a processing electrode, the processing electrode having an ion exchanger disposed on a surface of the processing electrode and having a narrower width than the workpiece; and processing the surface of the workpiece while allowing the processing electrode and the workpiece to make a relative movement, wherein a substantial contact width between the workpiece and such a portion of the ion exchanger as used in processing is kept constant during the processing.

2. The electrolytic processing method according to claim 1, wherein at least a portion of the ion exchanger exposed on the surface of the processing electrode is brought into a substantial contact with the workpiece over a full width of the exposed portion.

3. An electrolytic processing method, comprising:

bringing a workpiece close to or into contact with a processing electrode having an ion exchanger covering a surface of an electrode;

applying a voltage between the processing electrode and a feeding electrode that feeds electricity to the workpiece;

supplying a fluid between the workpiece and at least one of the processing electrode and the feeding electrode; and processing a surface of the workpiece while allowing the processing electrode and the workpiece to make a first relative movement, which is a relative reciprocating movement in a first direction, and, at the same time, allowing the workpiece and the processing electrode to make a second relative movement, which is a relative movement in the first direction for a distance corresponding to an integral multiple of a pitch as determined in a processing amount distribution of the workpiece in the first direction, obtained in the first relative movement.

4. The electrolytic processing method according to claim 3, wherein a speed of the first relative movement is changed.

5. The electrolytic processing method according to claim 3, wherein the processing electrode is comprised of a plurality of electrode members disposed in parallel.

6. The electrolytic processing method according to claim 3, wherein the second relative movement is a reciprocating movement.

7. The electrolytic processing method according to claim 6, wherein the moving distance in the reciprocating movement of the second relative movement differs between a forward movement and a backward movement.

8. The electrolytic processing method according to claim 6, wherein the second relative movement is repeated, and the moving direction of the workpiece in the second relative movement is changed by rotating the workpiece through a predetermined rotational angle.

9. The electrolytic processing method according to claim 3, wherein at least one of the voltage and an electric current applied between the processing electrode and the feeding electrode is changed during electrolytic processing.

10. The electrolytic processing method according to claim 3, wherein a speed of the second relative movement is changed during electrolytic processing.

11. An electrolytic processing method, comprising:

bringing a workpiece close to or into contact with a processing electrode having an ion exchanger covering a surface of an electrode;

applying a voltage between the processing electrode and a feeding electrode that feeds electricity to the workpiece;

supplying a fluid between the workpiece and at least one of the processing electrode and the feeding electrode; and processing a surface of the workpiece while allowing the processing electrode and the workpiece to make a first relative movement and, at the same time, allowing the workpiece and the processing electrode to make a second relative movement in a first direction, wherein the second relative movement is repeated, and a moving direction of the workpiece in the second relative movement is changed by rotating the workpiece through a predetermined rotational angle.

12. The electrolytic processing method according to claim 11, wherein a speed of the first relative movement is changed.

13. The electrolytic processing method according to claim 11, wherein the rotation of predetermined rotational angle is repeated so that the workpiece makes at least one revolution until completion of the electrolytic processing of the workpiece.

14. The electrolytic processing method according to claim 11, wherein the workpiece is not rotated during the second relative movement.

15. The electrolytic processing method according to claim 11, wherein at least one of the voltage and an electric current applied between the processing electrode and the feeding electrode is changed during electrolytic processing.

16. The electrolytic processing method according to claim 11, wherein a speed of the second relative movement is changed during electrolytic processing.

17. A substrate holder for holding a substrate and bringing the substrate into contact with a processing electrode to carry out electrolytic processing of the substrate, comprising:

a flange portion connected to a shaft;

a chucking member which can move with respect to the flange portion in an axial direction of the shaft and which holds the substrate; and a first pressure chamber formed between the flange portion and the chucking member, the first pressure chamber being defined by the flange portion, the chucking member, and an elastic member linking the flange portion and the chucking member, wherein a fluid is supplied to the first pressure chamber to pressurize the first pressure chamber, thereby bringing the substrate held by the chucking member into contact with the processing electrode.

18. The substrate holder according to claim 17, further comprising:

an air cylinder for pressing the chucking member downward.

19. The substrate holder according to claim 17, the chucking member including:

a chucking plate having a through-hole communicating with the substrate;

a stopper plate provided above the chucking plate; and a second pressure chamber formed between the chucking plate and the stopper plate, wherein the second pressure chamber is depressurized by drawing a fluid from the second pressure chamber, thereby attracting the substrate to the chucking member.

20. The substrate holder according to claim 17, wherein a retainer ring having an inward-protruding portion is mounted to the flange portion, and a protrusion for engaging the protruding portion of the retainer ring is provided in the chucking member.

21. A substrate holder for holding a substrate and bringing the substrate into contact with a processing electrode to carry out electrolytic processing of the substrate, comprising:

a flange portion connected to a shaft;

a chucking member which can move with respect to the flange portion in an axial direction of the shaft and which holds the substrate; and a weight of a predetermined weight is attached to the chucking member to adjust a pressure applied to the processing electrode by the substrate.

22. An electrolytic processing method, comprising:

providing a processing electrode and a feeding electrode;

applying a voltage between the processing electrode and the feeding electrode;

holding a substrate by a substrate holder, the substrate holder including a flange portion connected to a shaft and a chucking member for holding the substrate;

disposing an ion exchanger between the substrate and at least one of the processing electrode and the feeding electrode; and allowing the substrate to be in contact with the processing electrode while allowing the substrate and the processing electrode to make a relative movement, thereby processing the surface of the substrate.

23. The electrolytic processing method according to claim 22, including:

supplying a fluid to a first pressure chamber formed between the flange portion and the chucking member of the substrate holder to pressurize the first pressure chamber, thereby bringing the substrate held by the chucking member into contact with the processing electrode.

24. The electrolytic processing method according to claim 23, wherein a pressure of the fluid supplied to the first pressure chamber is adjusted so that a pressure applied to the substrate becomes not more than 6.86 kPa.

* * * * *